US010625527B2

(12) United States Patent
Sato et al.

(10) Patent No.: US 10,625,527 B2
(45) Date of Patent: Apr. 21, 2020

(54) TAPE, TAPE ROLL, AND TAPE CARTRIDGE

(71) Applicant: Brother Kogyo Kabushiki Kaisha, Nagoya-shi, Aichi-ken (JP)

(72) Inventors: Yukihiko Sato, Nagoya (JP); Takaaki Banno, Nagoya (JP); Harumitsu Inoue, Toki (JP); Haruki Matsumoto, Nagoya (JP); Yukiko Takami, Inazawa (JP); Tsutomu Kato, Nagoya (JP); Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/853,244

(22) Filed: Dec. 22, 2017

(65) Prior Publication Data

US 2018/0250974 A1 Sep. 6, 2018

(30) Foreign Application Priority Data

Mar. 1, 2017 (JP) ..... 2017-038847

(51) Int. Cl.
*B41J 31/00* (2006.01)
*G09F 3/00* (2006.01)
(Continued)

(52) U.S. Cl.
CPC ..... *B41J 31/00* (2013.01); *B41J 3/4075* (2013.01); *B41J 32/00* (2013.01); *G09F 3/0288* (2013.01);
(Continued)

(58) Field of Classification Search
CPC ..... B41J 31/00; B41J 3/4075; B41J 32/00; G09F 3/04; G09F 3/0288; G09F 2003/0229
See application file for complete search history.

(56) References Cited

U.S. PATENT DOCUMENTS 4,363,685 A 12/1982 White
5,254,381 A 10/1993 Hoffmann et al.
(Continued)

FOREIGN PATENT DOCUMENTS

CN 1998036 A 7/2007
CN 101085559 A 12/2007
(Continued)

OTHER PUBLICATIONS

Jul. 17, 2018—(EP) Extended Search Report—App 17210644.5.
(Continued)

*Primary Examiner* — Kristal Feggins
(74) *Attorney, Agent, or Firm* — Banner & Witcoff, Ltd.

(57) ABSTRACT

A tape includes a sheet and an elongated label that includes first portions and second portions. A second-side end portion of a first-side second portion is connected to a first-side end portion of one first portion, and a first-side end portion of a second-side second portion is connected to a second-side end portion of the one first portion. The one first portion has a first length in a tape widthwise direction. Each of the first-side second portion and the second-side second portion has a second length in the widthwise direction of the tape and a third length in a tape longitudinal direction. The second length is greater than the first length. The one first portion has a fourth length in the tape longitudinal direction which is greater than or equal to a specific length and less than a sum of the specific length and the third length.

20 Claims, 24 Drawing Sheets

(51) Int. Cl.

| | |
|---|---|
| ***G09F 3/04*** | (2006.01) |
| ***B41J 3/407*** | (2006.01) |
| ***B41J 32/00*** | (2006.01) |
| *G09F 3/02* | (2006.01) |

(52) U.S. Cl.
CPC ..... *G09F 3/04* (2013.01); *G09F 2003/0229* (2013.01)

(56) References Cited

U.S. PATENT DOCUMENTS

| | | | |
|---|---|---|---|
| 5,662,976 | A | 9/1997 | Popat et al. |
| 6,364,364 | B1 | 4/2002 | Murphy |
| 6,413,604 | B1 | 7/2002 | Matthews et al. |
| 7,121,751 | B2 | 10/2006 | Harada et al. |
| 9,082,321 | B2 | 7/2015 | Nahm et al. |
| 9,483,962 | B2 | 11/2016 | Nahm et al. |
| 9,539,832 | B2 | 1/2017 | Sasaki |
| 9,852,665 | B2 | 12/2017 | Nahm et al. |
| 10,297,172 | B2 | 5/2019 | Nahm et al. |
| 2007/0015659 | A1 | 1/2007 | O'Kell et al. |
| 2007/0082163 | A1 | 4/2007 | Bolnick et al. |
| 2008/0025778 | A1 | 1/2008 | Ito et al. |
| 2008/0231423 | A1 | 9/2008 | Maeda et al. |
| 2009/0285617 | A1 | 11/2009 | Vandermeulen |
| 2011/0100539 | A1 | 5/2011 | Suehara et al. |
| 2013/0051891 | A1 | 2/2013 | Nahm et al. |
| 2015/0287347 | A1 | 10/2015 | Nahm et al. |
| 2016/0292541 | A1 | 10/2016 | Yasui et al. |
| 2016/0297217 | A1 | 10/2016 | Sasaki |
| 2017/0046987 | A1 | 2/2017 | Nahm et al. |
| 2018/0012522 | A1 | 1/2018 | Nahm et al. |
| 2018/0015748 | A1 | 1/2018 | Kato et al. |

FOREIGN PATENT DOCUMENTS

| | | | |
|---|---|---|---|
| CN | 101516628 | A | 8/2009 |
| CN | 103057300 | A | 4/2013 |
| JP | 2001-137017 | A | 5/2001 |
| JP | 2003-058062 | A | 2/2003 |
| JP | 2004-291534 | A | 10/2004 |
| JP | 2005-106952 | A | 4/2005 |
| JP | 2008-111926 | A | 5/2008 |
| JP | 2010-014929 | A | 1/2010 |
| JP | 2012-040879 | A | 3/2012 |
| JP | 2015-049479 | A | 3/2015 |
| WO | 2014/148060 | A1 | 9/2014 |
| WO | 2017/018249 | A1 | 2/2017 |

OTHER PUBLICATIONS

Jul. 17, 2018—(EP) Extended Search Report—App 17210672.6.
Jul. 17, 2018—(EP) Extended Search Report—App 17210694.0.
Brady Identification Solutions & Specialty Tapes, General Catalog, 2003, 292 pages.
Sep. 27, 2016—International Search Report—App PCT/JP2016/074679.
Sep. 27, 2016—Written Opinion of ISA—PCT/JP2016/074679.
Sep. 25, 2016—(US) Co-pending U.S. Appl. No. 15/714,182.
Dec. 22, 2017—(US) Co-pending U.S. Appl. No. 15/853,159.
Dec. 22, 2017—(US) Co-pending U.S. Appl. No. 15/852,702.
Dec. 22, 2017—(US) Co-pending U.S. Appl. No. 15/852,831.
Dec. 22, 2017—(US) Co-pending U.S. Appl. No. 15/852,987.
Nov. 15, 2018—(US) Notice of Allowance—U.S. Appl. No. 15/853,159.
Nov. 30, 2018—(US) Non-final Office Action—U.S. Appl. No. 15/852,702.
Jan. 25, 2019—(US) Notice of Allowance—U.S. Appl. No. 15/852,987.
Jul. 3, 2018—(JP) Notice of Reasons for Rejection—App 2015-171109.
Sep. 12, 2018—(US) Non-Final Office Action—U.S. Appl. No. 15/852,987.
Jan. 28, 2019—(CN) The First Office Action—Appl. No. 201680037009.7.
May 7, 2019—(US) Notice of Allowance—U.S. Appl. No. 15/852,702.
Jun. 25, 2019—(US) Non-final Office Action—U.S. Appl. No. 15/714,182.
May 29, 2019—(US) Notice of Allowance—U.S. Appl. No. 15/853,159.
Sep. 27, 2019—(CN) The Second Office Action—Appl. No. 201680037009.7.

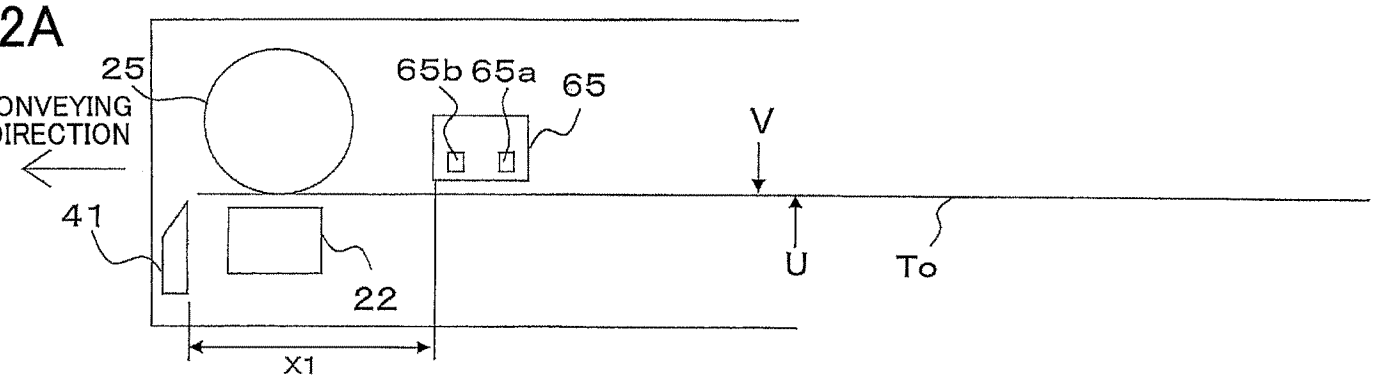
FIG.12A
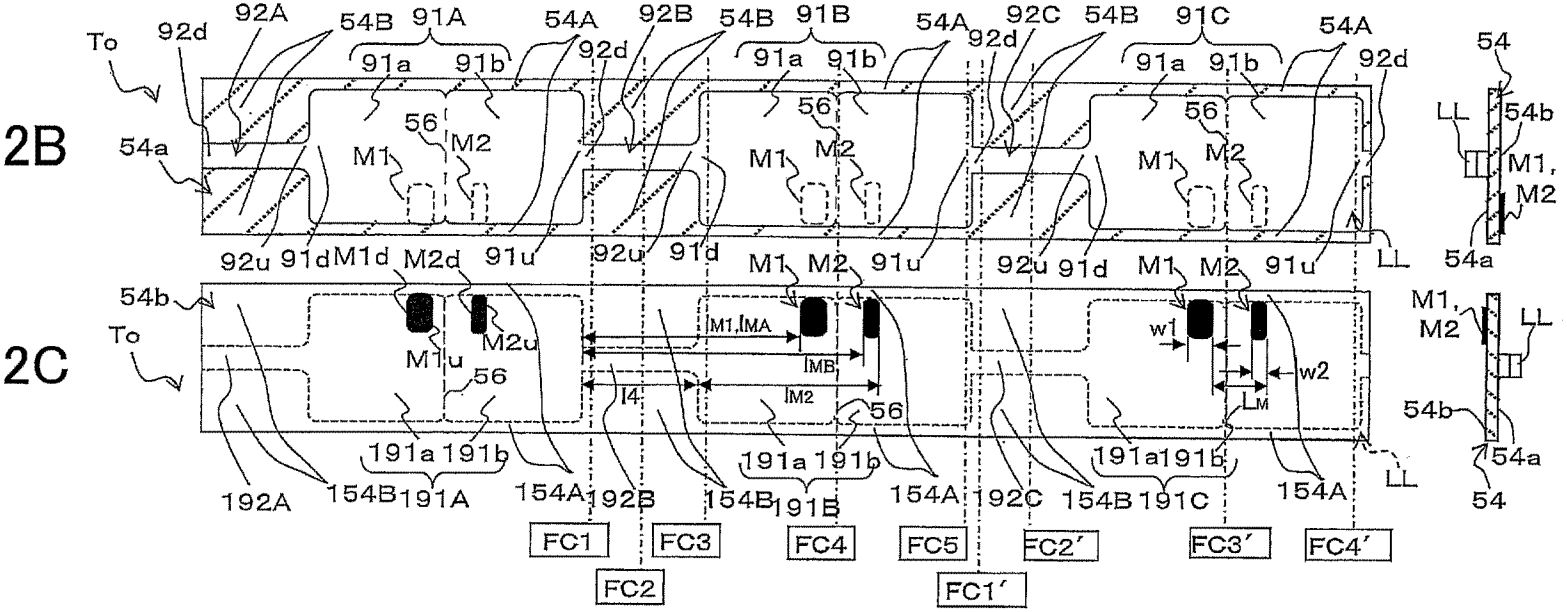
FIG.12B
FIG.12C

FIG.15

| | MINIMUM DOT | MAXIMUM DOT |
|---|---|---|
| MARK M1 | 125 | 175 |
| MARK M2 | 75 | 124 |

FIG.16

| | MARK DETECTED FIRST | |
|---|---|---|
| LABEL TYPE | MARK M1 | MARK M2 |
| L1 | ○ | × |
| L2 | ○ | × |
| L3 | ○ | ○ |
| L4 | ○ | ○ |
| L5 | ○ | ○ |

FIG.21

| | MINIMUM DOT | MAXIMUM DOT |
|---|---|---|
| MARK M1 | 125 | 175 |
| MARK M2 | 75 | 124 |
| MARK M3 | 25 | 74 |

FIG.22

| | MARK DETECTED FIRST | | |
|---|---|---|---|
| LABEL TYPE | MARK M1 | MARK M2 | MARK M3 |
| L1 | ○ | × | × |
| L2 | ○ | × | × |
| L3 | ○ | ○ | × |
| L4 | ○ | ○ | × |
| L5 | ○ | ○ | × |

TAPE, TAPE ROLL, AND TAPE CARTRIDGE

CROSS REFERENCE TO RELATED APPLICATION

The present application claims priority from Japanese Patent Application No. 2017-038847, which was filed on Mar. 1, 2017, the disclosure of which is herein incorporated by reference in its entirety.

BACKGROUND

The following disclosure relates to a tape, a tape roll, and a tape cartridge for creating a label.

There is known a label (a sticking tag) which is used by being separated from a sheet (i.e., a mount sheet) of a tape including a plurality of tags continuous to each other. The label includes a label portion (a character describing portion) and a sticking portion (an attachment portion). An image and/or characters such as a bar code is printed on the label portion. The sticking portion is used for attaching the label portion to an adherend (e.g., a product). When a user uses the label, the sticking portion coupled to the label portion is attached to the adherend in a state in which the image and/or the characters are in a desired orientation with respect to the adherend.

SUMMARY

In one aspect of the disclosure, a tape comprises: a sheet having a strip shape and extending in a longitudinal direction of the tape; and an elongated label extending in the longitudinal direction and stuck to the sheet, the elongated label comprising: a plurality of first portions each extending in the longitudinal direction; and a plurality of second portions, one of the plurality of second portions being located next to one of the plurality of first portions and located on a first side of the one of the plurality of first portions in the longitudinal direction, another of the plurality of second portions being located next to the one of the plurality of first portions and located on a second side of the one of the plurality of first portions in the longitudinal direction, the first side and the second side being opposite to each other in the longitudinal direction, a second-side end portion of the one of the plurality of second portion being connected to a first-side end portion of the one of the plurality of first portions, and a first-side end portion of the another of the plurality of second portions being connected to a second-side end portion of the one of the plurality of first portion, wherein the one of the plurality of first portions has a first length in a widthwise direction of the tape orthogonal to the longitudinal direction, each of the one of the plurality of second portions and the another of the plurality of second portions has a second length in the widthwise direction, the second length is greater than the first length.

In another aspect of the disclosure, a tape comprises: a sheet having a strip shape and extending in a longitudinal direction of the tape; and an elongated label extending in the longitudinal direction and stuck to the sheet, the elongated label comprising: a first sticking portion to be stuck to an adherend; a first label portion located on a first side of the first sticking portion in the longitudinal direction and on which printing is to be performed by a printing device, wherein a second side is opposite to the first side in the longitudinal direction of the tape; a second sticking portion which is located on the first side of the first label portion in the longitudinal direction and which is to be stuck to the adherend; and a second label portion which is located on the first side of the second sticking portion in the longitudinal direction and on which printing is to be performed by the printing device, wherein a first-side end portion of the first label portion is connected to a second-side end portion of the second sticking portion, a second-side end portion of the first label portion is connected to a first-side end portion of the first sticking portion, and a first-side end portion of the second sticking portion is connected to a second-side end portion of the second label portion, and wherein each of the first sticking portion and the second sticking portion has a first length in a widthwise direction of the tape orthogonal to the longitudinal direction, each of the first label portion and the second label portion has a second length in the widthwise direction, and the second length is greater than the first length, each of the first label portion and the second label portion has a third length in the longitudinal direction, and each of the first sticking portion and the second sticking portion has a fourth length in the longitudinal direction, and the fourth length is greater than or equal to a specific length and less than a sum of the specific length and the third length.

In yet another aspect of the disclosure, a tape cartridge comprises: a housing; an ink ribbon roll that is a roll of an ink ribbon; and a tape roll that is a roll of a tape, the tape comprising: a sheet having a strip shape and extending in a longitudinal direction of the tape; and an elongated label extending in the longitudinal direction and stuck to the sheet, the elongated label comprising: a plurality of first portions each extending in the longitudinal direction; and a plurality of second portions, one of the plurality of second portions being located next to one of the plurality of first portions and located on a first side of the one of the plurality of first portions in the longitudinal direction, another of the plurality of second portions being located next to the one of the plurality of first portions and located on a second side of the one of the plurality of first portions in the longitudinal direction, the first side and the second side being opposite to each other in the longitudinal direction, a second-side end portion of the one of the plurality of second portions being connected to a first-side end portion of the one of the plurality of first portions, a first-side end portion of the another of the plurality of second portions being connected to a second-side end portion of the one of the plurality of first portions, the one of the plurality of first portions having a first length in a widthwise direction of the tape, each of the one of the plurality of second portions and the another of the plurality of second portions having a second length in the widthwise direction, the second length being greater than the first length, each of the one of the plurality of second portions and the another of the plurality of second portions having a third length in the longitudinal direction, the one of the plurality of first portions having a fourth length in the longitudinal direction, the fourth length being greater than or equal to a specific length and less than a sum of the specific length and the third length.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which:

FIG. 12A is a view conceptually representing arrangement of a sensor, a platen roller, a thermal head, full cutters in a direction in which the tape is conveyed;

FIG. 12B is a plan view of the tape from which the outside-label portion is separated and which is viewed in the direction U in FIG. 12A;

FIG. 12C is a plan view of the tape from which the outside-label portion is separated and which is viewed in the direction V in FIG. 12A;

FIG. 15 is a view representing a mark recognition table relating to two marks;

FIG. 16 is a view representing a matching table relating to detection of the two marks, the matching table storing label-creatable information about whether creation of the label is allowed;

FIG. 21 is a view representing a mark recognition table relating to three marks;

FIG. 22 is a view representing a matching table relating to detection of the three marks, the matching table storing label-creatable information about whether creation of the label is allowed;

DETAILED DESCRIPTION OF THE EMBODIMENTS

Figure 1:
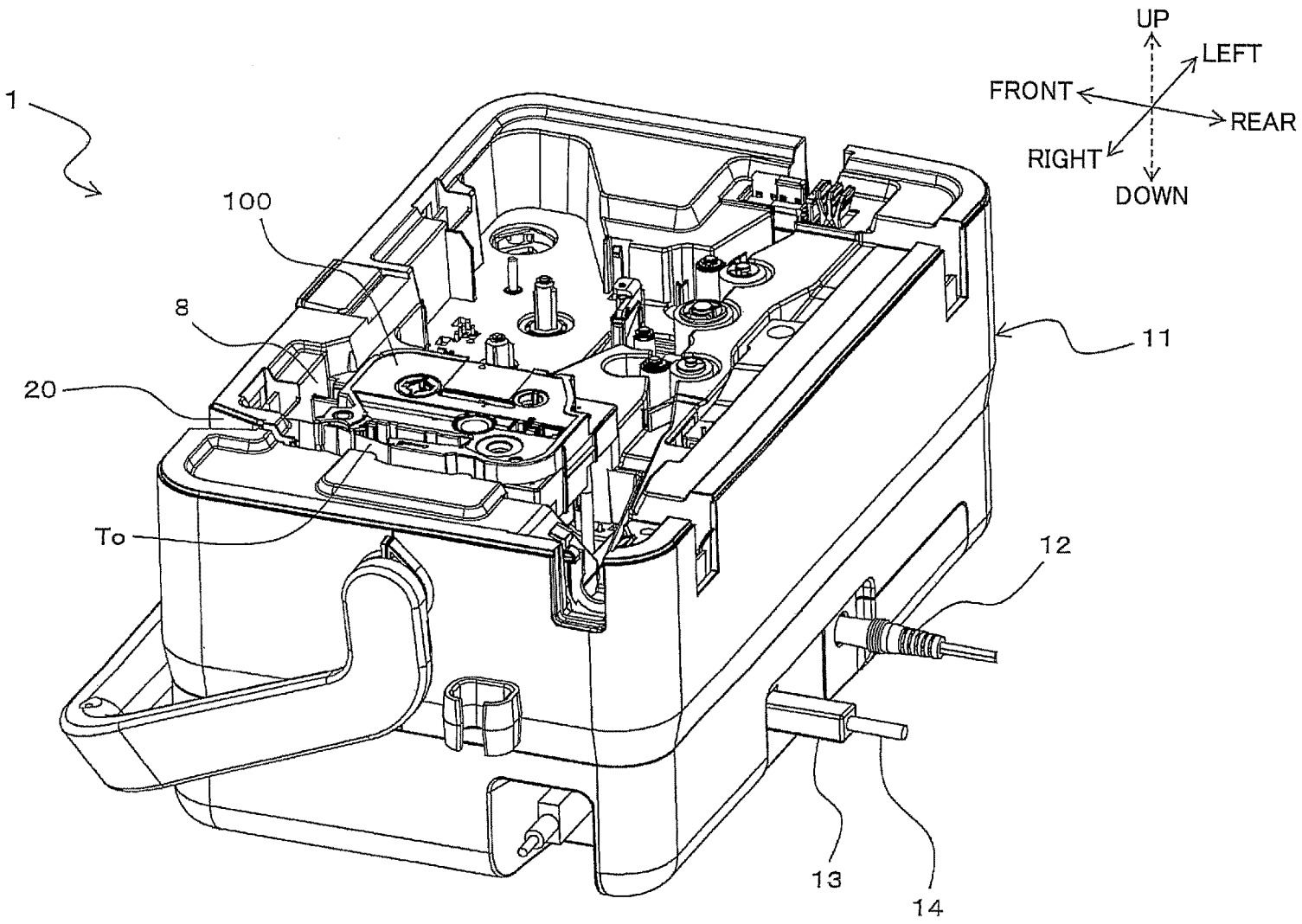
FIG. 1 is a perspective view of a printer according to one embodiment.

In the conventional technique, each of the label portion and the sticking portion has a fixed length. This configuration lacks applications to various uses of the label, such as (i) wrapping of the label portion around each of adherends of different diameters and (ii) change in the size of the label portion in accordance with the image and/or characters to be printed.

Accordingly, an aspect of the disclosure relates to a tape, a tape roll, and a tape cartridge capable of flexibly satisfying user's demand for various uses of a label.

Hereinafter, there will be described one embodiment by reference to the drawings. It is noted that "FRONT", "REAR", "RIGHT", "LEFT", "UP", and "DOWN" in the drawings respectively correspond to front, rear, right, left, up, and down sides or directions in the specification.

Overall Configuration of Printer

There will be described an overall configuration of a printer 1 according to the present embodiment with reference to FIG. 1. Examples of the printer include a label printer, a medium conveyor, and a label creating apparatus.

Figures 5A, 5B, 5C:
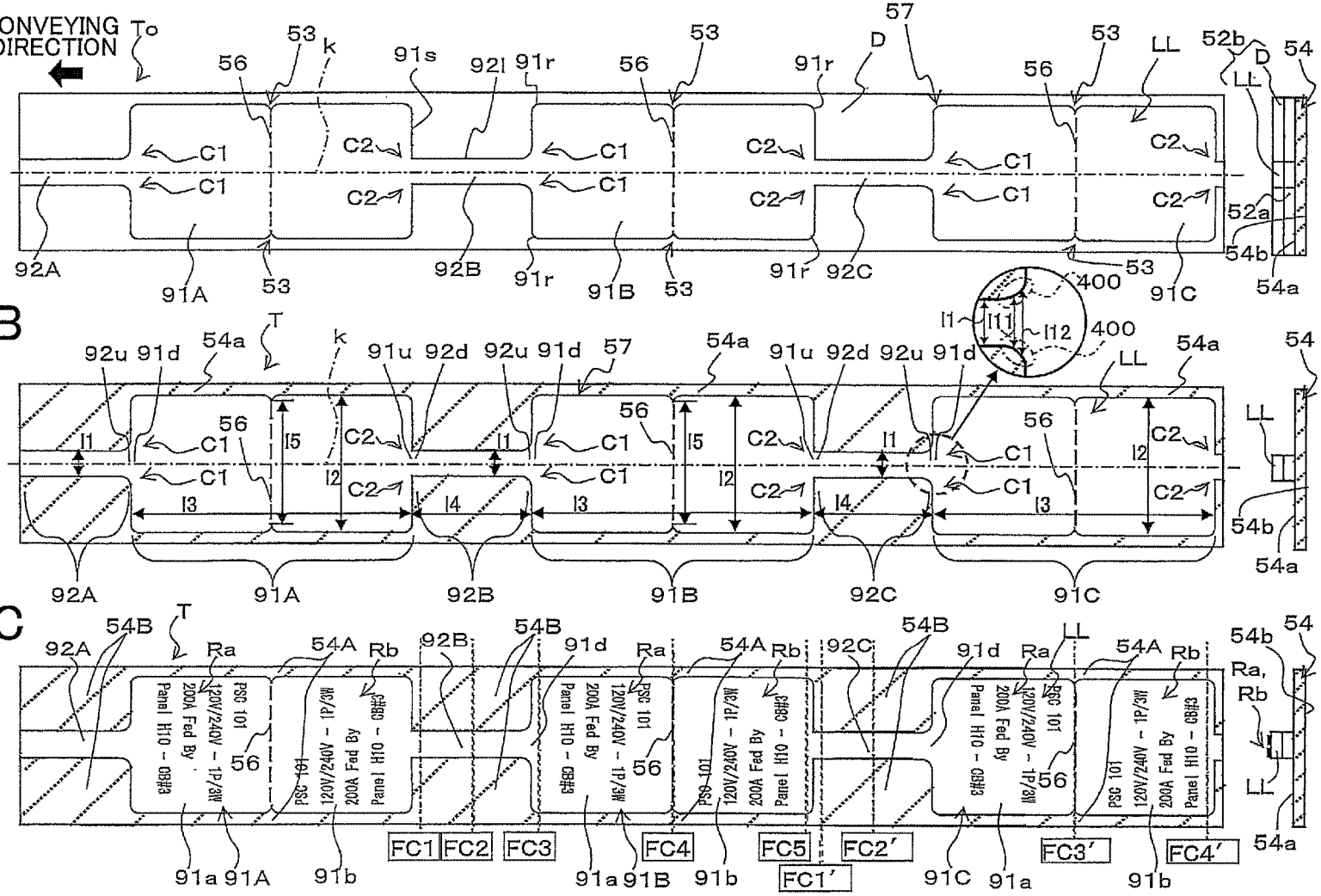
FIG. 5A is a plan view of a tape.
FIG. 5B is a plan view illustrating the tape without an outside-label portion separated from the tape in FIG. 5A.
FIG. 5C is a plan view of the tape printed at second portions in FIG. 5B.

The printer 1 illustrated in FIG. 1 is capable of printing characters on a tape To (see FIGS. 5B and 5C, for example). The tape To is a print tape and referred to as "tape T" after printing. The printer 1 may use various types of a tape cartridge 100 such as a thermal type, a receptor type, and a laminate type. In this description, the tape cartridge 100 of the receptor type is used. Also, the printer 1 may use the tape cartridge 100 of a die-cut-label type in which a cut frame 57 (see FIGS. 5B and 5C, for example) is formed in an adhesive sheet 52 of the tape To and may use the tape cartridge 100 of a type in which no cut frame is formed in the tape To (noted that this type may be hereinafter referred to as "normal label type"). It is noted that the tape cartridge 100 of the die-cut-label type includes a tape cartridge in which a cut frame is continuous in the longitudinal direction of the tape To as in FIGS. 5A and 5B, and the tape To is not fully cut in the widthwise direction of the tape To (that is, the tape To is continuous in the longitudinal direction). In the present embodiment, the tape cartridge 100 is of the normal label type by way of example.

The printer 1 includes: a main body 11 shaped like a substantially rectangular parallelepiped box; and a cover, not illustrated, capable of closing an opening formed in an upper portion of the main body 11. While FIG. 1 illustrates a state in which the cover is removed from the main body 11, the cover is pivotably supported by an upper portion of a rear end of the main body 11 in a state in which the cover is attached to the main body 11. A power-source connector 12 and a USB (Universal Serial Bus) connector 13 are disposed in a lower portion of a rear surface portion of the main body 11. The printer 1 is connected to an operation terminal 300 (see FIG. 4), such as a personal computer, via, e.g., a USB cable 14 connected to the USB connector 13. The printer 1 receives a print instructing signal (which will be described below) from the operation terminal 300 and performs printing on the tape To based on this print instructing signal. It is noted that the printer 1 and the operation terminal 300 may be connected over wireless communication. While the printer 1 may perform printing based on operations on the operation terminal 300 as described above, the printer 1 may perform printing based on operations on an operation device provided on the printer 1 as will be described below. This type of the printer 1 is called a standalone type.

A cartridge holder 8 is provided in an upper right portion of the main body 11. The cartridge holder 8 is a recess in which the tape cartridge 100 containing the tape To is removably mountable. For easy understanding, FIG. 1 illustrates the tape cartridge 100 at a position above its actual mounted position in the cartridge holder 8.

An output opening 20 is formed in a right portion of a front surface of the main body 11. The tape T (see FIGS. 5B and 5C) printed by a thermal head 22 which will be described below is conveyed by, e.g., a platen roller 25 which will be described below and is discharged from the cartridge holder 8 to the outside of the printer 1 through the output opening 20.

Internal Structure of Printer

Figure 2:
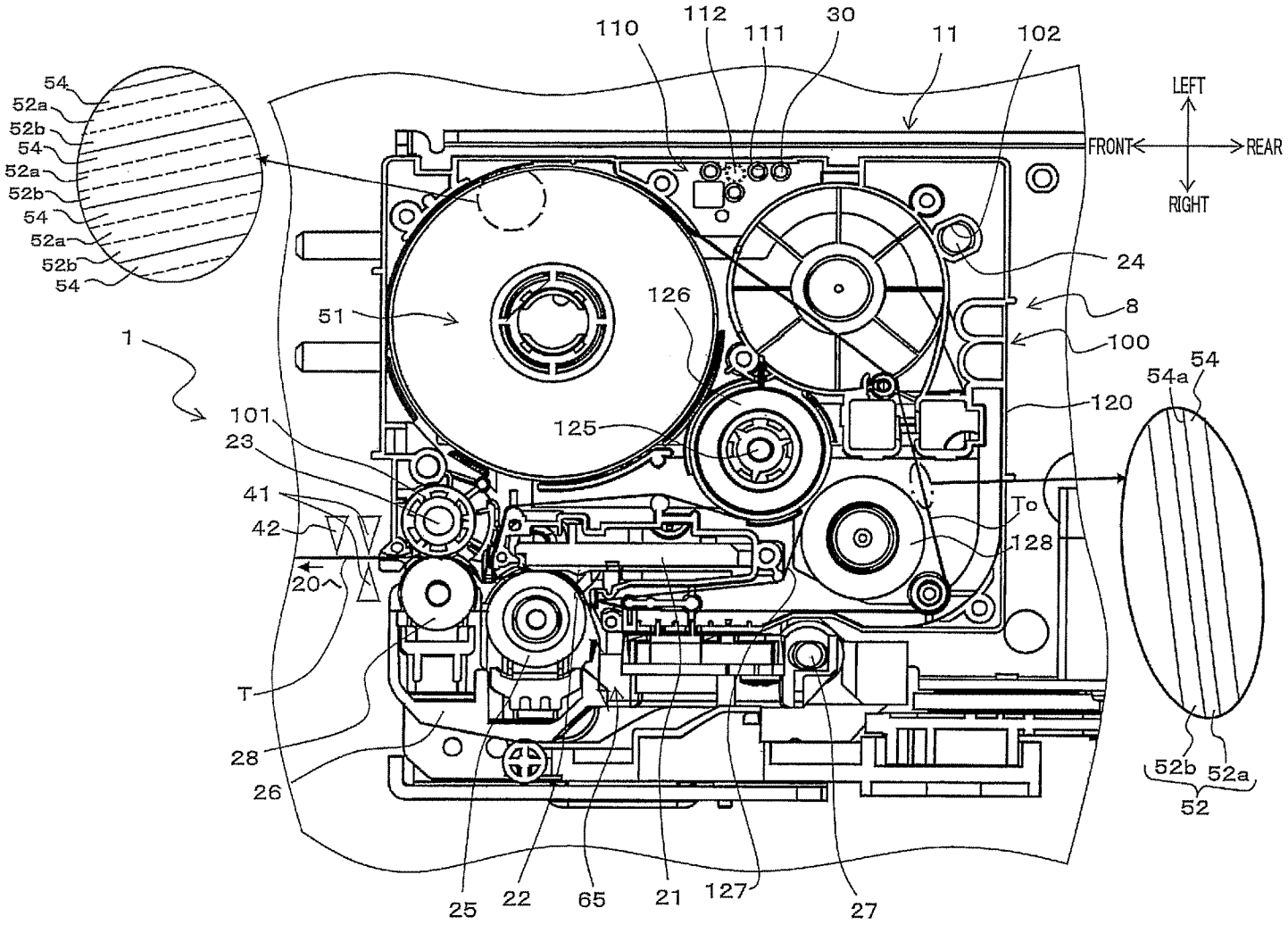
FIG. 2 is a plan view of a cartridge holder and components near the cartridge holder in the printer.

There will be next explained an internal structure of the printer 1 with reference to FIG. 2.

As illustrated in FIG. 2, the cartridge holder 8 in which the tape cartridge 100 is mountable is formed in the upper portion of the main body 11 as described above. A head holder 21 is provided upright at a right portion of a substantially central portion of the cartridge holder 8 in the front and rear direction. The head holder 21 is shaped like a plate extending in the front and rear direction. The thermal head 22 as one example of a printing device is provided on an upper surface of the head holder 21. The thermal head 22 includes a plurality of heating elements, not illustrated. The thermal head 22 uses an ink ribbon 127 which will be described below to perform printing on the tape To that is supplied from the tape cartridge 100 and conveyed along a predetermined conveyance path by, e.g., the platen roller 25 which will be described below.

A ribbon take-up shaft 125 is provided upright in the cartridge holder 8 at a position to the left of the head holder 21. The ribbon take-up shaft 125 is inserted in a ribbon take-up roller 126 disposed in the tape cartridge 100. The ribbon take-up shaft 125 rotates the ribbon take-up roller 126. An ink-supply-side roll 128 as one example of an ink ribbon roll is rotatably supported in the tape cartridge 100. The ink ribbon 127 is rolled on the ink-supply-side roll 128. The ribbon take-up roller 126 is rotated by the ribbon take-up shaft 125 to draw the ink ribbon 127 from the ink-supply-side roll 128 and take up the used ink ribbon 127.

A conveying-roller drive shaft 23 is provided upright in front of the head holder 21 in the cartridge holder 8. The conveying-roller drive shaft 23 is removably insertable in a conveying roller 101 in the tape cartridge 100. A guide shaft 24 is provided upright at a left corner of the cartridge holder 8. The guide shaft 24 is removably insertable in a guide hole 102 formed in the tape cartridge 100 (see also FIG. 3).

A drive motor 66 (see FIG. 4) in the form of a stepping motor is disposed under the cartridge holder 8 in the main body 11. The ribbon take-up shaft 125 and the conveying-roller drive shaft 23 are coupled to the drive motor 66 via a plurality of gears, not illustrated. The ribbon take-up shaft 125 and the conveying-roller drive shaft 23 are rotated by driving of the drive motor 66. The ribbon take-up roller 126 is rotated by driving of the ribbon take-up shaft 125. The conveying-roller drive shaft 23 is coupled to the platen roller 25 and a pressing roller 28 via a gear mechanism, not illustrated. The conveying roller 101, the platen roller 25, and the pressing roller 28 are rotated by rotation of the conveying-roller drive shaft 23.

A cartridge sensor 31 (see FIG. 4) is provided on a lower left support surface of the substantially central portion of the cartridge holder 8 in the front and rear direction. The cartridge sensor 31 is provided with a plurality of sensor protrusions 30 (five sensor protrusions 30 in this example) standing upright for depression. When the tape cartridge 100 is mounted in the cartridge holder 8, a detected portion 110, which will be described below, provided on the tape cartridge 100 is opposed to the sensor protrusions 30, and the detected portion 110 selectively depresses one or more of the sensor protrusions 30 which correspond to the type of the tape cartridge 100. Based on a combination on ON/OFF states of the sensor protrusions 30, the cartridge sensor 31 outputs a detection signal representing type information on the tape cartridge 100.

A platen holder 26 having an arm shape extending in the front and rear direction is disposed above and outside the cartridge holder 8 in the main body 11. The platen holder 26 is supported pivotably about a shaft holder 27. The platen roller 25 and the pressing roller 28 are rotatably supported at a front end portion of the platen holder 26. The conveying-roller drive shaft 23, the platen roller 25, and the pressing roller 28 constitute a conveyor. The platen roller 25 is opposed to the thermal head 22 and contactable with the thermal head 22. The pressing roller 28 is opposed to the conveying roller 101 and contactable with the conveying roller 101. When the platen holder 26 is moved toward the cartridge holder 8 by the above-described pivotal movement, and the platen roller 25 is moved to a printing position at which the platen roller 25 contacts the thermal head 22, the platen roller 25 presses the thermal head 22 via the tape To and the ink ribbon 127. At the same time, the pressing roller 28 presses the conveying roller 101 via the tape To. In this state, the tape To is conveyed by rotation of the conveying roller 101, the platen roller 25, and the pressing roller 28, and the ink ribbon 127 is drawn from the ink-supply-side roll 128 by rotation of the ribbon take-up roller 126, and printing is performed on the tape To by the thermal head 22.

Full cutters 41 and a half cutter 42 are provided near the output opening 20 in the main body 11. The full cutters 41 and the half cutter 42 constitute a cutter. The full cutters 41 are driven by a drive motor 71 (see FIG. 4) disposed in the main body 11, to perform full cut in which the tape To (the tape T after printing) is cut across its thickness in the widthwise direction of the tape, that is, all an adhesive layer 52*a* and a substrate 52*b* of the adhesive sheet 52 which will be described below and a separation sheet 54 which will be described below are cut. The half cutter 42 is driven by a drive motor 73 (see FIG. 4) disposed in the main body 11, to perform half cut in which the tape To (the tape T after printing) is partly cut in its thickness direction along the widthwise direction of the tape, that is, only the adhesive layer 52*a* and the substrate 52*b* of the adhesive sheet 52 are cut. The tape To (or the tape T) is cut by the half cutter 42 or the full cutters 41 (in other words, the full cut or the half cut is performed), so that labels (labels L1-L5 illustrated in FIGS. 6A-9C which will be described later) are created.

Construction of Tape Cartridge

Figure 3:
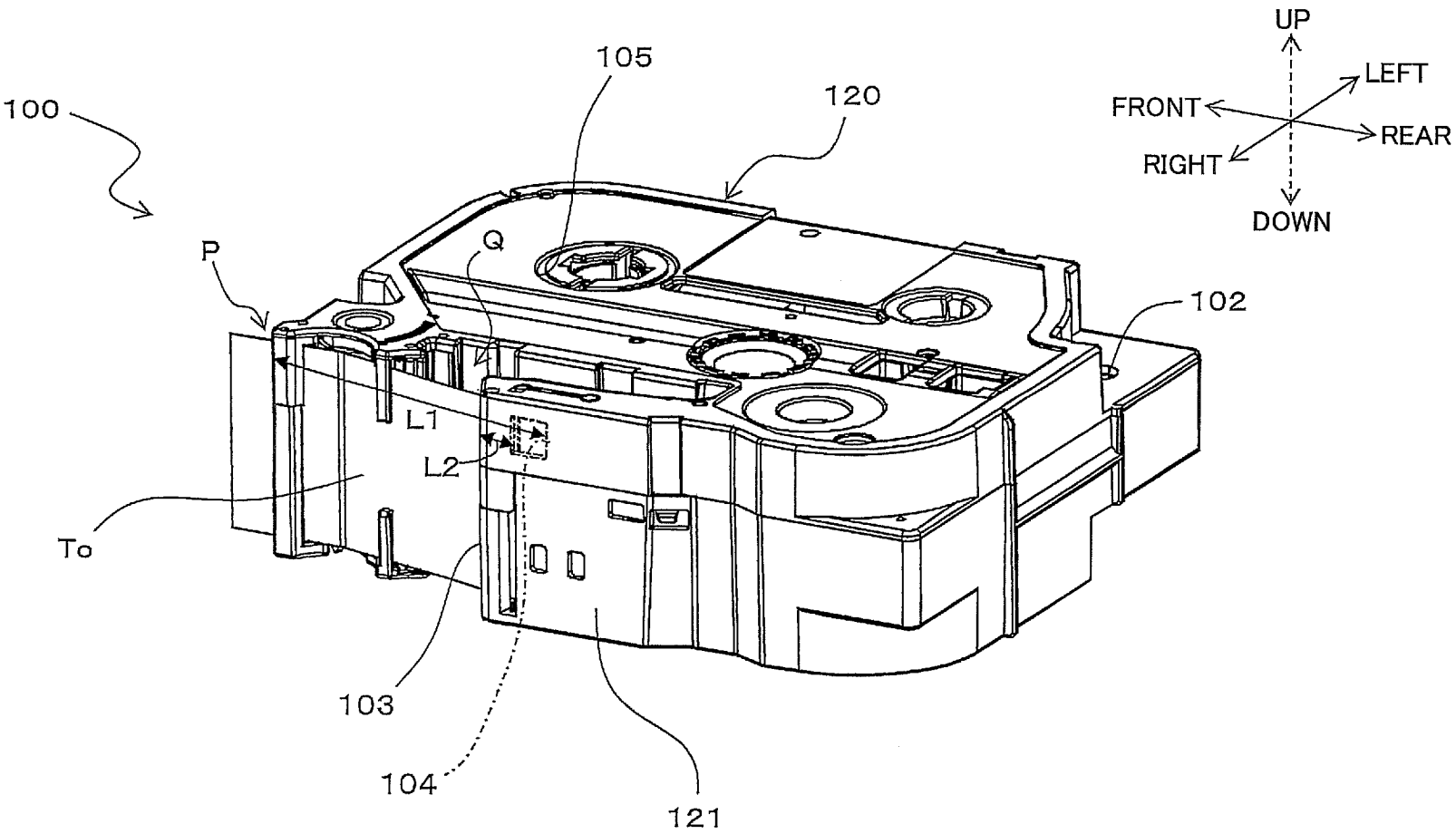
FIG. 3 is a perspective view of an external appearance of the entire tape cartridge.

There will be next explained a construction of the tape cartridge 100 with reference to FIGS. 2 and 3.

As illustrated in FIGS. 2 and 3, the tape cartridge 100 includes a substantially rectangular housing (a box-shape housing) 120 having rounded corner portions in plan view as a whole. A tape supply opening 103 is formed in a front portion of a right surface portion of the housing 120. The tape To is drawn from the tape cartridge 100 through the tape supply opening 103.

A tape-roll support opening 105 is formed in an upper surface of a front portion of the housing 120 to support a print-tape roll 51 (as one example of a tape roll) rotatably in the housing 120. The print-tape roll 51 is a roll of the tape To. As illustrated in the partly enlarged view in FIG. 2, the tape To is constituted by the adhesive sheet 52 and the separation sheet 54 stacked on each other in this order from an inner side (a left side in the partly enlarged view in FIG. 2 which will be referred to as a "front side") toward an outer side (a right side in the partly enlarged view in FIG. 2 which will be referred to as a "back side"). The adhesive sheet 52 has a strip shape extending in the longitudinal direction of the tape To and includes the adhesive layer 52*a* and the substrate 52*b* that is constituted by an elongated label LL and an outside-label portion D (see FIG. 5A). The separation sheet 54 as one example of the sheet has a strip shape extending in the longitudinal direction of the tape To. That is, the adhesive sheet 52 is located on an inner side of the separation sheet 54 in a radial direction of the print-tape roll 51. The thermal head 22 performs printing on a front surface of the substrate 52*b* (specifically, the elongated label LL which will be described below) as a front surface portion of the adhesive sheet 52. The adhesive sheet 52 has the adhesive layer 52*a* provided on a back side from the substrate 52*b*. The separation sheet 54 is provided on the adhesive layer 52*a* so as to be easily separable from the adhesive layer 52*a*. That is, the separation sheet 54 has one surface 54*a* and the other surface 54*b*, and the adhesive sheet 52 is separably stuck to the one surface 54*a*. In the present embodiment, the tape To is formed by sticking the strip-shaped adhesive sheet 52 to the entire strip-shaped separation sheet 54 whose length in a conveying direction is greater than that of the separation sheet 54 in the widthwise direction of the tape To. The conveying direction is a direction in which the tape To is conveyed by the platen roller 25 and other conveying components. It is noted that the tape To that has the adhesive sheet 52 stuck to the entire separation sheet 54 and has the cut frame 57 formed by the half cut may be used as the print-tape roll 51 as illustrated in FIG. 5A. Since this tape To has a constant thickness across the width of the tape To, it is possible to convey the tape To accurately. Alternatively, the tape To in which the one surface 54*a* of the separation sheet 54 is exposed at a region outside the elongated label LL in the widthwise direction of the tape To may be used as the print-tape roll 51 as illustrated in FIG. 5B. This configuration facilitates separation of the elongated label LL. Although this tape To has lower adhesion due to exposure of a portion of the separation sheet 54, the tape roll 51 is formed such that the adhesive sheet 52 is located on an inner side of the separation sheet 54. This configuration prevents first portions 92 from being peeled off from the separation sheet 54 when the tape roll 51 is formed. The tape To is drawn from the print-tape roll 51 and supplied from the tape supply opening 103 to a recessed portion Q of the housing 120 which is shaped like a cutout and corresponds to a position of the thermal head 22, so that the tape To is exposed with the ink ribbon 127. Ink of the ink ribbon 127 is then transferred to the tape To by the thermal head 22 (that is, printing is performed). The printed tape T is thereafter discharged from the housing 120 through an output opening P (formed at a position corresponding to the full cutters 41) and guided toward the output opening 20 formed in the main body 11.

The detected portion 110 indicating the type information on the tape cartridge 100 is provided on a lower surface of the front portion of the housing 120 at a substantially center of the front portion in the front and rear direction. The detected portion 110 indicates the type information on the tape cartridge 100 by combination of a surface portion 112 and insertion holes 111 formed in a lower surface of the tape cartridge 100 and opposed to the five sensor protrusions 30 of the cartridge sensor 31 provided on the main body 11.

Each of the insertion holes 111 is a round hole. When the tape cartridge 100 is mounted on the cartridge holder 8, the insertion hole 111 serves as a non-pressing portion that does not press a corresponding one of the sensor protrusions 30, so that the corresponding sensor protrusion 30 opposed to the insertion hole 111 is in an OFF state. When the tape cartridge 100 is mounted on the cartridge holder 8, the surface portion 112 serves as a pressing portion that presses a corresponding one of the sensor protrusions 30, so that the corresponding sensor protrusion 30 opposed to the surface portion 112 is in an ON state.

The tape cartridge 100 of the die-cut-label type has an opening 104 (as one example of an exposing portion) indicated by the one-dot chain line in FIG. 3 and formed in a side wall portion 121 of the housing 120 at a position near an upper side of the tape supply opening 103, e.g., at a position located upstream of the recessed portion Q. The opening 104 is for optical detection of marks M1, M2, M3 (which will be described later) printed on the tape To in advance for positioning control in conveyance. An optical sensor 65 detects the marks M1, M2, M3 through this opening 104 as will be described later.

Control Systems of Printer and Operation Terminal

Figure 4:
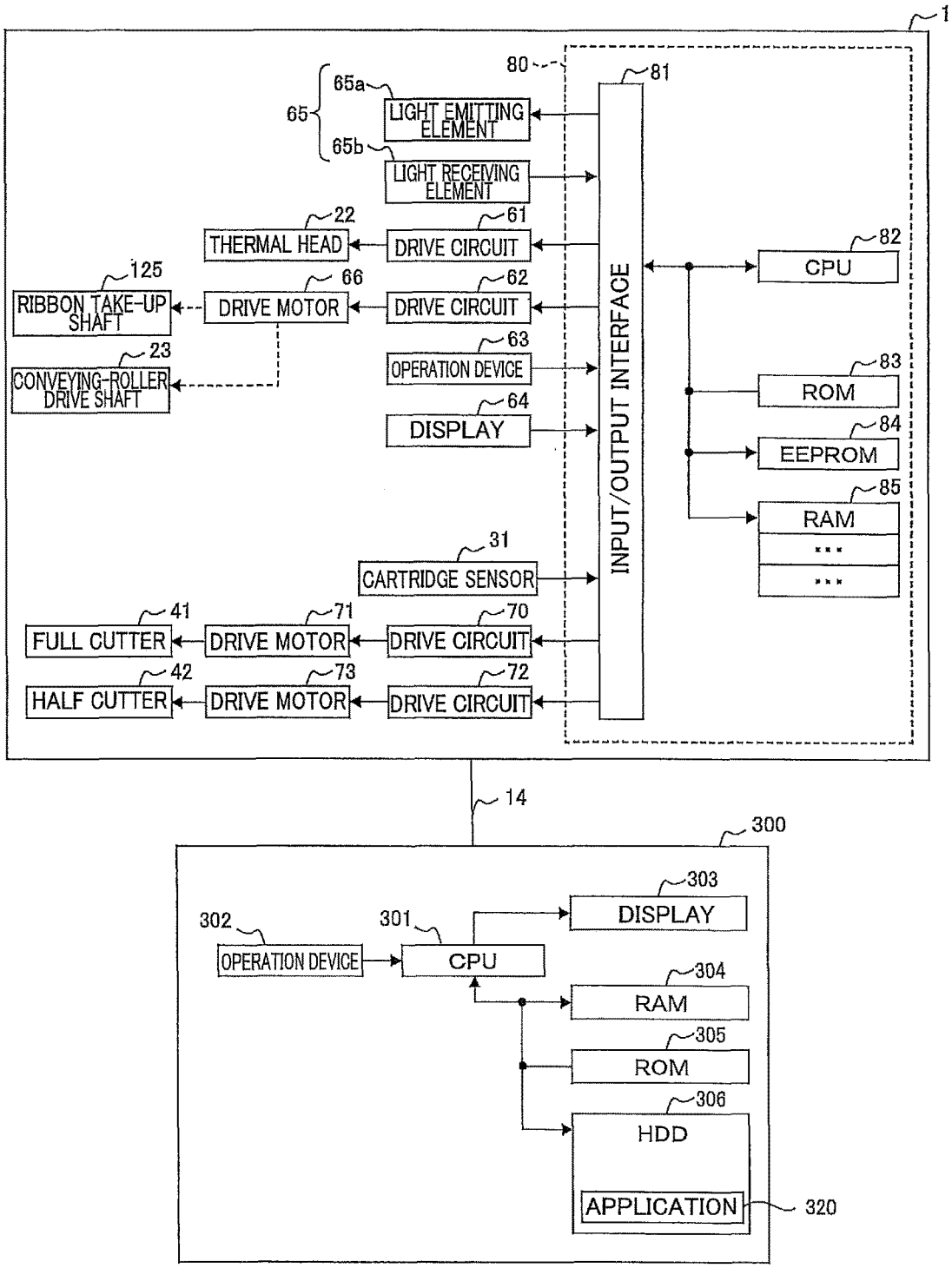
FIG. 4 is a block diagram illustrating control systems of the printer and an operation terminal.

There will be next explained control systems of the printer 1 and the operation terminal 300 with reference to FIG. 4.

As illustrated in FIG. 4, the printer 1 includes the control system including a control circuit 80 having a central processing unit (CPU) 82 as one example of a controller. In the control circuit 80, a read-only memory (ROM) 83, an electrically erasable programmable ROM (EEPROM) 84, a random-access memory (RAM) 85, and an input/output interface 81 are connected to the CPU 82 via data bus. It is noted that a non-volatile memory such as a flash memory may be used instead of the EEPROM 84.

The ROM 83 stores various kinds of programs and information required for control of the printer 1. Examples of the information include tables in FIGS. 15, 16, 21, and 22. The programs include a control program for execution of processings in the flow chart illustrated in FIG. 14 which will be described below. The ROM 83 is one example of a first storage and a second storage. The CPU 82 controls the printer 1 by processing signals according to the programs stored in the ROM 83 while using a temporary-storage function of the RAM 85.

The EEPROM 84 is a non-volatile memory that stores various kinds of information relating to the tape To. One example of the information is a relationship between each of various kinds of results of detection of the insertion holes 111 and the surface portion 112 by the cartridge sensor 31 and the type information on the tape cartridge 100. This configuration enables the CPU 82 to obtain the type information on the tape cartridge 100 by referring to the result of the detection for the tape cartridge 100 mounted on the cartridge holder 8.

Devices connected to the input/output interface 81 include a thermal-head drive circuit 61, a motor drive circuit 62, an operation device 63, a display 64, the optical sensor 65, the cartridge sensor 31, a motor drive circuit 70, and a motor drive circuit 72.

The thermal-head drive circuit 61 controls driving of the thermal head 22.

The motor drive circuit 62 controls driving of the drive motor 66 for driving the platen roller 25, the pressing roller 28, the ribbon take-up shaft 125, and the conveying-roller drive shaft 23.

The optical sensor 65 (see FIG. 2) emits light to the tape To through the opening 104 formed in the tape cartridge 100 of the die-cut-label type and detects a situation of conveyance of the tape To based on light reflected from the tape To. The optical sensor 65 includes a light emitting element 65*a* and a light receiving element 65*b* (see FIG. 4), for example. The light emitting element 65*a* is a light source, such as a light-emitting diode (LED), that radiates light or infrared rays in accordance with a flowing current. The light receiving element 65*b* is a sensor, such as a photodiode, that outputs a signal (voltage) in accordance with the received light or infrared rays. The opening 104 is formed at a position at a position corresponding to the marks M1, M2, M3 in the widthwise direction of the tape To. When the tape cartridge 100 is mounted on the cartridge holder 8, the opening 104 formed in the tape cartridge 100 is opposed to the optical sensor 65, and the marks M1, M2, M3 are detected through the opening 104. The optical sensor 65 is disposed such that a distance X1 between the optical sensor 65 and the full cutters 41 in the tape conveying direction (noted that this distance X1 may be hereinafter referred to as "sensor-to-cutter distance X1") is greater than a distance lMA which will be described below (lMA<X1).

The motor drive circuit 70 controls driving of the drive motor 71 for driving the full cutters 41.

The motor drive circuit 72 controls driving of the drive motor 73 for driving the half cutter 42.

It is noted that a label creating mechanism is constituted by devices including the thermal head 22, the thermal-head drive circuit 61, the ribbon take-up shaft 125, the conveying-roller drive shaft 23, the drive motor 66, the motor drive circuit 62, the full cutters 41, the drive motor 71, the motor drive circuit 70, the half cutter 42, the drive motor 73, and the motor drive circuit 72.

The operation terminal 300 includes the control system including a CPU 301 (as one example of a computing device). The operation terminal 300 is connected to the printer 1 by, e.g., the USB cable 14 and capable of transmitting and receiving signals to and from the printer 1. Devices connected to the CPU 301 include an operation device 302, a display 303, a RAM 304, a ROM 305, and a hard disk drive (HDD) 306. The ROM 305 stores information and various kinds of programs required for control of the operation terminal 300. The CPU 301 controls the operation terminal 300 by processing signals according to the programs stored in the ROM 305 while using a temporary-storage function of the RAM 304.

The HDD 306 stores an application program 320 for execution of processings in the flow chart illustrated in FIG. 11 which will be described below. The CPU 301 executes a procedure in FIG. 11, which will be described below, by executing the application program 320 in response to user's operation performed on the operation device 302, whereby the CPU 301 executes a procedure in FIG. 10, which will be described below, to send the printer 1 print data for printing on the labels (the labels L1-L5 in FIGS. 6A-9C) to be created by the printer 1.

That is, when the operation device 302 is operated by the user, the print instructing signal containing print data is output to the printer 1. In the printer 1, the ribbon take-up shaft 125 and the conveying-roller drive shaft 23 are driven by the motor drive circuit 62 and the drive motor 66 based on the print instructing signal, whereby the tape To is fed from the print-tape roll 51 in the tape cartridge 100, and the ink ribbon 127 is drawn from the ink-supply-side roll 128. Heating elements of the thermal head 22 are selectively heated by the thermal-head drive circuit 61 in synchronism with the feeding of the tape To by driving of the conveying-roller drive shaft 23, whereby the ink of the ink ribbon 127 is transferred to the tape To fed and conveyed, that is, printing is performed on the tape To based on the print data. Also, the half cutter 42 is driven by a motor drive circuit 77 and the drive motor 73, and the full cutters 41 are driven by the motor drive circuit 70 and the drive motor 71 to cut the printed tape T, thereby creating a desired number of labels.

Creation of Flag Label

In the present embodiment, what is called a flag label is created using the tape To. The flag label is attached to an adherend in a three-dimensional shape. The creation of the flag label will be explained below.

Structure of Print Tape

The structure of the tape To (the tape T after printing) in the present embodiment will be described with reference to FIG. 5A. FIG. 5A is a plan view of the unprinted and uncut tape To in a state in which the right and left direction in FIG. 5A coincides with the conveying direction (in other words, the longitudinal direction of the tape To), the up and down direction in FIG. 5A coincides with the widthwise direction of the tape To, and a front and back direction of the sheet surface of FIG. 5A coincides with the thickness direction of the tape To.

As illustrated in FIG. 5A, the tape To includes: the strip-shaped separation sheet 54 extending in the longitudinal direction of the tape To; and the adhesive sheet 52 extending in the longitudinal direction of the tape To. The adhesive sheet 52 includes the substrate 52*b* and the adhesive layer 52*a*, and the substrate 52*b* is stuck to the one surface 54*a* of the separation sheet 54, with the adhesive layer 52*a* interposed therebetween. The substrate 52*b* is formed of a resin film or a paper sheet, for example. The adhesive layer 52*a* is formed of acrylic adhesive, for example. The separation sheet 54 is formed by silicone processing on a front surface of the resin film or the paper sheet, for example.

The substrate 52*b* includes: the elongated label LL extending in the longitudinal direction of the tape To; and the outside-label portion D located on an outer portion of the substrate 52B in the widthwise direction of the tape To. The elongated label LL includes: a plurality of first portions 92A, 92B, 92C, and so on each extending in the longitudinal direction of the tape To; and a plurality of second portions 91A, 91B, 91C, and so on. It is noted that the first portions 92A, 92B, 92C, and so on may be collectively referred to as "first portions 92", and the second portions 91A, 91B, 91C, and so on may be collectively referred to as "second portions 91". Each of the first portions 92 serves as a sticking portion to be stuck to an adherend 19 or 19' as will be described later. Each of the second portions 91 serves as a label portion on which desired characters are printed as will be described later, for example.

As illustrated in FIG. 5A, the first portions 92A, 92B, 92C, and so on and the second portions 91A, 91B, 91C, and so on of the elongated label LL are connected to each other so as to be alternately arranged in the longitudinal direction of the tape To in the following order of the first first portion 92A, the first second portion 91A, the second first portion 92B, the second second portion 91B, the third first portion 92C, the third second portion 91C, and so on.

Specifically, focusing on the first portion 92B, for example, an upstream end portion 92*u* (see FIG. 5B) of the first portion 92B in the conveying direction is connected to a downstream end portion 91*d* (see FIG. 5B) of the second portion 91B in the conveying direction, and this second portion 91B is located just upstream (to the right side in FIG. 5B) of the first portion 92B in the conveying direction. The upstream end portion 92*u* is one example of a first-side end portion, and the downstream end portion 91*d* is one example of a second-side end portion. The upstream side is one example of a first side. Also, a downstream end portion 92*d* (see FIG. 5B) of the first portion 92B in the conveying direction is connected to an upstream end portion 91*u* (see FIG. 5B) of the second portion 91A located just downstream of the first portion 92B in the conveying direction. The downstream end portion 92*d* is one example of a second-side end portion, and the upstream end portion 91*u* is one example of a first-side end portion. The downstream side is one example of a second side. It is noted that the upstream side in the conveying direction and the downstream side in the conveying direction may be respectively referred to simply as "upstream side" and "downstream side".

It is noted that each of the first portion 92C, and so on arranged upstream of the first portion 92B has the same positional relationship as the first portion 92B with the second portions 91 located upstream and downstream of the first portion 92. As a result, each of the first portions 92 and each of the second portions 91 have the above-described relationship in the elongated label LL in which the first portions 92 and the second portions 91 are alternately arranged in the longitudinal direction of the tape To.

Regarding the functions of the sticking portions and the label portions, as in the above-described relationship, focusing on the first portion 92A (as one example of a first sticking portion), for example, the second portion 91A (as one example of a first label portion) is provided upstream of the first portion 92, and the first portion 92B (as one example of a second sticking portion) is provided upstream of the second portion 91A, and the second portion 91B (as one example of a second label portion) is provided upstream of the first portion 92B. In this arrangement, the upstream end portion 91*u* of the second portion 91A is connected to the downstream end portion 92*d* of the first portion 92B, the downstream end portion 91*d* of the second portion 91A is connected to the upstream end portion 92*u* of the first portion 92A, and the upstream end portion 92*u* of the first portion 92B is connected to the downstream end portion 91*d* of the second portion 91B. In this case, as in the above-described relationship, each of the first portions 92 and each of the second portions 91 of the elongated label LL have the same connection relationship as that of the first portion 92A, the second portion 91A located upstream of the first portion 92A, the first portion 92B located upstream of the second portion 91A, and the second portion 91B located upstream of the first portion 92B.

Each of the first portion 92 has a substantially rectangular shape elongated in the longitudinal direction of the tape To. The first portion 92 has a first length l1 (see FIG. 5B) in the widthwise direction of the tape To. Each of the second portions 91 has a second length l2 (see FIG. 5B) in the widthwise direction of the tape To specifically at a widest portion of the second portion 91. The second length l2 is greater than the first length l1. Specifically, the first length l1 is less than or equal to one third of the second length l2, for example. The positions of all the first portions 92A, 92B, 92C, and so on are the same in the widthwise direction of the tape To. In the present embodiment, the first length l1 is 7 mm, and the second length l2 is 25 mm by way of example.

The second portion 91 has a substantially rectangular shape elangated in the longitudinal direction of the tape To and having four curved corner portions 91*r*. The second portion 91 has a third length l3 (see FIG. 5B) in the longitudinal direction of the tape To. The first portion 92B has a fourth length l4 (see FIG. 5B) in the longitudinal direction of the tape To. This fourth length l4 is 0.3 times greater than or equal to the third length l3 and 1.3 times less than or equal to the third length l3, for example. In particular, the fourth length l4 may be less than or equal to the third length l3. It is noted that the fourth length l4 is greater than or equal to a predetermined specific length and less than the sum of the specific length and the third length l3, and the specific length is greater than or equal to 14 mm and less than or equal to 16 mm and may be 15 mm, for example. The technical significance of this configuration will be described later in detail. In the present embodiment, the third length l3 is 51 mm, and the fourth length l4 is 32 mm by way of example.

The second portion 91 has two slits 53 at its central portion in the longitudinal direction of the tape To. The slits 53 extend in the widthwise direction of the tape To respectively from opposite ends of the second portion 91 in the widthwise direction of the tape To, toward the center of the second portion 91 in the widthwise direction of the tape To.

The second portion 91 has a plurality of through holes 56 (as one example of a foldable line) arranged in the widthwise direction of the tape To at a central portion of the second portion 91 in the longitudinal direction of the tape To (between the slits 53). The through holes 56 are perforation and hereinafter may be referred to as "perforation 56". The perforation 56 is formed through the adhesive sheet 52 (including the substrate 52*b* and the adhesive layer 52*a*) in the thickness direction of the tape To. The second portion 91 has substantially line symmetry with respect to the perforation 56 formed in the second portion 91. In FIG. 5A, the second portion 91 has substantially line symmetry in the right and left direction.

It is noted that each of the first portion 92 and the second portion 91 has line symmetry with respect to a center line k extending in the longitudinal direction of the tape To through central positions of each of the first portion 92 and the second portion 91 in the widthwise direction of the tape To.

The cut frame 57 is formed by the half cut in advane around the elongated label LL (at a boundary between the elongated label LL and the outside-label portion D). This structure enables the elongated label LL and the outside-label portion D to be individually peeled off from the separation sheet 54.

FIG. 5B is a plan view illustrating a state in which only the outside-label portion D is peeled off from the separation sheet 54. As illustrated in FIG. 5B, the elongated label LL is stuck to the one surface 54*a* of the separation sheet 54, and the one surface 54*a* of the separation sheet 54 is exposed at a region located on an outer side of the elongated label LL in the widthwise direction of the tape To.

The upstream end portion 92*u* of the first portion 92 and the downstream end portion 91*d* of the second portion 91 are connected to each other by a first connecting portion C1. That is, the first connecting portion C1 is located downstream of the second portion 91. The first connecting portion C1 has a first connecting length l11 in the widthwise direction of the tape To at a first position indicated by "111" in the upper right partly enlarged view in FIG. 5B in this example. Also, the first connecting portion C1 has a second connecting length l12 at a second position indicated by "112" in the upper right partly enlarged view in FIG. 5B in this example. The second connecting length l12 is greater than the first connecting length 111 in the widthwise direction of the tape To. The second position is located nearer to the center of the second portion 91 (located just upstream of the first connecting portion C1) in the longitudinal direction of the tape To than the first position. In other words, the second position is located nearer to the perforation 56 than the first position in the longitudinal direction of the tape To. Each of the first connecting length l11 and the second connecting length l12 is greater than the first length l1 and less than the second length l2. With this structure, continuous curved parts of the first connecting portion C1 connecting the upstream end portion 92*u* of the first portion 92 and the downstream end portion 91*d* of the second portion 91 to each other respectively have reducing shape portions 400 for reducing stress concentration. In the present embodiment, the shape of an outer edge of each of the reducing shape portions 400 is an arc having a radius of 2 mm by way of example.

It is noted that the dimension 15 of the second portion 91 at the two slits 53 in the widthwise direction of the tape To is greater than each of the first length l1, the first connecting length l11, and the second connecting length l12 and less than the second length l2. In the present embodiment, the dimension 15 is 17 mm by way of example.

The downstream end portion 92*d* of the first portion 92 and the upstream end portion 91*u* of the second portion 91 which is located just downstream of the downstream end portion 92*d* are connected to each other by a second connecting portion C2. In the second connecting portion C2, one of first edges 921 of the first portion 92 which extend in the longitudinal direction of the tape To (in other words, the long sides of the rectangular shape of the first portion 92) and a corresponding one of second edges 91*s* of the second portion 91 which extend in the widthwise direction of the tape To (in other words, the short sides of the rectangular shape of the second portion) are orthogonal to each other, not forming continuous curved shapes.

Creation of Label

In the present embodiment, the tape To is conveyed by the platen roller 25 and other conveying components, and the thermal head 22 performs printing on the second portions 91 of the tape To based on the print data, on the basis of control of the CPU 82 based on the print instructing signal.

FIG. 5C illustrates a state in which images (e.g., character strings Ra, Rb) based on the print data are formed by the thermal head 22 on the second portions 91 illustrated in FIG. 5B. That is, each of the second portions 91A, 91B, 91C, and so on has a downstream first print region 91*a* (a left region in FIG. 5C); and an upstream second print region 91*b* (a right region in FIG. 5C). In this example, the character string Ra constituted by a character string "PSC 101 120V/240V-1P/3W 200A Fed By Panel H10-CB#3" is formed on the first print region 91*a* so as to be in a left-to-right horizontal line orientation when the first print region 91*a* stands upright with its upstream edge (in other words, an edge near the perforation 56) serving as an upper edge (see FIGS. 6A-6C, 7A-7C, and 8A-8F). The character string Rb constituted by a character string "PSC 101 120V/240V-1P/3W 200A Fed By Panel H10-CB#3" is formed on the second print region 91*b* so as to be in a left-to-right horizontal line orientation when the second print region 91*b* stands upright with its downstream edge (in other words, an edge near the perforation 56) serving as an upper edge (see FIGS. 6A-6C, 7A-7C, and 8A-8F). In other words, the character string Rb is formed on the second print region 91*b* so as to be in such an orientation that the character string Ra is rotated by 180 degrees about the center of the perforation 56 in the widthwise direction of the tape To. It is noted that first outer portions 54B and second outer portions 54A in FIG. 5C will be described later.

After the printing, the full cutters 41 cut the printed tape T to create the label having the printed second portion 91 and the first portion 92. In the present embodiment, the presence or absence and positions of cutting of the tape T by the full cutters 41 are changeable to create various labels (the labels L1-L5 in this example, see FIGS. 6A-9C). Examples of the cutting positions include cutting positions FC1, FC2, FC3, FC4, FC5, FC1', FC2', FC3', and FC4' indicated by the one-dot chain lines in FIG. 5C.

Examples of Use of Label

There will be next explained, with reference to FIGS. 6A-9C, examples of the various kinds of the labels created as described above. The following explanation is provided, taking the five types of the labels L1-L5 as an example.

Label L1

There will be explained, with reference to FIGS. 6A-6C, the label L1 created by cutting at the cutting positions FC1, FC1' in FIG. 5C.

As described above, the label L1 is created by cutting the printed tape T at the cutting position FC1 and the cutting position FC1' in FIG. 5C. That is, as illustrated in FIG. 6A, the label L1 is created so as to correspond to a combination of the first portion 92 (the first portion 92B in this example) and the second portion 91 (the second portion 91B in this example), and the length of the label L1 in the longitudinal direction of the tape T is substantially equal to that of the combination in the longitudinal direction of the tape T (i.e., the sum of the length of the first portion 92 in the longitudinal direction of the tape T and the length of the second portion 91 in the longitudinal direction of the tape T).

Figure 6A:
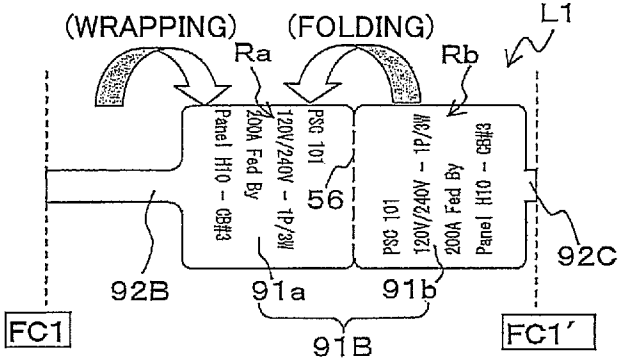
FIG. 6A is a plan view of a label created by cutting the printed tape.

As illustrated in FIG. 6A, the label L1 includes a portion of the elongated label LL of the tape T in FIG. 5C as a result of the cutting thereof at the cutting positions FC1, FC1'. Specifically, the label L1 includes: a most portion of the first portion 92B (except a portion thereof located downstream of the cutting position FC1); the entire second portion 91B; and a small portion of the first portion 92C (only a portion thereof located downstream of the cutting position FC1'). It is noted that each of these portions has the adhesive layer 52*a* on its back portion.

When cutting the tape T at the cutting positions FC1, FC1', the separation sheet 54 is also cut. Thus, the cut tape T includes the first outer portions 54B and the second outer portions 54A as portions of the separation sheet 54. In plan view, the first outer portions MB are located on opposite sides of the most portion of the first portion 92B and the small portion of the first portion 92C in the widthwise direction of the tape T (see FIG. 5C). In plan view, the second outer portions MA are located on opposite sides of the second portion 91B in the widthwise direction of the tape T (see FIG. 5C).

It is noted that the perforation 56 formed in the second portion 91 extends in the widthwise direction of the tape T between the first print region 91*a* and the second print region 91*b*. This perforation 56 is used for mountain fold which will be described below.

To use the label, as illustrated in FIG. 6A, the user peels the second portion 91B and the first portions 92B, 92C off from the separation sheet 54 of the cut tape T to obtain the label L1 having the second portion 91B and the first portions 92B, 92C. Thereafter, as illustrated in FIGS. 6B and 6C, the elongated strip-shaped first portion 92B of the label L1 is wrapped around the adherend 19, and the second portion 91B is folded along the perforation 56 so as to make a mountain fold. It is noted that the adherend 19 is a cable in this example and may be a tube or a pipe. Back surfaces of the first print region 91*a* and the second print region 91*b* of the second portion 91B of the label L1 are stuck to each other using the adhesive layer 52*a*. As illustrated in FIG. 6C, the distal end portion of the folded-back first portion 92B (i.e., the left end portion in FIG. 6A) is interposed between (i) the first print region 91*a* and (ii) the second print region 91*b* and the first portion 92C, thereby ensuring firm attachment. It is noted that the first portion 92C is stuck to a radially outer surface of the first portion 92B wrapped around the adherend 19 (an outer surface thereof in the radial direction).

Figure 6B:
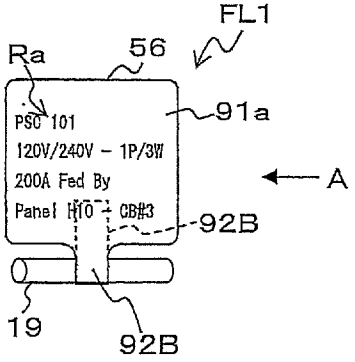
FIG. 6B is a view illustrating a state in which a flag label using the label in FIG. 6A is attached to an adherend.

With these operations, as illustrated in FIG. 6B, the first portions 92B, 92C connected to the folded second portion 91B are attached to the adherend 19, resulting in completion of a flag label FL1 in which surfaces of the first print region 91*a* and the second print region 91*b* superposed on each other are parallel with the axial direction of the adherend 19.

Figure 6C:
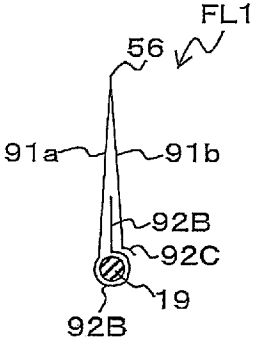
FIG. 6C is a view of the label viewed in the direction A in FIG. 6B.
Figure 6D:
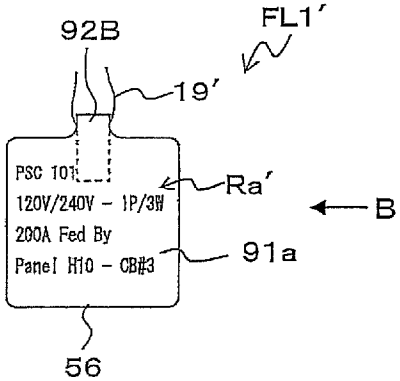
FIG. 6D is a view illustrating a state in which a flag label in an alternative example is attached to the adherend.
Figure 6E:
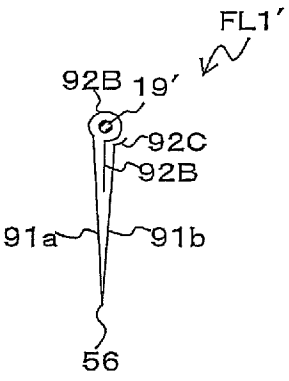
FIG. 6E is a view of the label viewed in the direction B in FIG. 6D.

As an alternative example, FIGS. 6D and 6E illustrate a flag label FL1' to be attached to the adherend 19' shaped not like a cable but like a piece of string. In this case, as in the above-described case, a flag label FL1' is formed by wrapping the first portion 92B around the adherend 19', folding the first portion 92B along the perforation 56, and sticking the back surfaces of the first print region 91*a* and the second print region 91*b* to each other.

In this case, the orientation of the characters to be printed on the above-described two print regions is reverse to that in the case in FIGS. 6A-6C. That is, a character string Ra' (see FIG. 6D) constituted by a character string "PSC 101 120V/240V-1P/3W 200A Fed By Panel H10-CB#3" is formed on the first print region 91*a* so as to be in a left-to-right horizontal line orientation when the first print region 91*a* stands upright with its perforation-side edge serving as a lower edge. Also, a character string Rb', not illustrated, constituted by a character string "PSC 101 120V/240V-1P/3W 200A Fed By Panel H10-CB#3" is formed on the second print region 91*b* so as to be in a left-to-right horizontal line orientation when the second print region 91*b* stands upright with its perforation-side edge serving as a lower edge. In other words, the character string Rb is formed on the second print region 91*b* so as to be in such an orientation that the character string Ra' is rotated by 180 degrees about the center of the perforation 56 in the widthwise direction of the tape To.

Label L2

Figure 7A:
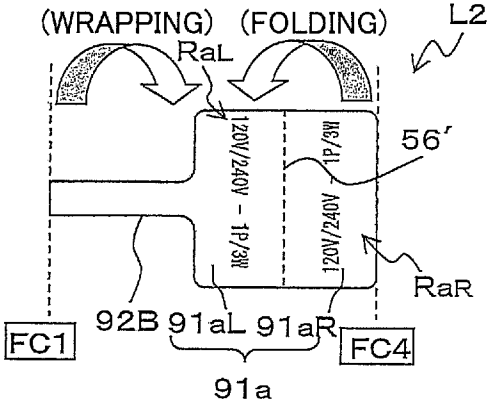
FIG. 7A is a plan view of a label created by cutting the printed tape.
Figure 7B:
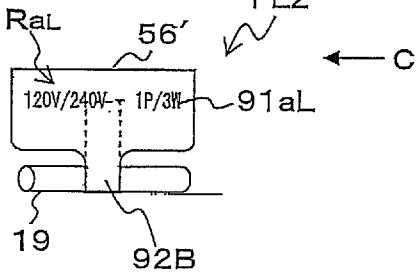
FIG. 7B is a view illustrating a state in which a flag label using the label in FIG. 7A is attached to the adherend.
Figure 7C:
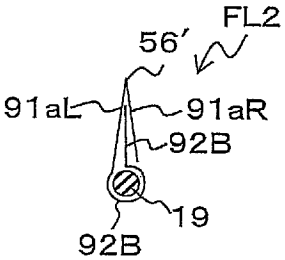
FIG. 7C is a view of the label viewed in the direction C in FIG. 7B.

There will be next explained, with reference to FIGS. 7A-7C, the label L2 created by cutting the tape T at the cutting positions FC1, FC4 illustrated in FIG. 5C.

As described above, the label L2 is created by cutting the printed tape T at the cutting position FC2 and the cutting position FC2' in FIG. 5C. That is, as illustrated in FIG. 7A, like the label L1, the label L2 is created so as to correspond to a combination of the first portion 92 (the first portion 92B in this example) and the second portion 91 (the second portion 91B in this example), and the length of the label L2 in the longitudinal direction of the tape T is substantially equal to the sum of a length substantially equal to the length of the first portion 92 in the longitudinal direction of the tape T and a half the length of the second portion 91 in the longitudinal direction of the tape T.

As illustrated in FIG. 7A, the label L2 includes a portion of the elongated label LL of the tape T in FIG. 5C as a result of the cutting thereof at the cutting positions FC1, FC4. Specifically, the label L2 includes: a most portion of the first portion 92B (except a portion thereof located downstream of the cutting position FC1); and a half portion of the second portion 91B (in other words, the first print region 91*a* located downstream of the cutting position FC4). It is noted that each of these portions has the adhesive layer 52*a* on its back portion. It is noted that when the tape T is cut at the cutting positions FC1, FC4, as in the above-described case, the tape T includes: the first outer portions 54B located on opposite sides of the first portion 92B in the widthwise direction of the tape T; and the second outer portions 54A located on opposite sides of the first print region 91*a* in the widthwise direction of the tape T.

To use the label, as illustrated in FIG. 7A, the user peels the first portion 92B and the first print region 91*a* off from the separation sheet 54 of the cut tape T to obtain the label L2 having the first portion 92B and the first print region 91*a*. Thereafter, as illustrated in FIGS. 7B and 7C, the elongated strip-shaped first portion 92B of the label L2 is wrapped around the adherend 19, and the first print region 91*a* is folded at a mountain-fold portion 56' (indicated by the broken line in FIG. 7A for easy understanding) so as to make a mountain fold. The first print region 91*a* has a portion 91*a*L located on one side (to the left side in FIG. 7A) of the mountain-fold portion 56' and a portion 91*a*R located on the other side (to the right side in FIG. 7A) of the mountain-fold portion 56'. Back surfaces of the portion 91*a*L and the portion 91*a*R are stuck to each other using the adhesive layer 52*a*.

In this example, a character string RaL constituted by a character string "120V/240V-1P/3W" is formed on the one-side portion 91*a*L of the first print region 91*a* so as to be in a left-to-right horizontal line orientation when the one-side portion 91*a*L stands upright with the mountain-fold portion 56' serving as an upper edge (see FIG. 7B). Also, a character string RaR constituted by a character string "120V/240V-1P/3W" is formed on the other-side portion 91*a*R of the first print region 91*a* so as to be in a left-to-right horizontal line orientation when the other-side portion 91*a*R stands upright with the mountain-fold portion 56' serving as an upper edge (see FIG. 7B).

In the above-described sticking, as illustrated in FIG. 7C, the distal end portion of the folded-back first portion 92B (i.e., the left end portion in FIG. 6A) is interposed between the one-side portion 91*a*L and the other-side portion 91*a*R.

With these operations, as illustrated in FIG. 7B, the first portion 92B connected to the folded first print region 91*a* is attached to the adherend 19, resulting in completion of a flag label FL2 in which surfaces of the one-side portion 91*a*L and the other-side portion 91*a*R superposed on each other are parallel with the axial direction of the adherend 19.

Labels L3, L4

Figure 8A:
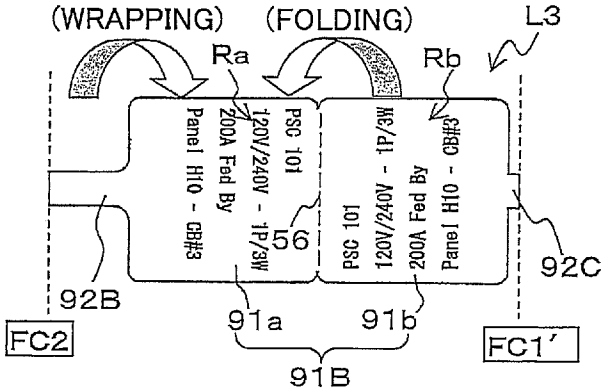
FIG. 8A is a plan view of a label created by cutting the printed tape.
Figure 8B:
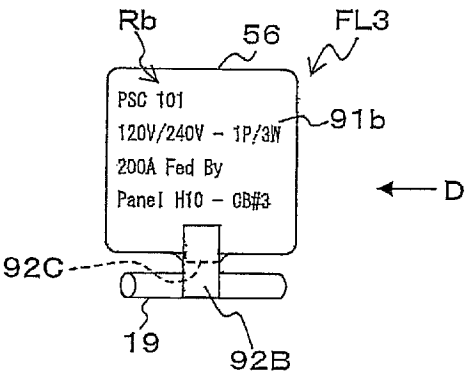
FIG. 8B is a view illustrating a state in which a flag label using the label in FIG. 8A is attached to the adherend.
Figure 8C:
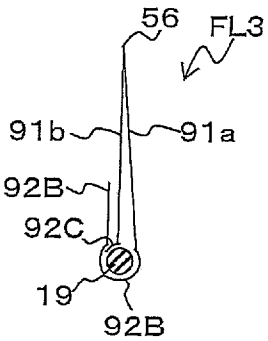
FIG. 8C is a view of the label viewed in the direction D in FIG. 8B.

There will be next explained, with reference to FIGS. 8A-8C, the label L3 created by cutting the tape T at the cutting positions FC2, FC1' illustrated in FIG. 5C.

As described above, the label L3 is created by cutting the tape T at the cutting position FC2 and the cutting position FC1' in FIG. 5C. That is, as illustrated in FIG. 8A, like the label L1, the label L3 is created so as to correspond to a combination of the first portion 92 (the first portion 92B in this example) and the second portion 91 (the second portion 91B in this example), and the length of the label L1 in the longitudinal direction of the tape T is substantially equal to the sum of a half of the length of the first portion 92 in the longitudinal direction of the tape T and the length of the second portion 91 in the longitudinal direction of the tape T.

Specifically, as illustrated in FIG. 8A, the label L3 includes a portion of the elongated label LL of the tape T in FIG. 5C as a result of the cutting thereof at the cutting positions FC2, FC1'. Specifically, the label L3 includes: about a half portion of the first portion 92B (except a portion thereof located downstream of the cutting position FC2); the entire second portion 91B; and a small portion of the first portion 92C (only a portion thereof located downstream of the cutting position FC1'). It is noted that each of these portions has the adhesive layer 52*a* on its back portion. It is noted that, when the tape T is cut at the cutting positions FC2, FC1', as in the above-described case, the tape T includes: the first outer portions MB located on opposite sides of the first portions 92B, 92C in the widthwise direction of the tape T; and the second outer portions MA located on opposite sides of the second portion 91B in the widthwise direction of the tape T.

To use the label, as illustrated in FIG. 8A, the first portions 92B, 92C and the second portion 91B are peeled off from the separation sheet 54 of the cut tape T to obtain the label L3 having the first portions 92B, 92C and the second portion 91B. Thereafter, as illustrated in FIGS. 8B and 8C, the elongated strip-shaped first portion 92B of the label L3 is wrapped around the adherend 19, and the second portion 91B is folded along the perforation 56 so as to make a mountain fold. Then, back surfaces of the first print region 91*a* (with the character string Ra similar to that in FIG. 6) of the second portion 91B of the label L3 and the second print region 91*b* (with the character string Rb similar to that in FIG. 6) of the second portion 91B of the label L3 are stuck to each other using the adhesive layer 52*a*. In this sticking, as illustrated in FIG. 8C, an end portion of the second print region 91*b* (a right end portion thereof in FIG. 8A) and the first portion 92C are interposed between the folded first portion 92B and the first print region 91*a*. As a result, the distal end portion of the first portion 92B is located on the second print region 91*b*, thereby facilitating removal.

With these operations, as illustrated in FIG. 8B, the first portions 92B, 92C connected to the folded second portion 91B are attached to the adherend 19 (the first portion 92B is stuck to a front portion of the second print region 91*b*), resulting in completion of a flag label FL3 in which the surfaces of the first print region 91*a* and the second print region 91*b* superposed on each other are parallel with the axial direction of the adherend 19.

Figure 8D:
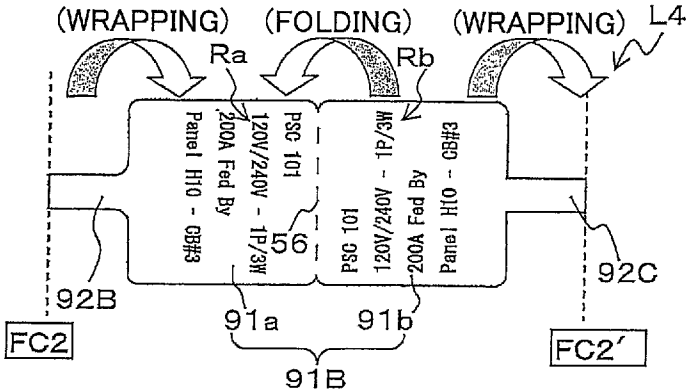
FIG. 8D is a plan view of the label cut at first portions that are different from cutting positions in FIG. 8A.
Figure 8E:
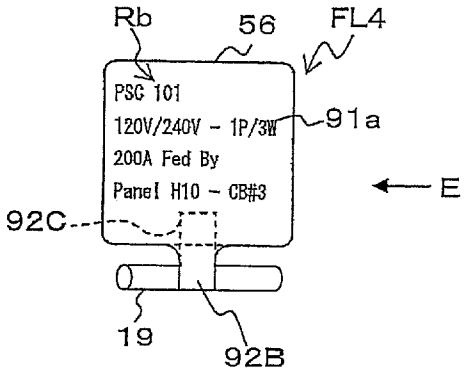
FIG. 8E is a view illustrating a state in which a flag label using the label in FIG. 8D is attached to the adherend.
Figure 8F:
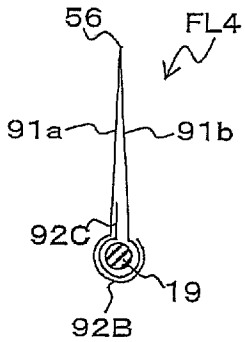
FIG. 8F is a view of the label viewed in the direction E in FIG. 8E.

As an alternative example, FIGS. 8D-8F illustrate one example of creation of a flag label FL4 from the label L4. The flag label FL4 and the label L4 are respectively different from the flag label FL4 and the label L4 in an overlapping manner in attachment.

As described above, the label L4 is created by cutting the tape T at the cutting position FC2 and the cutting position FC2' in FIG. 5C. That is, as illustrated in FIG. 8D, like the label L1, the label L4 is created so as to correspond to a combination of the first portion 92 (the first portion 92B in this example) and the second portion 91 (the second portion 91B in this example), and the length of the label L1 in the longitudinal direction of the tape T is substantially equal to the sum of the length of the first portion 92 in the longitudinal direction of the tape T and the length of the second portion 91 in the longitudinal direction of the tape T.

As illustrated in FIG. 8D, the label L4 includes a portion of the elongated label LL of the tape T in FIG. 5C as a result of the cutting thereof at the cutting positions FC2, FC2'. Specifically, the label L4 includes: about a half portion of the first portion 92B (except a portion thereof located downstream of the cutting position FC2); the entire second portion 91B; and about a half portion of the first portion 92C (a portion thereof located downstream of the cutting position FC2'). It is noted that each of these portions has the adhesive layer 52*a* on its back portion. It is noted that, when the tape T is cut at the cutting positions FC2, FC2', as in the above-described case, the tape T includes: the first outer portions MB located on opposite sides of the first portions 92B, 92C in the widthwise direction of the tape T; and the second outer portions MA located on opposite sides of the second portion 91B in the widthwise direction of the tape T.

To use the label, as illustrated in FIG. 8D, the first portions 92B, 92C and the second portion 91B are peeled off from the separation sheet 54 of the cut tape T to obtain the label L4 having the first portions 92B, 92C and the second portion 91B. Thereafter, as illustrated in FIGS. 8E and 8F, the first portion 92C of the elongated strip-shaped first portions 92B, 92C of the label L4 is wrapped around the adherend 19, and the second portion 91B is folded along the perforation 56 so as to make a mountain fold. Then, back surfaces of the first print region 91*a* (with the character string Ra similar to that in FIG. 6) of the second portion 91B of the label L4 and the second print region 91*b* (with the character string Rb similar to that in FIG. 6) of the second portion 91B of the label L4 are stuck to each other using the adhesive layer 52*a*. In this sticking, as illustrated in FIG. 8F, the first portion 92C is interposed between (i) the second print region 91*b* and (ii) the first portion 92B and the first print region 91*a* folded so as to be wrapped around an outer circumferential surface of the adherend 19 after the wrapping of the first portion 92S.

With these operations, as illustrated in FIG. 8E, the first portions 92B, 92C connected to the folded second portion 91B are attached to the adherend 19 (the first portion 92C is stuck to a back portion of the first print region 91*a*), resulting in completion of the flag label FL4 in which the surfaces of the first print region 91*a* and the second print region 91*b* superposed on each other are parallel with the axial direction of the adherend 19.

Label L5

Figure 9A:
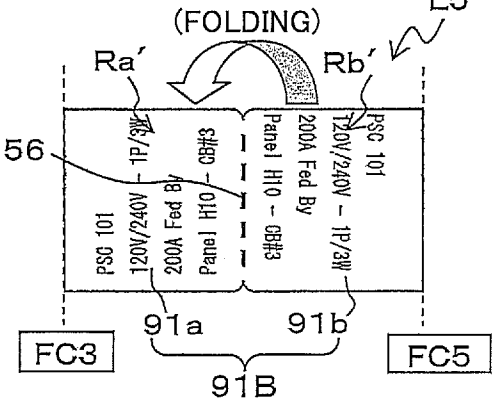
FIG. 9A is a plan view of a label created by cutting the printed tape.
Figure 9B:
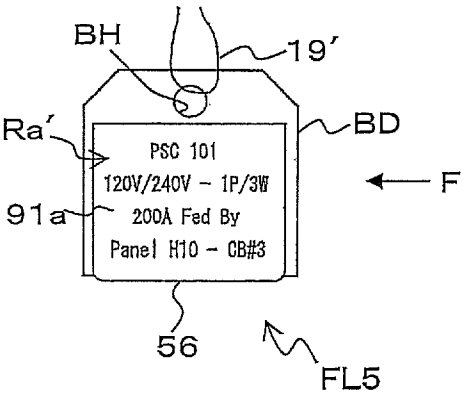
FIG. 9B is a view illustrating a state in which a flag label using the label in FIG. 9A is attached to the adherend.
Figure 9C:
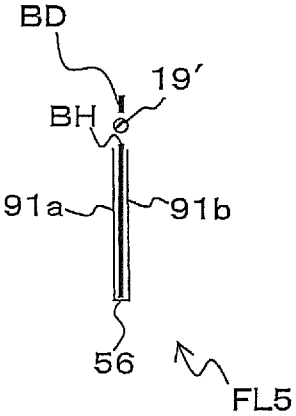
FIG. 9C is a view of the label viewed in the direction F in FIG. 9B.

There will be next explained, with reference to FIGS. 9A-9C, the label L5 created by cutting the tape T at the cutting positions FC3, FC5 illustrated in FIG. 5C.

As described above, the label L5 is created by cutting the tape T at the cutting position FC3 and the cutting position FC5 in FIG. 5C. That is, as illustrated in FIG. 9A, the label L5 is created so as to correspond to the second portion 91 (the second portion 91B in this example), and the length of the label L5 in the longitudinal direction of the tape T is substantially equal to that of the one second portion 91 in the longitudinal direction of the tape T.

As illustrated in FIG. 9A, the label L5 includes a portion of the elongated label LL of the tape T in FIG. 5C as a result of the cutting thereof at the cutting positions FC3, FC5. Specifically, the label L5 includes the entire second portion 91B. It is noted that the second portion 91B has the adhesive layer 52*a* on its back portion. It is noted that, when the tape T is cut at the cutting positions FC3, FC5, as in the above-described case, the tape T includes the second outer portions MA located on opposite sides of the second portion 91B in the widthwise direction of the tape To.

To use the label, as illustrated in FIG. 9A, the second portion 91B is peeled off from the separation sheet 54 of the cut tape T to obtain the label L5 having the second portion 91B. Thereafter, as illustrated in FIGS. 9B and 9C, the label L5 is folded along the perforation 56 so as to make a mountain fold such that a board BD is interposed between the first print region 91*a* and the second print region 91*b*. Back surfaces of the first print region 91*a* and the second print region 91*b* are stuck to the board BD using the adhesive layer 52*a*. In other words, the back surfaces of the first print region 91*a* and the second print region 91*b* of the second portion 91B are stuck to each other, with the board BD interposed between the first print region 91*a* and the second print region 91*b*. As in the case in FIG. 6C, the character string Ra' (see FIGS. 9A and 9B) constituted by the character string "PSC 101 120V/240V-1P/3W 200A Fed By Panel H10-CB#3" is formed on the first print region 91*a* so as to be in a left-to-right horizontal line orientation when the first print region 91*a* stands upright with its perforation-side edge serving as a lower edge. Also, the character string Rb' (see FIG. 9A) constituted by the character string "PSC 101 120V/240V-1P/3W 200A Fed By Panel H10-CB#3" is formed on the second print region 91*b* so as to be in a left-to-right horizontal line orientation when the second print region 91*b* stands upright with its perforation-side edge serving as a lower edge. In other words, the character string Rb is formed on the second print region 91*b* so as to be in such an orientation that the character string Ra' is rotated by 180 degrees about the center of the perforation 56 in the widthwise direction of the tape To.

A through hole BH is formed through the center of an upper end of the board BD. A strip-shaped adherend 19' may pass through the through hole BH. As illustrated in FIG. 9C, this operation results in completion of a flag label FL5 in which the board BD interposed between the first print region 91*a* and the second print region 91*b* stuck to each other hangs down from the adherend 19'.

Procedure of Operations on Operation Terminal

Figure 10:
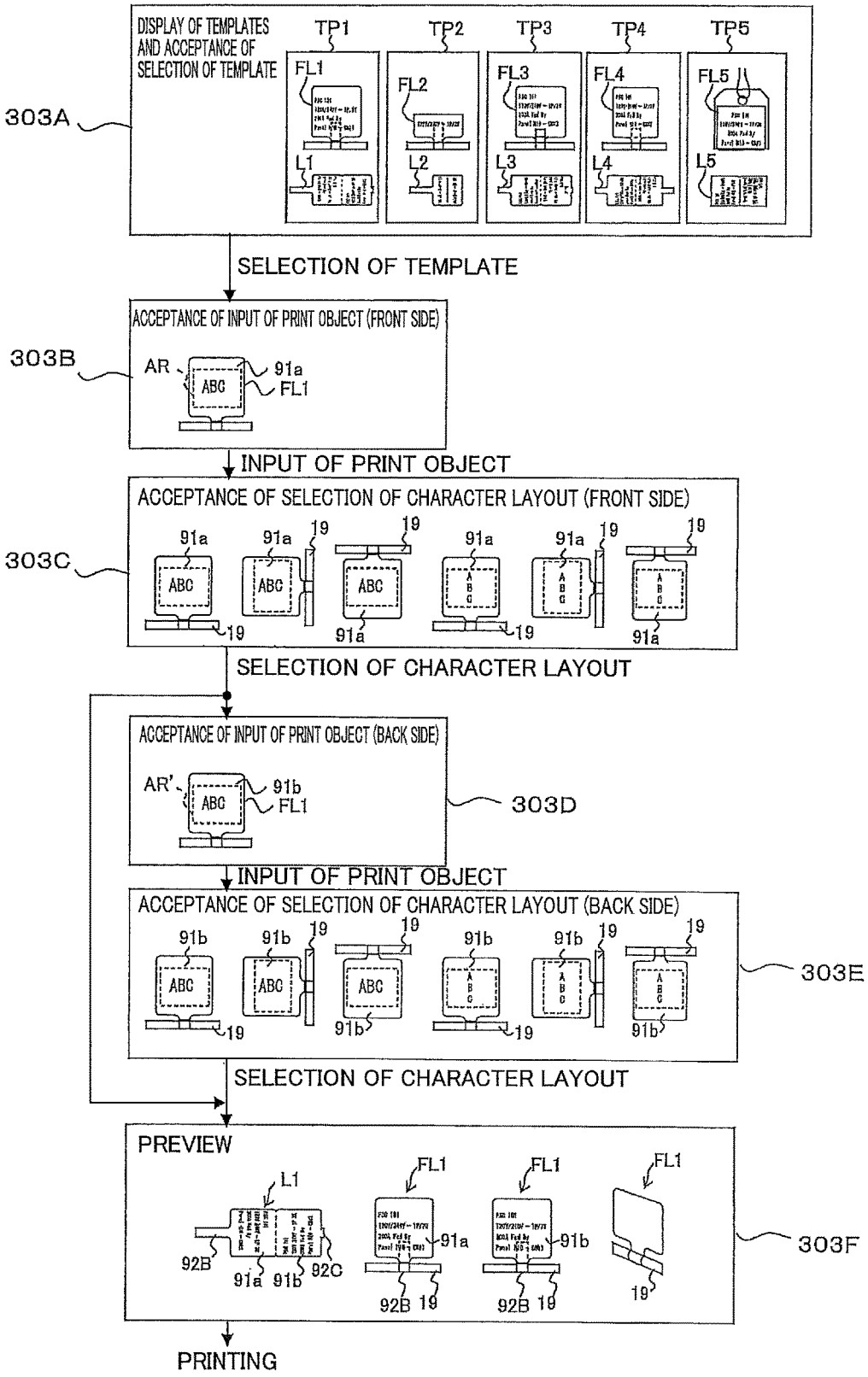
FIG. 10 is a view illustrating a procedure of operations on the operation terminal.

FIG. 10 illustrates a procedure of operations performed by the user on the operation terminal 300 to create one of the labels L1-L5 for forming the respective flag labels FL1-FL5 (hereinafter may be collectively referred to as "flag label FL").

As illustrated in FIG. 10, when the operation device 302 of the operation terminal 300 is operated by the user, a template-displaying and template-selection-accepting screen 303A is displayed on the display 303 of the operation terminal 300. That is, the HDD 306 of the operation terminal 300 stores a plurality of templates (five templates TP1-TP5) respectively corresponding to various labels (the labels L1-L5) creatable by the printer 1. It is noted that the ROM 305 or other similar devices may be used instead of the HDD 306, and these devices are one example of a storage. The labels L1-L5 may be hereinafter collectively referred to as "labels L", and likewise the templates TP1-TP5 may be hereinafter collectively referred to as "templates TP". The templates TP1, TP2, TP3, TP4, TP5 are displayed on the screen 303A.

Each of the templates TP contains two pieces of cutting-position information and image information. The two pieces of cutting-position information respectively represent two cutting positions (a downstream cutting position and an upstream cutting position) to be cut in the tape T to create a corresponding label. The image information represents an external appearance of the label.

That is, the template TP1 displayed on the screen 303A contains: an image representing the shape of the label L1; and an image representing the using manner of the flag label FL1 using the label L1. The image representing the shape of the label L1 corresponds to the plan view in FIG. 6A in the example, and this image is one example of the image information. The image representing the using manner of the flag label FL1 using the label L1 corresponds to FIG. 6B in the example, and this image is another example of the image information. Though not illustrated specifically, the two cutting positions illustrated in FIG. 6A are associated with the image representing the label L1. That is, the cutting position FC1 and the cutting position FC1' are associated with the image representing the label L1 and are one example of the two pieces of the cutting-position information.

The template TP2 contains: an image representing the shape of the label L2; and an image representing the using manner of the flag label FL2 using the label L2. The image representing the shape of the label L2 corresponds to the plan view in FIG. 7A in the example, and this image is still another example of the image information. The image representing the using manner of the flag label FL2 using the label L2 corresponds to FIG. 7B in the example, and this image is still another example of the image information. As in the above-described case, the cutting position FC1 and the cutting position FC4 illustrated in FIG. 7A are associated with the image representing the label L2 and are another example of the two pieces of the cutting-position information.

The template TP3 contains: an image representing the shape of the label L3; and an image representing the using manner of the flag label FL3 using the label L3. The image representing the shape of the label L3 corresponds to the plan view in FIG. 8A in the example, and this image is still another example of the image information. The image representing the using manner of the flag label FL3 using the label L3 corresponds to FIG. 8B in the example, and this image is still another example of the image information. As in the above-described case, the cutting position FC2 and the cutting position FC1' illustrated in FIG. 8A are associated with the image representing the label L3 and are still another example of the two pieces of the cutting-position information.

The template TP4 contains: an image representing the shape of the label L4; and an image representing the using manner of the flag label FL4 using the label L4. The image representing the shape of the label L4 corresponds to the plan view in FIG. 8D in the example, and this image is still another example of the image information. The image representing the using manner of the flag label FL4 using the label L4 corresponds to FIG. 8E in the example, and this image is still another example of the image information. As in the above-described case, the cutting position FC2 and the cutting position FC2' illustrated in FIG. 8D are associated with the image representing the label L4 and are still another example of the two pieces of the cutting-position information.

The template TP5 contains: an image representing the shape of the label L5; and an image representing the using manner of the flag label FL5 using the label L5. The image representing the shape of the label L5 corresponds to the plan view in FIG. 9A in the example, and this image is still another example of the image information. The image representing the using manner of the flag label FL5 using the label L5 corresponds to FIG. 9B in the example, and this image is still another example of the image information. As in the above-described case, the cutting position FC3 and the cutting position FC5 illustrated in FIG. 9A are associated with the image representing the label L5 and are still another example of the two pieces of the cutting-position information.

While the five templates TP1-TP5 respectively corresponding to the five labels L1-L5 are stored in the above-described example, at least two templates TP (as one example of a first template and a second template) at least need to be stored selectably as described above.

For example, in the case where the template TP1 is stored as the first template, cutting information (as one example of first positional information) representing the cutting position FC1 (as one example of a first position) in the first portion 92B and cutting information (as one example of second positional information) representing the cutting position FC1' (as one example of a second position) in the first portion 92C are associated with each other for the image (as one example of a first image) representing the shape (as one example of a first shape) of the corresponding label L1 (as one example of a first label).

In the case where the template TP2 is stored as the first template, cutting information (as another example of the first positional information) representing the cutting position FC1 (as another example of the first position) in the first portion 92B and cutting information (as another example of the second positional information) representing the cutting position FC4 (as another example of the second position) in the second portion 91B are associated with each other for the image (as another example of the first image) representing the shape (as another example of the first shape) of the corresponding label L2 (as another example of the first label).

In the case where the template TP3 is stored as the first template, cutting information (as still another example of the first positional information) representing the cutting position FC2 (as still another example of the first position) in the first portion 92B and cutting information (as still another example of the second positional information) representing the cutting position FC1' (as still another example of the second position) in the first portion 92C are associated with each other for the image (as still another example of the first image) representing the shape (as still another example of the first shape) of the corresponding label L3 (as still another example of the first label).

In the case where the template TP4 is stored as the first template, cutting information (as still another example of the first positional information) representing the cutting position FC2 (as still another example of the first position) in the first portion 92B and cutting information (as still another example of the second positional information) representing the cutting position FC2' (as still another example of the second position) in the first portion 92C are associated with each other for the image (as still another example of the first image) representing the shape (as still another example of the first shape) of the corresponding label L4 (as still another example of the first label).

In the case where the template TP5 is stored as the first template, cutting information (as still another example of the first positional information) representing the cutting position FC3 (as still another example of the first position) in the second portion 91B and cutting information (as still another example of the second positional information) representing the cutting position FC5 (as still another example of the second position) in the second portion 91B are associated with each other for the image (as still another example of the first image) representing the shape (as still another example of the first shape) of the corresponding label L5 (as still another example of the first label).

In some cases, the template TP1 is stored as the second template, for example. In this case, as in the above-described case, cutting information (as one example of third positional information) representing the cutting position FC1 (as one example of a third position) in the first portion 92B and cutting information (as one example of fourth positional information) representing the cutting position FC1' (as one example of a fourth position) in the first portion 92C are associated with each other for the image (as one example of a second image) representing the shape (as one example of a second shape) of the corresponding label L1 (as one example of a second label).

In the case where the template TP2 is stored as the second template, as in the above-described case, cutting information (as another example of the third positional information) representing the cutting position FC1 (as another example of the third position) in the first portion 92B and cutting information (as another example of the fourth positional information) representing the cutting position FC4 (as another example of the fourth position) in the second portion 91B are associated with each other for the image (as another example of the second image) representing the shape (as another example of the second shape) of the corresponding label L2 (as another example of the second label).

In the case where the template TP3 is stored as the second template, as in the above-described case, cutting information (as still another example of the third positional information) representing the cutting position FC2 (as still another example of the third position) in the first portion 92B and cutting information (as still another example of the fourth positional information) representing the cutting position FC1' (as still another example of the fourth position) in the first portion 92C are associated with each other for the image (as still another example of the second image) representing the shape (as still another example of the second shape) of the corresponding label L3 (as still another example of the second label).

In the case where the template TP4 is stored as the second template, as in the above-described case, cutting information (as still another example of the third positional information) representing the cutting position FC2 (as still another example of the third position) in the first portion 92B and cutting information (as still another example of the fourth positional information) representing the cutting position FC2' (as still another example of the fourth position) in the first portion 92C are associated with each other for the image (as still another example of the second image) representing the shape (as still another example of the second shape) of the corresponding label L4 (as still another example of the second label).

In the case where the template TP5 is stored as the second template, as in the above-described case, cutting information (as still another example of the third positional information) representing the cutting position FC3 (as still another example of the third position) in the second portion 91B and cutting information (as still another example of the fourth positional information) representing the cutting position FC5 (as still another example of the fourth position) in the second portion 91B are associated with each other for the image (as still another example of the second image) representing the shape (as still another example of the second shape) of the corresponding label L5 (as still another example of the second label).

As a result, for example, in the case where the template TP1 is stored as the first template, and the template TP2 is stored as the second template, the third position (the cutting position FC1) related to the corresponding label L2 is the same as the first position (the cutting position FC1) related to the corresponding label L1, and the fourth position (the cutting position FC4) related to the label L2 is different from the first position (the cutting position FC1) related to the label L1.

In the case where the template TP1 is stored as the first template, for example, the corresponding label L1 is created by cutting the tape T in its widthwise direction at the first position (the cutting position FC1) on the first portion 92B and by cutting the tape T in its widthwise direction at the first portion 92C located next to the first portion 92B in the longitudinal direction of the tape T (specifically, at the cutting position FC1').

In the case where the template TP2 is stored as the first template, for example, the corresponding label L2 is created by cutting the tape T in its widthwise direction at the second position (the cutting position FC4) on the first portion 92B.

In the case where the template TP5 is stored as the second template, for example, the corresponding label L5 is created by cutting the tape T in its widthwise direction at the third position (the cutting position FC3) on the second portion 91B and by cutting the tape T in its widthwise direction at the fourth position (the cutting position FC5) on the second portion 91B.

In the case where the template TP1 is stored as the first template, and the template TP3 is stored as the second template, for example, the label L3 as one example of the second label is created by cutting the tape T in the widthwise direction at the third position (the cutting position FC2) on the first portion 92B. The image of the flag label FL1 as the first image represents a shape (see FIG. 6B) in which the first position (the cutting position FC1) on the first portion 92B is disposed inside the second portion 91 folded in the longitudinal direction of the tape T. The image of the flag label FL3 as the second image represents a shape (see FIG. 8B) in which the third position (the cutting position FC2) on the first portion 92B is disposed outside the second portion 91 folded in the longitudinal direction of the tape T.

When the operation device 302 is thereafter operated by the user to select one of the templates TP1-TP5 displayed on the screen 303A of the display 303, a print-object-input accepting screen (for the front surface) 303B is displayed on the display 303. FIG. 10 illustrates one example in which the template TP1 is selected.

On the screen 303B, as illustrated in FIG. 10, the image corresponding to the front surface in the selected template TP1 (the image representing the first print region 91*a* of the flag label FL1 in the template TP1 in this example) contains an input area AR (see FIG. 10) of an appropriate size, e.g., a size corresponding to the second portion 91 of the label L1. This input area AR is an area to which the user operating the operation device 302 inputs a print object (e.g., character strings and symbols) to be printed on the first print region 91*a* of the flag label FL1. In this case, the size of the input area AR displayed on the display 303 may vary depending upon which template TP is selected.

When a desired print object (the character string "ABC" in this example) is input by the user via the operation device 302, the display 303 displays a character-layout-selection accepting screen 303C. In the example illustrated in FIG. 10, the screen 303C contains the following six layouts (character layouts) displayed selectably: a layout in which horizontally-written character strings are described on the first print region 91*a* of the flag label FL1, and the first portion 92B located under the first print region 91*a* is attached to the adherend 19 oriented substantially horizontally; a layout in which horizontally-written character strings are described on the first print region 91*a*, and the first portion 92B located to the right of the first print region 91*a* is attached to the adherend 19 oriented substantially vertically; a layout in which horizontally-written character strings are described on the first print region 91*a*, and the first portion 92B located on an upper side of the first print region 91*a* is attached to the adherend 19 oriented substantially horizontally; a layout in which vertically-written character strings are described on the first print region 91*a*, and the first portion 92B located below the first print region 91*a* is attached to the adherend 19 oriented substantially horizontally; a layout in which vertically-written character strings are described on the first print region 91*a*, and the first portion 92B located to the right of the first print region 91*a* is attached to the adherend 19 oriented substantially vertically; and a layout in which vertically-written character strings are described on the first print region 91*a*, and the first portion 92B located on an upper side of the first print region 91*a* is attached to the adherend 19 oriented substantially horizontally.

When a desired one of the character layouts (the leftmost layout on the screen 303C in FIG. 10 in this example) is selected by the user via the operation device 302, the display 303 displays a print-object-input accepting screen 303D. It is noted that in the case where the character layouts for the front and back surfaces of the flag label FL need not be specified separately in particular (that is, in the case where the same layout is to be used for the character layouts for the front and back surfaces), a preview screen 303 which will be described below is displayed without displaying the screen 303D or a screen 303E which will be described below.

On the screen 303D, as illustrated in FIG. 10, the image corresponding to the back surface in the selected template TP1 (the image representing the second print region 91*b* of the flag label FL1 in the template TP1 in this example) contains an input area AR' (see FIG. 10) of an appropriate size, e.g., a size corresponding to the second portion 91 of the label L1. Like the input area AR, this input area AR' is an area to which the user operating the operation device 302 inputs a print object (e.g., character strings and symbols) to be printed on the second print region 91*b* of the flag label FL1. In this case, the size of the input area AR' displayed on the display 303 may vary depending upon which template TP is selected.

When a desired print object (the character string "ABC" in this example) is input by the user via the operation device 302, the display 303 displays the character-layout-selection accepting screen 303E similar to the character-layout-selection accepting screen 303C. In the example illustrated in FIG. 10, the screen 303E contains the following six layouts (character layouts) displayed selectably: a layout in which horizontally-written character strings are described on the second print region 91*b* of the flag label FL1, and the first portion 92B located below the second print region 91*b* is attached to the adherend 19 oriented substantially horizontally; a layout in which horizontally-written character strings are described on the second print region 91*b*, and the first portion 92B located to the right of the second print region 91*b* is attached to the adherend 19 oriented substantially vertically; a layout in which horizontally-written character strings are described on the second print region 91*b*, and the first portion 92B located on an upper side of the second print region 91*b* is attached to the adherend 19 oriented substantially horizontally; a layout in which vertically-written character strings are described on the second print region 91*b*, and the first portion 92B located below the second print region 91*b* is attached to the adherend 19 oriented substantially horizontally; a layout in which vertically-written character strings are described on the second print region 91*b*, and the first portion 92B located to the right of the second print region 91*b* is attached to the adherend 19 oriented substantially vertically; and a layout in which vertically-written character strings are described on the second print region 91*b*, and the first portion 92B located on an upper side of the second print region 91*b* is attached to the adherend 19 oriented substantially horizontally.

When a desired one of the character layouts (the leftmost layout on the screen 303E in FIG. 10 in this example) is selected by the user via the operation device 302, the display 303 displays a preview screen 303F.

The preview screen 303F contains preview images representing external appearances of the labels L and the flag labels FL and corresponding to (i) a result of selection of the template on the screen 303A (the template TP1 selected in the above-described example), (ii) a result of input of the print object on the screen 303B (the character string "ABC" input in the above-described example), (iii) a result of selection of the character layout on the screen 303C (the leftmost character layout in the above-described example), (iv) a result of input of the print object on the screen 303D (the character string "ABC" input in the above-described example), and (v) a result of selection of the character layout on the screen 303E (the leftmost character layout in the above-described example). In this example, the preview screen 303F contains: an image corresponding to FIG. 6A illustrating the label L1 in plan view; an image corresponding to FIG. 6B illustrating the using manner of the flag label FL1 so as to show the first print region 91*a;* an image representing the using manner of the flag label FL1 so as to show the second print region 91*b;* and an image representing the using manner of the flag label FL1 viewed obliquely.

When the user viewing this preview screen displayed on the screen 303F has operated the operation device 302 to perform a confirmation operation, not only the two pieces of the cutting-position information (representing the cutting positions FC1, FC1' in this example) related to the corresponding label L (the label L1 in this example) but also print data containing print information representing the print object input to the input areas AR, AR' on the screens 303B, 303D via the operation device 302 is transmitted to the printer 1, and printing is performed on the transmitted print data. With these processings and operations, the label L with information input by the user via the operation device 302, such as texts and symbols, is easily created with a desired describing manner selected by the user.

Control Procedure in Operation Terminal

Figure 11:
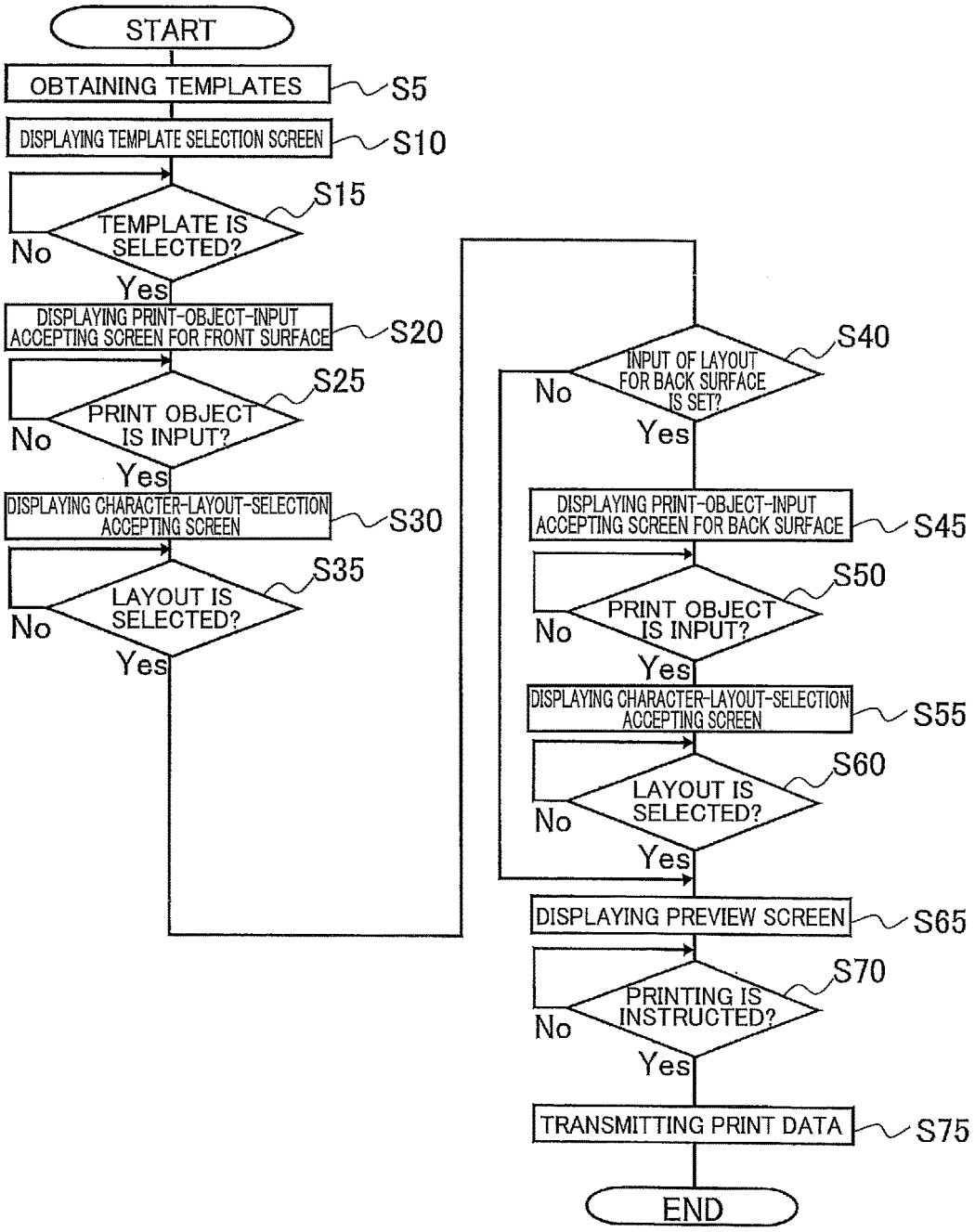
FIG. 11 is a flow chart representing a control procedure executed by a central processing unit (CPU) of the operation terminal.

There will be next explained, with reference to a flow chart in FIG. 11, a control procedure executed by the CPU 301 of the operation terminal 300 to execute the processings described above.

The flow in FIG. 11 begins with S5 at which the CPU 301 reads the templates TP stored in advance (the templates TP1-TP5 in the above-described example) from the HDD 306 (or the ROM 305, for example) and obtains the templates TP. This processing at S5 is one example of an obtaining procedure. Upon completion of this processing, this flow goes to S10.

The CPU 301 at S10 outputs a display control signal to the display 303 to display the templates TP obtained at S5 on the template-displaying and template-selection-accepting screen 303A (see FIG. 10). This processing at S10 is one example of an image display procedure. Upon completion of this processing, this flow goes to S15.

The CPU 301 at S15 determines whether one of the templates TP is selected on the template-displaying and template-selection-accepting screen 303A by user's operation on the operation device 302. When none of the templates TP is selected (S15: NO), the CPU 301 continues executing this processing. When one of the templates TP is selected (S15: YES), this flow goes to S20. It is noted that the CPU 301 at S15 creates two pieces of the cutting-position information corresponding to the image representing the label L in the selected template, and these two pieces of the cutting-position information include the first positional information and the second positional information respectively corresponding to the first position and the second position, or the third positional information and the fourth positional information respectively corresponding to the third position and the fourth position. The processing at S15 is one example of a selection accepting procedure.

The CPU 301 at S20 outputs a display control signal to the display 303 to display the print-object-input accepting screen (for the front surface) 303B (see FIG. 10). Upon completion of this processing, this flow goes to S25.

The CPU 301 at S25 determines whether the print object is input to the input area AR of the screen 303B (see FIG. 10) displayed at S20, by user's operation on the operation device 302. When no print object is input (S25: NO), the CPU 301 continues executing this processing. When the print object is input (S25: YES), this flow goes to S30.

The CPU 301 at S30 outputs a display control signal to the display 303 to display the character-layout-selection accepting screen (for the front surface) 303C (see FIG. 10). Upon completion of this processing, this flow goes to S35.

The CPU 301 at S35 determines whether one of the character layouts is selected on the screen 303C by user's operation on the operation device 302. When none of the character layouts is selected (S35: NO), the CPU 301 continues executing this processing. When one of the character layouts is selected (S35: YES), this flow goes to S40.

The CPU 301 at S40 determines whether the printer 1 is set to require the user to input a character layout for the back surface of the flag label FL, based on a setting set in advance or a setting set by the user operating the operation device 302 at this time, for example. In other words, the CPU 301 determines whether the printer 1 is set such that the character layout for the back surface is designated separately from the character layout for the front surface. When the printer 1 is not set to require the user to input the character layout for the back surface (S40: NO), this flow goes to S65. When the printer 1 is set to require the user to input the character layout for the back surface (S40: YES), this flow goes to S45.

The CPU 301 at S45 outputs a display control signal to the display 303 to display the print-object-input accepting screen (for the back surface) 303D (see FIG. 10). It is noted that the processings at S45 and S20 are one example of an area display procedure. Upon completion of this processing, this flow goes to S50.

The CPU 301 at S50 determines whether the print object is input to the input area AR of the screen 303D' (see FIG. 10) displayed at S45, by user's operation on the operation device 302. When the print object is not input (S50: NO), the CPU 301 continues executing this processing. When the print object is input (S50: YES), this flow goes to S55.

The CPU 301 at S55 outputs a display control signal to the display 303 to display the character-layout-selection accepting screen (for the back surface) 303E (see FIG. 10). Upon completion of this processing, this flow goes to S60.

The CPU 301 at S60 determines whether one of the character layouts is selected on the screen 303E by user's operation on the operation device 302. When none of the character layouts is selected (S60: NO), the CPU 301 continues executing this processing. When one of the character layouts is selected (S60: YES), this flow goes to S65.

The CPU 301 at S65 outputs a display control signal to the display 303 to display the preview screen 303F (see FIG. 10). Upon completion of this processing, this flow goes to S70.

The CPU 301 at S70 determines whether the printer 1 is instructed to perform printing, by the user having confirmed the preview screen 303F and operated the operation device 302 (pressing a printing button, for example). When the printer 1 is not instructed to perform printing (S70: NO), the CPU 301 continues executing this processing. When the printer 1 is instructed to perform printing (S70: YES), this flow goes to S75.

The CPU 301 at S75 sends the printer 1 a print instruction signal containing the print data (as one example of label information) including: the two pieces of the cutting-position information related to the label L corresponding to the images displayed on the preview screen 303F; and the print information representing the print objects input to the input areas AR, AR' on the respective screens 303B, 303D. This processing is one example of an information transmission procedure.

Positioning of Tape by Sensor

As described above, in the present embodiment, it is possible to create the label L by controlling the full cutters 41 to cut the first portion 92 and the second portion 91 of the tape T after printing. To position the tape T or To to the cutting position or a printing starting position, as illustrated in FIGS. 12A-12C, the marks M1, M2 detectable by the optical sensor 65 including the light emitting element 65*a* and the light receiving element 65*b* are provided on the tape To. The marks M1, M2 may be hereinafter collectively referred to as "marks M".

As described above, the cutting position of the tape T in cutting of the first portion 92 and the cutting position of the tape T in cutting of the second portion 91 may be changed to create the label L having one of various shapes which is desired by the user. This configuration provides various uses of the label which are demanded by the user. Thus, at least two types of the positions at which the tape T is cut by the full cutters 41 or the half cutter 42 need to be set, without these positions determined uniquely. To address the need of two or more types of settings, the mark M1 as a first detected element and the mark M2 as a second detected element are provided on the tape To at different positions in the longitudinal direction of the tape (see FIG. 12C). The mark M1 is one example of a first mark and a first positioning mark, and the mark M2 is one example of a second mark and a third positioning mark.

That is, in this example, as illustrated in FIGS. 12B and 12C, first back portions 192A, 192B, 192C, and so on are arranged on the separation sheet 54 at positions located on the right back side from the respective first portions 92A, 92B, 92C, and so on in the elongated label LL (including the first portion 92 and the second portion 91) and the separation sheet 54 of the tape To. That is, each of the first back portions 192A, 192B, 192C, and so on and a corresponding one of the first portions 92A, 92B, 92C, and so on are located at the same position in plan view. It is noted that the first back portions 192A, 192B, 192C, and so on may be hereinafter collectively referred to as "first back portions 192". Also, second back portions 191A, 191B, 191C, and so on are arranged on the separation sheet 54 located on the right back side from the second portions 91A, 91B, 91C, and so on of the elongated label LL. The second back portions 191A, 191B, 191C, and so on may be hereinafter collectively referred to as "second back portion 191". Each of the second back portions 191 includes a first print back region 191*a* and a second print back region 191*b* respectively located on the right back from the first print region 91*a* and the second print region 91*b* of the second portion 91. In this example, the mark M1 is provided on the first print back region 191*a*, and the mark M2 is provided on the second print back region 191*b*. In other words, the mark M1 is disposed downstream of the perforation 56, and the mark M2 is disposed upstream of the perforation 56.

The marks M1, M2 may be used in a well-known technique for positioning in cutting of the tape To or T by the full cutters 41 or the half cutter 42 at the cutting positions FC1, FC2, FC3, FC4, FC5, FC1', FC2' (hereinafter may be collectively referred to as "cutting positions FL") and for positioning in printing on the first print region 91*a* and the second print region 91*b* by the thermal head 22. That is, when the mark M1 or M2 is detected by the optical sensor 65, the printer 1 counts the number of pulses for the drive motor 66 as a pulse motor from the detection, and the CPU 82 calculates a distance traveled by the tape, enabling the above-described positioning.

In this example, the marks M1, M2 are printed in advance and are different from the other portion of the separation sheet 54 in at least one of hue, chroma, and lightness, so that the marks M1, M2 are different from the other portion of the separation sheet 54 in reflectivity when viewed in the same wavelength (wavelength band). For example, the marks M1, M2 are printed with black ink.

It is noted that portions of the first outer portions 54B and the second outer portions 54A (see FIGS. 12B and 5C) of the separation sheet 54, which portions are located near the other surface 54*b*, will be referred to as "first outer back portions 154B" and "second outer back portions 154A" for convenience. Instead of being formed respectively on the first print back region 191*a* and the second print back region 191*b* as described above, the marks M1, M2 may be formed on the first outer back portion 154B or the second outer back portion 154A at the same position in the longitudinal direction of the tape (also see a modification in FIG. 24 which will be described below). Alternatively, instead of being formed respectively on the first print back region 191*a* and the second print back region 191*b* as described above, the marks M1, M2 may be formed on the first print region 91*a* or the second print region 91*b* at the same position in the longitudinal direction of the tape. In this case, however, the optical sensor 65 needs to be provided on the same side of the conveyance path of the tape To as the thermal head 22 in FIG. 12A. It is noted that the first outer portions 54B, the second outer portions 54A, the first back portion 192, the second back portion 191, the first outer back portions 154B, and the second outer back portions 154A located at positions corresponding to the first portion 92 and the second portion 91 in the widthwise direction of the tape or the thickness direction of the tape are one example of opposite-portion regions. In these portions, each of the second outer portions 54A, the second back portion 191, and the second outer back portions 154A at a position corresponding to the second portion 91 in the widthwise direction of the tape or the thickness direction of the tape is one example of a second-portion region.

In the present embodiment, an upstream end portion M1*u* of the mark M1 and an upstream end portion M2*u* of the mark M2 are different from each other in position in the longitudinal direction of the tape, and a downstream end portion M1*d* of the mark M1 and a downstream end portion M2*d* of the mark M2 are different from each other in position in the longitudinal direction of the tape. That is, a distance lMB from the downstream end portion 92*d* of the first portion 92 to the mark M2 in the longitudinal direction of the tape To is greater than the distance lMA (equal to a distance lM1 which will be described below) from the downstream end portion 92*d* of the first portion 92 to the mark M1 in the longitudinal direction of the tape To. The upstream end portion M1*u* of the mark M1 is located downstream of the downstream end portion M2*d* of the mark M2.

The length w1 of the mark M1 in the longitudinal direction of the tape To (i.e., a distance from the upstream end portion M1*u* of the mark M1 to the downstream end portion M1*d* thereof) is different from the length w2 of the mark M2 in the longitudinal direction of the tape To (i.e., the distance from the upstream end portion M2*u* of the mark M2 to the downstream end portion M2*d* thereof). Specifically, the length w2 of the mark M2 is less than the length w1 of the mark M1, for example. When converted to the number of dots in the thermal head 22, as one example, the length w1 and the length w2 are 150 dots and 100 dots, respectively. Assuming that the resolution of the thermal head 22 is 360 dpi, the length w1 and the length w2 are about 11 mm and about 7 mm, respectively. A mark-to-mark distance LM between the upstream end portion M1*u* of the mark M1 and the upstream end portion M2*u* of the mark M2 in the longitudinal direction of the tape To is less than the length l4 of the first portion 92.

As a relationship with the tape cartridge 100, the distance lM1 (see FIG. 12C) from the downstream end portion 92*d* of the first portion 92 to the downstream end portion M1*d* of the mark M1 is less than a distance L1 (see FIG. 3) from the output opening P (specifically, an upstream end of the output opening) to the opening 104. The distance L1 is one example of a first distance. Also, a distance lM2 from the downstream end portion 91*d* of the second portion 91 to the upstream end portion M2*u* of the mark M2 is less than a distance L2 (see FIG. 3) from the recessed portion to the opening 104 (specifically, a downstream end of the opening 104). The distance L2 is one example of a second distance.

Control for Cutting Position using Marks

As described above, each of the two marks M1, M2 has not only the function for specifying the cutting position in the current processing on the tape To or T but also a function for specifying a cutting position in the preceding processing on the tape To or T, i.e., a function for specifying a leading-end (front-end) position of the tape To or T. That is, each of the two marks M1, M2 is used to specify cutting positions in the case where the tape To, T is cut at the cutting positions. There will be explained the functions of the two marks M1, M2 with reference to FIGS. 13A and 13B.

As described above, in the present embodiment, each of the marks M1 is provided downstream of a corresponding one of the marks M2 on the tape To. As illustrated in FIGS. 5A-5C and 12A, 12B, when the tape To is conveyed, the first portions and the second portions are conveyed in the order of the first portion 92A, the second portion 91A, the first portion 92B, the second portion 91A, and so on. As described above, the sensor-to-cutter distance X1 is greater than the distance lMA from the downstream end portion 92*d* of the first portion 92 to the mark M1 in the longitudinal direction of the tape To.

Figure 13A:
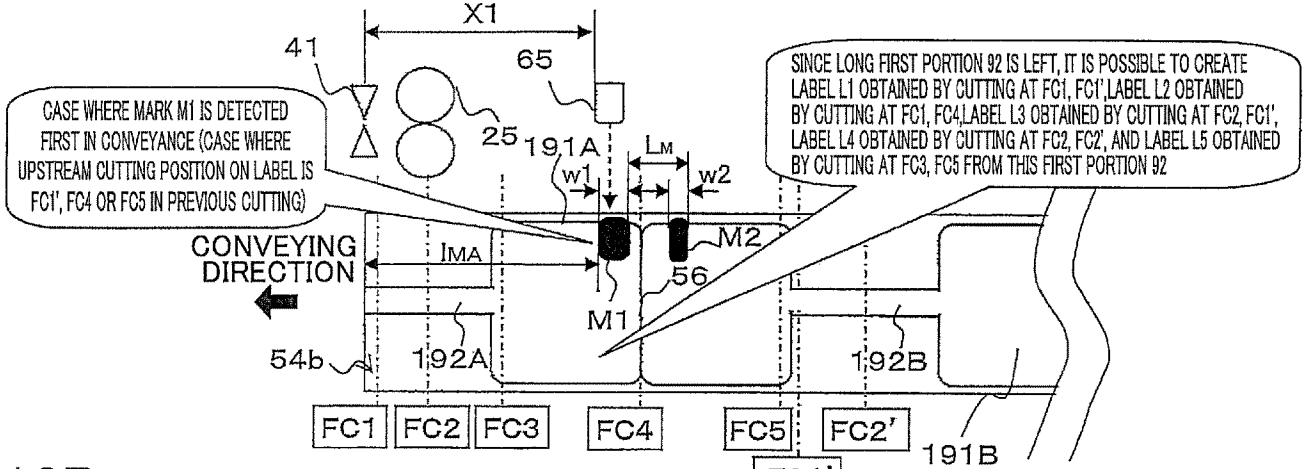
FIG. 13A is a view illustrating a situation when a mark M1 is detected by the sensor for the first time in the conveyance of the tape.

With this positional relationship, it is assumed that, as illustrated in FIG. 13A, the mark M1 is detected by the optical sensor 65 before detection of the mark M2 just after conveyance of the tape in a certain label creation processing, for example. This detection indicates that the long first portion 92 is left at a position located upstream of the cutting position in cutting of the tape by the full cutters 41 in the preceding label creation processing. In other words, the detection indicates that the first portion 92 is not cut to a short length and is cut at the cutting position FC1', the cutting position FC4, or the cutting position FC5. As a result, in the current label creation processing in which the conveyance is started as described above, it is possible to create the label L having the long first portion 92 in its downstream portion (i.e., the label L1 or L2 in the above-described example), and this long first portion 92 is preferable for the case where the label L is attached to the adherend 19 in the form of a thick cable, for example. It is noted that the tape To may be further conveyed from this state and cut by the full cutters 41 or the half cutter 42 when a central portion of the remaining long first portion 92 in the longitudinal direction of the tape To has reached the full cutters 41 or the half cutter 42, thereby creating the label L having the short first portion 92 in its downstream portion (i.e., the label L3, L4, or L5 in the above-described example), and this short first portion 92 is preferable for the case where the label L is attached to the adherend 19 in the form of a thin cable, for example.

In this case, in an upstream end portion of the label L created as described above in the current operation, the next first portion 92 may be cut at its downstream end portion 92*d* (or at a downstream portion of the next first portion 92) to form the next first portion 92 having a long length for the label L to be created in the next operation (e.g., the label L1 created by cutting at the cutting positions FC1, FC1' and the label L3 created by cutting at the cutting positions FC2, FC1'). Alternatively, the next first portion 92 may be cut at its upstream portion to shorten the first portion 92 of the label L to be created in the next operation (e.g., the label L4 created by cutting at the cutting positions FC2, FC2').

Figure 13B:
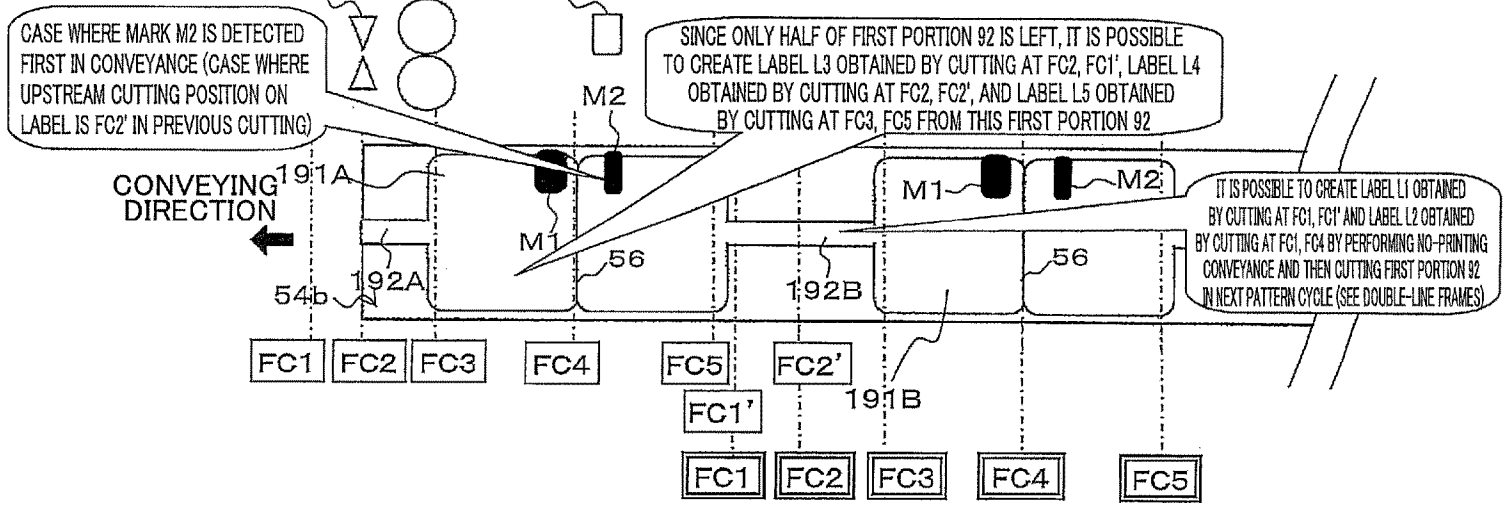
FIG. 13B is a view illustrating a situation when a mark M2 is detected by the sensor for the first time in the conveyance of the tape.

On the other hand, it is assumed that, as illustrated in FIG. 13B, the mark M2 is detected by the optical sensor 65 without detection of the mark M1 just after conveyance of the tape in a certain label creation processing, for example. This detection indicates that only the short first portion 92 is left at a position located upstream of the cutting position in cutting of the full cutters 41 or the half cutter 42 in the preceding label creation processing. In other words, the detection indicates that the first portion 92 is cut at the cutting position FC2' so as to have a short length. As a result, in the current label creation processing in which the conveyance is started as described above, it is possible to create the label L having the short first portion 92 in its downstream portion or not having the first portion 92 (i.e., the label L3, L4, or L5 in the above-described example), and this short first portion 92 is preferable for the case where the label L is attached to the adherend 19 in the form of a thin cable. In this case, however, without further operation, it is impossible to create the label (the labels L1, L2 in the above-described example) having the long first portion 92 preferable for the case where the label is attached to the adherend 19 in the form of the thick cable, for example. Thus, in this case, it is possible to create the label L having the long first portion 92 at its downstream portion (e.g., the labels L1, L2 in the above-described example) by conveying the tape To from the above-described state by an amount corresponding to about one pattern cycle (noted that this conveyance may be referred to as "no-printing conveyance" or "preliminary conveyance"), and by cutting the first portion 92 when the cutting position FC1 on the first portion 92 corresponding to the next pattern cycle has reached the full cutters 41 or the half cutter 42. One pattern cycle has a length substantially equal to the sum of the length of the first portion 92 and the length of the second portion 91.

In this case, in the upstream end portion of the label L created as described above in the current operation, the next first portion 92 may be cut at its upstream portion to form the next first portion 92 having a short length for the label L to be created in the next operation (e.g., the label L4 created by cutting at the cutting positions FC2, FC2'). Alternatively, the next first portion 92 may be cut at its downstream end portion 92*d* (or at a downstream portion of the next first portion 92) to form the next first portion 92 having a long length for the label L to be created in the next operation (e.g., the label L1 created by cutting at the cutting positions FC1, FC1' and the label L3 created by cutting at the cutting positions FC2, FC1').

It is noted that, in FIGS. 13A and 13B, an outline of the elongated label LL (in other words, the cut frame 57) to be indicated by a broken line on the other surface 54*b* of the separation sheet 54 is indicated by a solid line for simplicity. The same illustration manner as used in FIGS. 13A and 13B are used for FIGS. 20 and 23, for example.

Control Procedure for Cutting Position in Printer

As described above, in the case where the cutting positions are desirably changed using the marks M1, M2 to satisfy user's demand for the various uses of the label, the label shape (corresponding to the first shape) desired by the user cannot be always obtained in the current creation of the label, depending upon the cutting positions in the preceding creation of the label. To solve this problem, in the present embodiment, processings to be executed are switched by the CPU 82, depending upon whether the mark M1 is detected after the start of conveyance for the current creation of the label and whether the second mark or an opening is detected. There will be explained, with reference to the flow chart in FIG. 14, a detailed procedure of control executed by the CPU 82 of the printer 1 to execute the switching.

Figure 14:
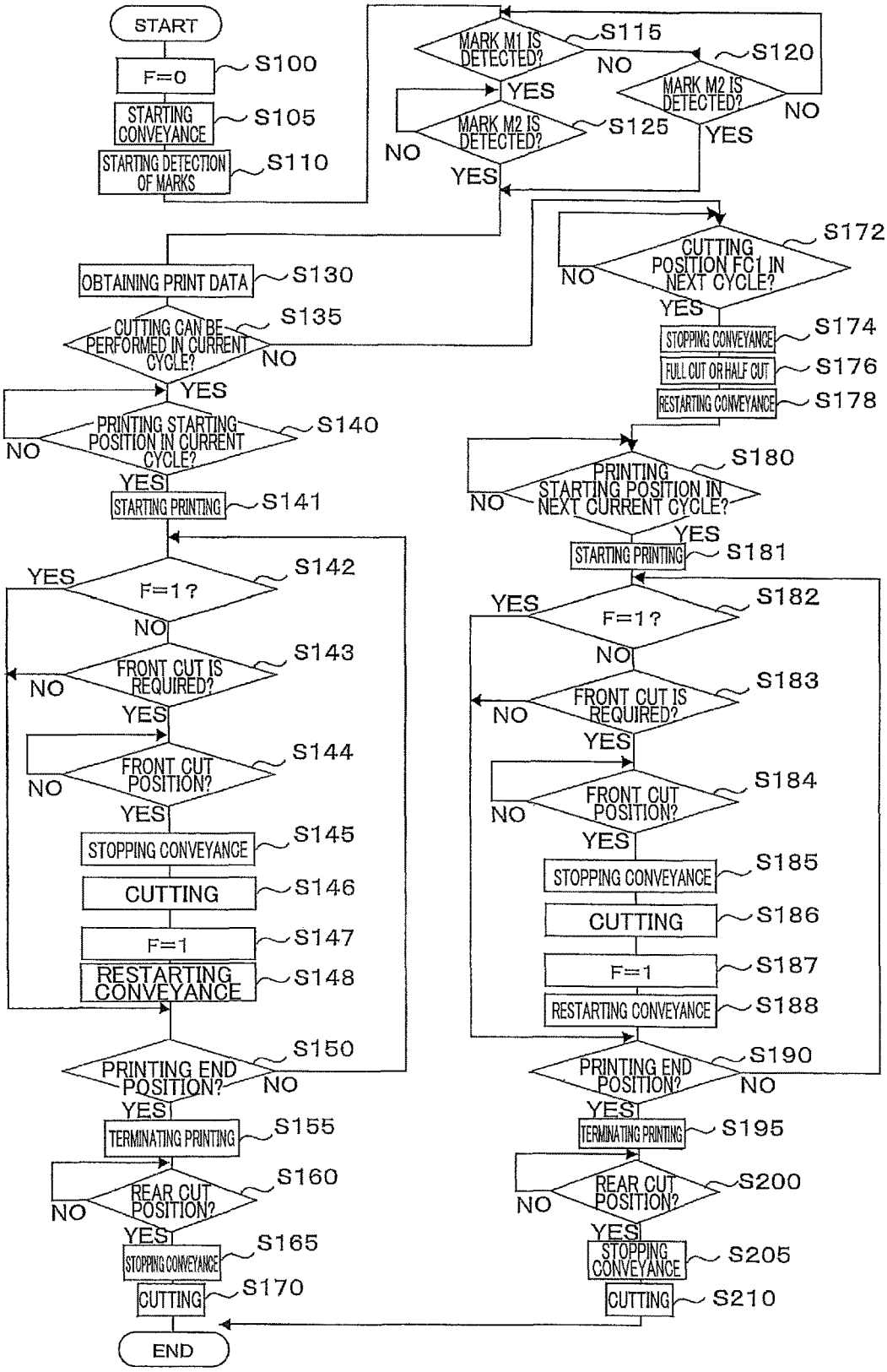
FIG. 14 is a flow chart representing a control procedure executed by a CPU of the printer.

This flow in FIG. 14 begins when the print instruction signal is input from the operation terminal 300 to the CPU 82 of the printer 1. At S100, the CPU 82 initializes to a front cut flag F to zero. The front cut flag F indicates that a front cut position which will be described below is cut.

The CPU 82 at S105 outputs a control signal to the drive motor 66 via the motor drive circuit 62 to drive the platen roller 25 and other conveying components to start conveying the tape To. This processing is one example of a conveyance start procedure. Upon completion of this processing, this flow goes to S110.

The CPU 82 at S110 starts controlling the optical sensor 65 to detect the marks M1, M2. In other words, the CPU 82 starts identifying a signal detected by the optical sensor 65. Upon completion of this processing, this flow goes to S115.

The CPU 82 at S115 determines whether the mark M1 is detected by the optical sensor 65. When the mark M1 is not detected (S115: NO), this flow goes to S120.

The CPU 82 at S120 determines whether the mark M2 is detected by the optical sensor 65. When the mark M2 is not detected (S120: NO), this flow returns to S115. When the mark M2 is detected (S120: Yes), this flow goes to S130.

When the CPU 82 at S115 determines that the mark M1 is detected by the optical sensor 65 (S115: Yes), this flow goes to S125.

As in the processing at S120, the CPU 82 at S125 determines whether the mark M2 is detected by the optical sensor 65. When the mark M2 is not detected (S125: NO), the CPU 301 continues executing this processing. When the mark M2 is detected (S125: YES), this flow goes to S130.

Mark Identification Processing

In the determination of detection of the marks M1, M2 at S115, S120, and S125, the CPU 82 executes a mark identification processing for identifying which of the marks M1, M2 is detected. This identification is performed based on periods of detection of the optical sensor 65 which correspond to the respective lengths w1, w2 of the marks M1, M2.

For example, in the case where light emitted from the light emitting element 65*a* impinges on the tape To or T at a position different from the mark M, a relatively large amount of light is reflected off the tape and received by the light receiving element 65*b* of the optical sensor 65, but in the case where the light emitted from the light emitting element 65*a* impinges on the mark M, a small amount of light is reflected off the mark M and received by the light receiving element 65*b* due to difference in the reflectivity. Thus, when the tape To or T is conveyed, the mark M passes through a position opposed to the optical sensor 65, so that the amount of light received by the light receiving element 65*b* of the optical sensor 65 is changed in the order of a large amount, a small amount (due to the mark M), and a large amount. It is noted that, in this case, the identification may be performed by detecting a change of the amount of received light in the order of a small amount, a large amount, and a small amount. The light receiving element 65*b* outputs a detection signal to the CPU 82. The start of this detection signal is a timing when the amount of the received light is changed from the large amount to the small amount for the first time, and the end of the detection signal is a timing when the amount of the received light is thereafter changed from the large amount to the small amount. Accordingly, in the case where the light reflected off the mark M1 having the relatively long length w1 is received, a timewise length of the detection signal is long (as one example of a first detection signal), and in the case where the light reflected off the mark M2 having the relatively short length w2 is received, a timewise length of the detection signal is short (as one example of a second detection signal).

The CPU 82 uses the characteristics of the detection signal from the light receiving element 65*b* to identify whether the detection signal is one of the first detection signal and the second detection signal. In the present embodiment, in particular, the ROM 83 stores a table illustrated in FIG. 15 (as one example of a mark identification table), and the CPU 82 uses this table to perform the identification, for example.

The table illustrated in FIG. 15 stores a relationship between each of the two marks M1, M2 and corresponding detection-period information representing a time (detection period) from the start of the signal to the end of the signal. In this example, each of the two marks M1, M2 is associated with the length of the detection period converted to the number of dots in the thermal head 22.

In this table, as illustrated in FIG. 15, in the case where the detection period of the detection signal output from the optical sensor 65 is greater than or equal to a length equivalent to 125 dots and less than or equal to a length equivalent to 175 dots, it is considered that the detection signal is the first detection signal output from the mark M1. Also, in the case where the detection period of the detection signal output from the optical sensor 65 is greater than or equal to a length equivalent to 75 dots and less than a length equivalent to 125 dots (124 in FIG. 15), it is considered that the detection signal is the second detection signal output from the mark M2. While this table is stored in the printer 1 (in the ROM 83, for example) in this case, the CPU 82 may access and read the table stored in a device outside the printer 1 (as another example of the second storage).

Returning to FIG. 14, after the positive decision at S125 or S120, the CPU 82 at S130 obtains the print data contained in the print instructing signal received from the operation terminal 300 as described above. This processing is one example of an information obtaining procedure and an information obtaining processing.

The CPU 82 at S135 determines, based on the label information obtained at S130, whether the cutting positions indicated by the two pieces of the cutting-position information contained in the label information can be used for cutting in the current pattern cycle defined by the combination of the first portion 92 and the second portion 91 as described above. This processing is one example of a determination procedure and a determination processing. When cutting cannot be performed in the current pattern cycle (S135: NO), this flow goes to S172. When cutting can be performed in the current pattern cycle (S135: YES), this flow goes to S140. This processing is one example of a selecting procedure.

In the present embodiment, the CPU 82 executes the determination at S135 by obtaining information (e.g., label-creatable information) stored in a table illustrated in FIG. 16 (e.g., a matching table) prepared and stored in the ROM 83 or another similar device in advance and by using the obtained information. It is noted that obtaining the information is one example of a label-creatable-information obtaining processing.

That is, as described above, in the case where the mark M1 is detected first by the optical sensor 65, the long first portion 92 is left in the preceding label creation processing, and accordingly it is possible to create the labels L1, L2 each having the long first portion 92 and the labels L3-L5 each having the short first portion 92 in the current label creation processing. Also, in the case where the mark M2 is detected first by the optical sensor 65, only the short first portion 92 is left in the preceding label creation processing, and accordingly it is possible to create only the labels L3-L5 each having the short first portion 92 in this pattern cycle in the current label creation processing.

The matching table in FIG. 16 is created by tabulating (i) the label information expressed by the type of the label which represents one of the labels L1-L5 in this example and (ii) the label-creatable information indicating whether creation of the label is allowed. As illustrated in FIG. 16, in the case where the mark M1 is detected first, any of the five labels L1-L5 is creatable in this pattern cycle (see marks "○"). In the case where the mark M2 is detected first, any of the labels L3-L5 is creatable in this pattern cycle (see marks "○"), but none of the labels L1, L2 is not creatable in this pattern cycle (see marks "×").

While this table is stored in the printer 1 (in the ROM 83, for example) in this case, the CPU 82 may access and read the table stored in a device outside the printer 1. In this case, the device outside the printer 1 is another example of the first storage.

Returning to FIG. 14, the CPU 82 at S140 determines, based on the print information contained in the print data obtained at S130, whether the conveyance state of the tape T or To being conveyed has become a state in which the thermal head 22 is opposed to a position at which printing is to be started in the current pattern cycle. It is noted that the position of the tape T or To at which the thermal head 22 is opposed to the position at which printing is to be started may be hereinafter referred to as "printing starting position".

In the case where the mark M1 is detected first by the optical sensor 65 (i.e., in creation of any of the labels L1-L5), this determination is executed based on the first detection signal corresponding to detection of the mark M1. That is, the CPU 82 calculates a conveyance distance from the timing when the mark M1 is detected by the optical sensor 65 (i.e., the timing of input of the first detection signal), by counting the number of pulses for the drive motor 66 as the pulse motor from the timing of the detection of the mark M1, and the CPU 82 determines the conveyance state of the tape To based on the calculated conveyance distance. A result of detection (the second detection signal) of the mark M2 after detection of the mark M1 is input to but ingnored by the CPU 82.

In the case where the mark M2 is detected first by the optical sensor 65 (i.e., in creation of the label L4), the determination at S140 is executed based on the second detection signal corresponding to detection of the mark M2. That is, the CPU 82 calculates a conveyance distance from the timing when the mark M2 is detected by the optical sensor 65 (i.e., the timing of input of the second detection signal), by counting the number of pulses for the drive motor 66 as the pulse motor from the timing of the detection of the mark M2, and the CPU 82 determines the conveyance state of the tape To based on the calculated conveyance distance.

When the CPU 82 determined at S140 that the tape To has not reached the printing starting position (S140: NO), the CPU 82 continues executing this processing. When the tape To has reached the printing starting position (S140: YES), this flow goes to S141.

The CPU 82 at S141 outputs a control signal to the thermal head 22 via the thermal-head drive circuit 61 to control the thermal head 22 to start printing on the predetermined print region of the tape To being conveyed, based on the print information contained in the print data obtained at S130.

The CPU 82 at S142 determines whether the front cut flag F is 1. When the front cut flag F is 1, in other words, the front cut flag F is switched to 1 at S147 (S142: YES), this flow goes to S150. When the front cut flag F is 0 (S150: NO), this flow goes to S143.

The CPU 82 at S143 determines, based on the result of obtainment of the print data at S130, whether the type of the label which is indicated by the obtained print data requires the full cut at a middle portion or an upstream end portion of the downstream first portion 92. This full cut may be hereinafter referred to as "front cut". When the type of the label does not require the front cut (the labels L1, L2 in the above-described example) (S143: NO), this flow goes to S150. The type of the label requires the front cut (the labels L3-L5 in the above-described example) (S143: YES), this flow goes to S144.

The CPU 82 at S144 determines whether the tape T is conveyed to a cut position at which the front cut is to be performed by the full cutters 41. In other words, the CPU 82 determines whether the tape T has reached a position (a front cut position) at which the full cutters 41 are opposed to the cutting position for the front cut which is indicated by the cutting-position information contained in the print data obtained at S130. This determination may be executed by counting the number of pulses, output from the drive circuit 62 for driving the drive motor 66 as the pulse motor, from the timing of detection of the mark M1 or M2 and determining whether the number of pulses has reached a predetermined value, for example. When the tape T has not reached the front cut position (S144: NO), the CPU 82 continues executing this processing. When the tape T has reached the front cut position (S144: YES), this flow goes to S145.

The CPU 82 at S145 outputs a control signal to the drive motor 66 via the motor drive circuit 62 to stop driving of the drive motor 66. This processing stops rotation of the conveying-roller drive shaft 23, the ribbon take-up shaft 125, and so on, thereby stopping conveyance of the tape To.

The CPU 82 at S146 outputs a control signal to the full cutters 41 via the motor drive circuit 70 to drive the full cutters 41 to cut the tape T (the front cut). It is noted that the half cut may be performed for the tape To with the half cutter 42. Upon completion of this processing, this flow goes to S147.

The CPU 82 at S147 switches the front cut flag F to 1, and this flow goes to S148.

As in the processing at S105, the CPU 82 at S148 outputs a control signal to the drive motor 66 via the motor drive circuit 62 to drive the platen roller 25 and other conveying components to start conveying the tape To again.

The CPU 82 at S150 determines whether the conveyance state of the tape To or T being conveyed has become a state in which the thermal head 22 is opposed to a position at which printing is to be terminated. This determination is executed in the same manner as that at S140. It is noted that the position of the tape To or T at which the thermal head 22 is opposed to the position at which printing is to be terminated may be hereinafter referred to as "printing end position". When the tape To or T has not reached the printing end position (S150: NO), this flow returns to S142. When the tape To or T has reached the printing end position (S150: YES), this flow goes to S155.

The CPU 82 at S155 outputs a control signal to the thermal head 22 via the thermal-head drive circuit 61 to terminate the printing on the predetermined print region started at S145.

The CPU 82 at S160 determines whether the tape T is conveyed to a cut position at which the full cut is to be performed by the full cutters 41 for an upstream end portion of the label L being created (noted that this cutting may be hereinafter referred to as "rear cut"). In other words, the tape T has reached to a position at which the full cutters 41 are opposed to a cutting position for the rear cut which is indicated by the cutting-position information contained in the print data obtained at S130. This determination may be executed by counting the number of pulses, output from the drive circuit 62 for driving the drive motor 66 as the pulse motor, from the timing of detection of the mark M1 or M2 and determining whether the number of pulses has reached a predetermined value, for example. It is noted that the position of the tape T at which the full cut is to be performed for the upstream end portion of the label L may be hereinafter referred to as "rear cut position". When the tape T has not reached the rear cut position (S160: NO), the CPU 82 continues executing this processing. When the tape T has reached the rear cut position (S160: YES), this flow goes to S165.

As in the processing at S145, the CPU 82 at S165 stops driving of the drive motor 66 to stop conveyance of the tape T.

The CPU 82 at S170 outputs a control signal to the full cutters 41 via the motor drive circuit 70 to drive the full cutters 41 to cut the tape T, and this flow ends. It is noted that the processings at S160-S170 are one example of a cutting procedure and a first cutting processing.

As described above, the negative decision is made at S135, this flow goes to S172. The CPU 82 at S172 determines, based on the cutting-position information contained in the print data obtained at S130, whether the conveyance state of the tape To being conveyed has become a state in which the full cutters 41 are opposed to the cutting position FC1 in the next pattern cycle, i.e., after the next pattern cycle is established by the no-printing conveyance. It is noted that the cutting position FC1 in the next pattern cycle may be hereinafter referred to as "next cutting position FC1". This determination corresponds to detection of the mark M2 first by the optical sensor 65 (i.e., creation of any of the labels L3-L5) and is executed based on the second detection signal corresponding to the detection of the mark M2. That is, the CPU 82 calculates a conveyance distance from the timing when the mark M2 is detected by the optical sensor 65 (i.e., the timing of input of the second detection signal), by counting the number of pulses for the drive motor 66 as the pulse motor from the timing of the detection of the mark M2, and the CPU 82 determines the conveyance state of the tape To based on the calculated conveyance distance.

When the full cutters 41 are not opposed to the cutting position FC1 (S172: NO), the CPU 82 continues executing this processing. When the full cutters 41 are opposed to the cutting position FC1 (S172: YES), this flow goes to S174.

As in the processing at S165, the CPU 82 at S174 stops driving of the drive motor 66 to stop conveycance of the tape To.

As in the processing at S170, the CPU 82 at S176 controls the full cutters 41 to cut the tape To. It is noted that the half cut may be performed for the tape To with the half cutter 42.

As in the processing at S148, the CPU 82 at S178 restarts conveyance of the tape To, and this flow goes to S180.

The CPU 82 at S180 determines, based on the print information contained in the print data obtained at S130, whether the tape To or T has reached the printing starting position in the next current pattern cycle.

This determination also corresponds to detection of the mark M2 first by the optical sensor 65 (i.e., creation of any of the labels L3-L5) and is executed based on the second detection signal corresponding to the detection of the mark M2.

When the tape To or T has not reached the printing starting position (S180: NO), the CPU 82 continues executing this processing. That is, the CPU 82 continues the conveyance started at S105 and controls the drive motor 66 to perform the no-printing conveyance by the amount corresponding to the one pattern cycle. Since this no-printing conveyance is performed, cutting at the cutting position indicated by the cutting-position information contained in the print data obtained at S130 and printing based on the print information are not performed in this pattern cycle corresponding to determination at S135. Cutting at the cutting position and printing based on the print information are performed in the next pattern cycle performed after this pattern cycle (see S185-S210). When the tape To or T has reached the printing starting position (S180: YES), this flow goes to S181.

Processings at S181-S210 are similar to those at S141-S170. The CPU 82 at S181 controls the thermal head 22 to start printing. The CPU 82 at S182 determines whether the flag F is 1 and at S183 determines whether the type of the label requires the front cut. The CPU 82 at S184 determines whether the tape T has reached the front cut position. When the tape T has reached the front cut position, the CPU 82 at S185 stops conveyance of the tape To or T. The CPU 82 at S186 drives the full cutters 41 to cut the tape T (or drives the half cutter 42 to perform the half cut for the tape To. After switching the flag F to 1 at S187, the CPU 82 restarts conveyance of the tape T at S188.

The CPU 82 at S190 determines whether the tape To or T has reached the printing end position. When the tape To or T has reached the printing end position, the CPU 82 at S195 controls the thermal head 22 to stop printing. The CPU 82 at S200 determines whether the tape T has reached the cut position. When the tape T has reached the cut position, the CPU 82 at S205 controls the drive motor 66 to stop conveyance of the tape To or T and at S210 drives the full cutters 41 to cut the tape T, and this flow ends. The processings at S200-S210 are one example of a second cutting processing.

In the flow in FIG. 14, when the negative decision (NO) is made at S135, the flow need not go directly to S172 to execute the processings at S172-S210 at which the no-printing conveyance is performed to establish the next pattern cycle, and the cutting is performed as described above. That is, before the processing at S180, the display 64 or 303 may be controlled to provide a notification for prompting the user to select whether the cutting processing is to be executed based on the cutting information in the print data after the no-printing conveyance by about an amount corresponding to the one pattern cycle, for example. This processing is one example of a first notification processing. In this configuration, when the user has operated the operation device 63 or 302 to select performing the cutting, the no-printing conveyance may be performed to the next pattern cycle to perform the cutting at S172-S210. It is noted that conveyance of the tape To or T needs to be stopped while the user is operating the operation device 63 or 302. Thus, when the negative decision (NO) is made at S135, the CPU 82 outputs a control signal to the drive motor 66 via the motor drive circuit 62 to stop the drive motor 66. When the user has selected performing the cutting via the operation device 63 or 302, the CPU 82 outputs a control signal to the drive motor 66 via the motor drive circuit 62 to drive the drive motor 66. In this case, in the case where the first portion 92 left in the preceding creation of the label L is short, and creation of the label L having the long first portion 92 is indicated in the current operation, it is possible to confirm an intension of the user about whether the no-printing conveyance is to be performed by the amount corresponding to the one pattern cycle to create the desired label shape.

In the flow in FIG. 14, as described above, when the negative decision (NO) is made at S135, the flow goes directly to S172 to execute the processings at S172-S210 at which the no-printing conveyance is performed to the next pattern cycle, and the cutting is performed. Instead of this configuration, the display 64 or 303 may be controlled to display a notification for prompting the user to select the shape (i.e., the type) of another label L creatable without the no-printing conveyance, for example. This processing is one example of a second notification processing. It is noted that, while the operation device 63 or 302 is being operated by the user, conveyance of the tape To or T needs to be stopped. Thus, when the negative decision (NO) is made at S135, the CPU 82 outputs a control signal to the drive motor 66 via the motor drive circuit 62 to stop the drive motor 66. In this case, when the user has operated the operation device 63 or 302 to select the shape of the new label L in response to the notification, the CPU 82 controls the platen roller 25, the full cutters 41, and other relating components to cut the tape at the cutting position corresponding to the selected shape of the label L. This processing is one example of a third cutting processing. In this case, in the case where the first portion 92 left in the preceding creation of the label L is short, and creation of the label L having the long first portion 92 is indicated in the current operation, it is possible to confirm an intension of the user about whether the label shape is to be changed to avoid the no-printing conveyance by the amount corresponding to the one pattern cycle.

Effects

The following effects are achieved in the present embodiment.

In the present embodiment, as explained above with reference to, e.g., FIGS. 6A-9C, the user peels the label portion having the first portion 92B and the second portion 91B off from the separation sheet 54 and sticks the label portion to the adherend 19 to use the label portion as the flag label FL, for example. In these operations, an image is printed on the wide second portion 91, and the relatively narrow first portion 92 is wrapped around and stuck to the adherend 19, making it possible to associate the character/image information represented by the image with the adherend 19.

In the tape To according to the present embodiment, as illustrated in, e.g., FIGS. 5A-5C, the first portions 92 and the second portions 91 are continuously arranged in the longitudinal direction of the tape To in the elongated label LL on the separation sheet 54 in the order of the first portion 92A, the second portion 91A, the first portion 92B, the second portion 91B, and so on. It is possible to flexibly satisfy user's demand for the various uses of the label, by appropriately adjusting the dimensions, in the longitudinal direction of the tape, of the first portion 92 and the second portion 91 to be peeled in use (and constitute a portion of the label L) among the plurality of first portions 92A, 92B, 92C, and so on and the second portions 91A, 91B, 91C, and so on, for example, by cutting some midway portion of the first portion 92 and/or the second portion 91 in the longitudinal direction of the tape.

In the case where an amount of the character/image information in use is small, for example, the second portion 91 of the label portion to be peeled may be cut at some midway portion of the second portion 91 near the first portion 92 to shorten the second portion 91 of the label portion in the longitudinal direction of the tape, thereby preventing the second portion 91 from needlessly and obtrusively protruding from the cable after attachment of the label (see the flag label FL2 in FIGS. 7A-7C, for example). In the case where an amount of the character/image information in use is large, for example, the second portion 91 of the label portion to be peeled may not be cut at some midway portion of the second portion 91 (or the second portion 91 may be cut at a position far from the first portion 92) to increase the dimension of the second portion 91 of the label portion in the longitudinal direction of the tape, thereby reliably printing the entire character/image information on the second portion 91 (see the flag labels FL1 and FL3-FL5 in FIGS. 6A-6C and 8A-9C, for example).

In the case where a thin cable is used as the adherend 19, for example, the first portion 92 of the label portion to be peeled may be cut at its some midway portion near the second portion 91 to shorten or eliminate the dimension of the first portion 92 of the label portion in the longitudinal direction of the tape, thereby preventing generation of an obstructive remainder in wrapping (see the flag labels FL3-FL5 in FIGS. 8A-9C, for example). In the case where a thick cable is used as the adherend 19, for example, the first portion 92 of the label portion to be peeled may not be cut at its some midway portion (or the first portion 92 may be cut at a position far from the second portion 91) to increase the dimension of the first portion 92 of the label portion in the longitudinal direction of the tape, thereby reliably wrapping the label around the cable to firmly attach the label to the cable (see the flag labels FL1, FL2 in FIGS. 6A-6C and 7A-7C).

Figure 17A:
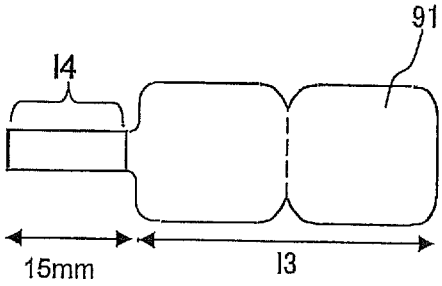
FIGS. 17A through 17D are views for explaining effects of the embodiment.
Figure 17B:
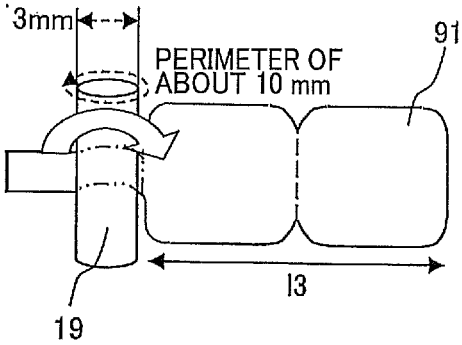

In the case where the label is used by being wrapped around the adherend 19 such as the cable as described above, from the viewpoint of achieving the firm attachment, the fourth length l4 (see FIG. 4B) of the first portion 92 is preferably greater than or equal to the specific length determined in advance so as to correspond to the outside diameter of the adherend 19, for example. Assuming the adherend 19 having an outside diameter of 3 mm, for example, it is considered that the specific length is about 15 mm that is the sum of (i) about 10 mm as the circumference (perimeter) of the adherend 19 and (ii) α mm as a slight additional length (see FIG. 17A). In this case, when the label is wrapped around the adherend 19, the first portion 92 is wrapped around an outer surface of the adherend 19 by an amount substantially equivalent to the circumference of the adherend 19 (see FIG. 17B).

Figure 17C:
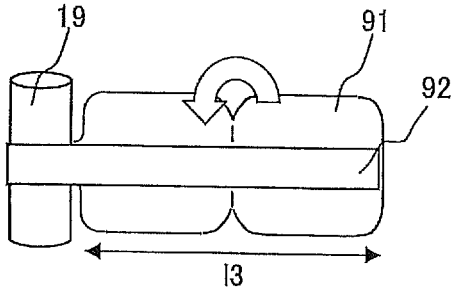
Figure 17D:
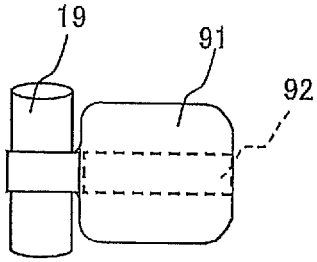

However, if the fourth length l4 is considerably greater than 15 mm, as illustrated in FIG. 17C, after the first portion 92 is wrapped around the outer surface of the adherend 19 by an amount substantially equivalent to the circumference of the adherend 19, the first portion 92 further extends on the second portion 91 to a position near an edge of the second portion 91. If the first portion 92 is further longer, there is a possibility of the first portion 92 obtrusively protruding from the second portion 91. In particular, as illustrated in FIG. 17D, when the second portion 91 is folded into a half, the first portion 92 may protrude from the folded second portion 91. Accordingly, from the viewpoint of using the flag label FL while preventing this unpreferable state, the fourth length l4 is preferably greater than or equal to the specific length of 15 mm and less than the sum of the specific length and the third length l3 (15 mm+l3). Also, if the fourth length l4 is greater than the sum of the specific length and the third length l3 (15 mm+l3), the first portion 92 is too long, which increases error in conveyance, resulting in deteriorated accuracy of the printing starting position and the cutting positions.

In the present embodiment, the tape includes the elongated label LL described above (having the label portions arranged continuously), which enables change in the length of each of the first portion 92 and the second portion 91 in the longitudinal direction of the tape, resulting in enhanced applications with fulfillment of user's demand for the various uses of the label. Also, it is possible to use the label smoothly with firm attachment by making the fourth length l4 greater than or equal to the specific length and less than the sum of the specific length and the third length l3.

In the present embodiment, for example, the specific length is greater than or equal to 14 mm and less than or equal to 16 mm (15 mm in the above-described example). Thus, when the label is attached to the adherend 19 having an outside diameter of 3 mm, firm attachment is achieved with the additional length of about 5 mm When the specific length is less than 14 mm, an amount of error in the cutting position with respect to the length of the first portion is large, making it difficult to accurately obtain the first portion having a length suitable for a desired use.

In the present embodiment, in particular, the through holes (i.e., the perforation) 56 arranged in the widthwise direction of the tape is formed in the central portion of the second portion 91 in the longitudinal direction of the tape. Thus, the second portion 91 is bent along the perforation 56 when peeled off from the separation sheet 54, it is possible to create the flag label FL in which its portion (e.g., the first print region 91*a*) located on one side of the perforation 56 serves as a front print surface after attachment, and a portion (e.g., the second print region 91*b*) of the flag label FL which is located on the other side of the perforation serves as a back print surface after attachment. That is, it is possible to create the flag label FL with desired information printed on its front and back surfaces.

In the present embodiment, in particular, the elongated label LL is stuck to the one surface 54*a* of the separation sheet 54, and the one surface 54*a* of the separation sheet 54 is exposed at an area located on an outer side of the elongated label LL in the widthwise direction of the tape. This configuration makes it easy for the user to peel the first portion 92 and the second portion 91 in use.

In the present embodiment, in particular, as illustrated in FIG. 2, the substrate 52*b* containing the elongated label LL is located on an inner side of the separation sheet 54 in the radial direction of the print-tape roll 51 in each of layers of the rolled tape To of the print-tape roll 51 which are stacked on each other in the radial direction. This configuration makes it difficult for the elongated label LL to be peeled off from the separation sheet 54 when compared with a configuration in which the tape To is rolled in a state in which the elongated label LL is located on an outer side of the separation sheet 54 in the radial direction.

In the present embodiment, the first portion 92 has the first length l1 in the widthwise direction of the tape, and the largest dimension of the second portion 91 in the widthwise direction of the tape is the second length l2 greater than the first length l1. In the case where the elongated label LL is peeled off from the separation sheet 54 and wrapped around the adherend 19 such as the cable as described above, from the viewpoint of higher durability when the elongated label LL is peeled off from the separation sheet 54 or after the elongated label LL is attached to the adherend 19, it is preferable to reduce generation of stress concentration at a boundary between the first portion 92 and the second portion 91.

In the present embodiment, as illustrated in FIG. 5B, the elongated label LL has the first connecting length l11 in the widthwise direction of the tape at the first position on the first connecting portion C1 (specifically, the reducing shape portions 400) which connects the upstream end portion 92*u* of the first portion 92 and the downstream end portion 91*d* of the second portion 91 to each other, and the elongated label LL has the second connecting length l12 greater than the first connecting length l11 in the widthwise direction of the tape at the second position nearer to the center of the second portion 91 than the first position in the longitudinal direction of the tape. Specifically, as illustrated in FIG. 5B, the outline of each of the reducing shape portions 400 has a continuously-curved shape (i.e., an arc shape), whereby the outline of each of the reducing shape portions 400 has a shape in which the dimension of the elongated label LL in the widthwise direction gradually increases toward the center of the second portion 91 in the longitudinal direction of the tape. This configuration reduces the stress concentration at the first connecting portion C1 to improve the durability, when compared with a configuration in which the first edge of the first portion 92 which extends in the longitudinal direction of the tape (e.g., the long side of the rectangular shape) and the edge of the second portion 91 which extends in the widthwise direction of the tape (e.g., the short side of the rectangular shape) are orthogonal to each other at the first connecting portion C1, for example. As a result, it is possible to improve the durability when the elongated label LL is peeled off from the separation sheet 54 or after the elongated label LL is attached to the adherend 19. Also, the curved shape in the first connecting portion C1 reduces generation of the stress concentration at a boundary between the first portion 92 and the second portion 91 when the elongated label LL is peeled off from the separation sheet 54 or after the elongated label LL is attached to the adherend 19, resulting in improved durability.

In the present embodiment, in particular, the longitudinal direction of the second portion 91 coincides with the longitudinal direction of the tape, and the second portion 91 has a substantially rectangular shape including the curved portions 91*r* at the four corners of the second portion 91. This configuration reduces damage to the flag label FL due to contact or interference of an external object with the second portion 91 in a state in which the first portion 92 is wrapped around the adherend 19 such as the cable, resulting in further improvement in the durability.

In the present embodiment, in particular, the first edges 921 of the first portion 92 which extend in the longitudinal direction of the tape and the second edges 91*s* of the second portion 91 which extend in the widthwise direction of the tape are orthogonal to each other at the second connecting portion C2 connecting the downstream end portion 92*d* of the first portion 92 and the upstream end portion 91*u* of the second portion 91 to each other.

That is, in the present embodiment, the second connecting portion C2 of each of the first portions 92A, 92B, 92C, and so on has the orthogonal connecting structure different from that of the first connecting portion C1 located on an opposite side of the first portion 92 from the second connecting portion C2. As a result, most of the first portions 92A, 92B, 92C, and so on in the longitudinal direction of the tappet are effectively used as the first portions 92A, 92B, 92C, and so on, and the durability is improved by the shape of the first connecting portion C1.

In the present embodiment, the slits 53 are formed on the outer portions of the second portion 91 in the widthwise direction of the tape. With this configuration, the peeled second portion 91 can be bent at the slits 53. In particular, the dimension 15 of the second portion 91 in the widthwise direction of the tape at the slits 53 is less than the dimension of the other portions of the second portion 91 (the second length l2 as the largest dimension in particular). The dimension 15 is 17 mm as one example. This configuration makes it possible to use the flag label FL in which the portion (e.g., the first print region 91*a*) of the second portion 91 which is located on one side of the slits 53 serves as a front print surface after attachment, and the portion (e.g., the second print region 91*b*) of the second portion 91 which is located on the other side of the slits 53 serves as a back print surface after attachment. That is, it is possible to use the flag label FL with desired information printed on its front and back surfaces. In particular, in addition to the slits 53 formed in the opposite end portions of the tape, the perforation 56 is formed at the central portion of the second portion 91 in the longitudinal direction of the tape. This perforation 56 further facilitates bending of the peeled second portion 91.

In the present embodiment, in particular, the first length l1 of the first portion 92 in the widthwise direction of the tape is less than or equal to one third of the second length l2 of the second portion 91 in the widthwise direction of the tape, for example. With this configuration, the dimension of the first portion 92 in the widthwise direction of the tape is reliably less than the dimension of the second portion 91 in the widthwise direction of the tape. As a result, the first portion 92 is easily wrapped around the adherend 19 such as the cable in the attachment when compared with a configuration in which the dimension of the first portion 92 in the widthwise direction of the tape is substantially equal to the dimension of the second portion 91 in the widthwise direction of the tape, for example. Even in the case where the adherend 19 such as the cable is disposed in a curved manner, the narrow first portion 92 is easily and reliably attached to the cable. Also, twisting the second portion 91 after the attachment makes it easy for the second portion 91 to rotate, about an axis extending in the longitudinal direction of the tape, relative to the first portion 92 wrapped around the adherend 19 such as the cable, making it easy for the user to visually recognize the character/image information on the second portion 91.

In the present embodiment, in particular, in manufacturing of the tape To, the substrate 52*b* having the same dimension as that of the separation sheet 54 in the widthwise direction of the tape To is stuck to the one surface 54*a* of the strip-shaped separation sheet 54 in advance, and the cut frame 57 forming the outline of the elongated label LL is formed in the substrate 52*b*, for example. Then, during conveyance of the entire strip-shaped separation sheet 54 and the entire substrate 52*b*, the outside-label portion D of the substrate 52*b* which is located outside the cut frame 57 is peeled off and removed from the separation sheet 54 while leaving the elongated labels LL of the substrate 52*b* which correspond to regions inside the cut frame 57. As a result, the one surface 54*a* of the separation sheet 54 is exposed on an outer side of the elongated label LL in the widthwise direction of the tape, that is, the one surface 54*a* in the first outer portions 54B and the second outer portions 54A is exposed.

As described above, the first connecting portion C1 includes the reducing shape portions 400 each having the outline of the continuously-curved shape (e.g., the arc shape), making it easy to smoothly peel the outside-label portion D without breaking the outside-label portion D during operation. This improves productivity in manufacturing of the tape. The above-described more smoothly peeling enables increase in viscosity of the adhesive layer 52*a* provided on a sticking surface of the substrate 52*b* which is nearer to the separation sheet 54. That is, the tape may be of a heavy-release type (a heavy-peeling type). In this case, it is possible to more firmly attach the elongated label LL to the adherend 19 such as the cable in the above-described attachment.

In the present embodiment, in particular, the first connecting portion C1 is located downstream of the second portion 91. Thus, when the tape T is discharged from the tape cartridge 100, the first connecting portion C1 is discharged in advance of the corresponding second portion 91. In this case, in the above-described peeling, the user in many cases peels the elongated label LL by peeling the label LL off from the separation sheet 54 in the order of the first portion 92 and the second portion 91 while holding the first portion 92 with user's hand. In this peeling manner, a particularly large load is imposed on the first connecting portion C1 between the first portion 92 peeled off from the separation sheet 54 first and the second portion 91 having not peeled off from the separation sheet 54 yet, so that the stress concentration easily occurs. Accordingly, the effect of reducing the stress concentration in the above-described configuration is particularly effective.

In the present embodiment, as described above, the cutting position of the first portion 92 and the cutting position of the second portion 91 are changed variously to change the shape of the label L variously. This configuration provides various uses of the label which are demanded by the user. Since each change in the cutting positions requires the user to set the cutting positions corresponding to the shape of the label L to be created, the setting of the cutting positions is preferably simple.

Thus, in the present embodiment, the CPU 301 of the operation terminal 300 executes the program for creating the label. By executing this program, the CPU 301 at S5 in FIG. 11 obtains the templates TP each containing the image information representing (i) a corresponding one of the labels L having shapes different from each other and (ii) and a corresponding one of the flag labels FL having shapes different from each other. Thereafter, the CPU 301 at S10 displays the images respectively representing the labels L, based on the obtained templates TP. When the user having viewed these images selects one of the images on the operation device 302, the CPU 301 creates the cutting-position information (representing two of the cutting positions FC1-FC5 and FC1'-FC4', for example) corresponding to the selected image and at S75 transmits the created cutting-position information to the printer 1.

With these processings, when the user selects the image displayed on the display 303 and representing the label L or the flag label FL the user wants to create, the first portion 92 and the second portion 91 are automatically cut at the cutting positions corresponding to the selection, thereby eliminating the need to perform the above-described complicated setting of the cutting positions. This improves convenience to the user.

In the present embodiment, the cutting positions of the tape T in cutting of the first portion 92 and the second portion 91 may be changed to create the label L having one of various shapes which is desired by the user. This configuration provides various uses of the label which are demanded by the user. The mark M1 and the mark M2 are provided on the tape To to set at least two types of the positions at which the tape T are cut by the full cutters 41 or the half cutter 42. Thus, the cutting positions FC of the first portion 92 or the second portion 91 may be changed desirably using the two marks M1, M2 to reliably fulfill user's demand for the various uses of the label. With this configuration, in the present embodiment, the tape includes the elongated label LL having the above-described continuous structure, and the cutting positions FC of the tape T are changed using the two marks M1, M2, which enables change in the length of each of the first portion 92 and the second portion 91 in the longitudinal direction of the tape, resulting in enhanced applications with fulfillment of user's demand for the various uses of the label.

The second portion 91 has the second length l2 greater than the first length l1 of the first portion 92. Thus, in the form of the label L, an image is formed on the relatively wide second portion 91 to print information as much as possible, and the relatively narrow first portion 92 is easily wrapped around the adherend 19 such as the cable. Furthermore, there is a relatively large distance between (i) the optical sensor 65 configured to sense the marks M1, M2 and (ii) the thermal head 22 and the full cutters 41. Thus, by providing the marks M1, M2 on the second portion 91 or a region corresponding to the second portion 91, it is possible to cut the first portion 92 well.

In the present embodiment, in particular, the length w1 of the mark M1 in the longitudinal direction of the tape is different from the length w2 of the mark M2 in the longitudinal direction of the tape. Thus, when the two marks M1, M2 are detected by the optical sensor 65 during conveyance of the tape To as described above, it is possible to easily identify which mark is detected, based on the length of the time of the detection.

In the present embodiment, in particular, the length w2 of the mark M2 is less than the length w1 of the mark M1. This configuration has the following significance. In the case where the tape To or T is conveyed with the first portion 92 as a downstream portion and the second portion 91 as an upstream portion as described above and in the case where the mark M2 is detected at a timing later than detection of the mark M1, even if a certain part of the first portion 92 has passed through the position of the full cutters 41 at this point, the second portion 91 located on the rear side of the first portion 92 in some cases has not reached the position of the full cutters 41 or the thermal head 22. Thus, this timing may be used as a timing of start of printing on the second portion 91 by the thermal head 22. In other words, when the mark M2 is detected, it is possible to consider that the positioning of the tape T to the printing starting position is completed. In this case, since a relatively large amount of information is in most cases printed on the second portion 91, it is preferable to quickly determine the start of the printing. A slight delay in the start of the printing may lead to difficulty in printing of all the to-be-printed information on the second portion 91.

Thus, in the present embodiment, as described above, the length w2 of the mark M2 in the longitudinal direction of the tape is less than the length w1 of the mark M1 in the longitudinal direction of the tape. This configuration expedites detection of the mark M2, thereby avoiding the above-described problem.

In the present embodiment, in particular, the mark-to-mark distance LM between the upstream end portion M1*u* of the mark M1 and the upstream end portion M2*u* of the mark M2 is less than the fourth length l4 of the first portion 92 (see FIG. 12C). This configuration has the following significance. That is, the mark M1 can be used for identification of the cutting position in the case where the first portion 92 is not cut at some midway position thereon, and the mark M2 can be used for identification of the cutting position in the case where the first portion 92 is cut at some midway position thereon in the present embodiment as described above. If the mark-to-mark distance LM between the upstream end portion M1*u* of the mark M1 and the upstream end portion M2*u* of the mark M2 is greater than the length l4 of the first portion 92 in this case, the entire first portion 92 may have passed through the position of the full cutters 41 at the timing of detection of the mark M2, leading to a possibility that the tape T cannot be cut at the first portion 92.

To solve this problem, the mark-to-mark distance LM between the mark M1 and the mark M2 is less than the length l4 of the first portion 92 in the present embodiment. This configuration avoids the above-described problem and makes it possible to reliably cut the first portion 92 at some midway position thereon.

In the present embodiment, in particular, the distance lM1 from the downstream end portion 92*d* of the first portion 92 to the downstream end portion M1*d* of the mark M1 is less than the distance L1 from the output opening P (specifically, the upstream end of the output opening) to the opening 104. This configuration has the following significance.

That is, in the present embodiment as described above, the label L is created by printing an image on the second portion 91 during conveyance of the tape To discharged from the tape cartridge 100 mounted on the printer 1 and by thereafter cutting the tape T. In this operation, the mark M1 is used for control for determining the tape cutting position. In this case, the position of the output opening P substantially corresponds to the position of the full cutters 41 provided in the printer 1, and the position of the opening 104 substantially corresponds to the position of the optical sensor 65 provided in the printer 1 to detect the mark M1, for example.

If the distance lM1 from the downstream end portion 92*d* of the first portion 92 to the downstream end portion M1*d* of the mark M1 is greater than the distance L1 from the output opening P to the opening 104 (specifically, the upstream end of the opening 104), when the mark M1 is detected by the optical sensor 65 through the opening 104, the downstream end portion 92*d* of the first portion 92 may have already passed through the position of the output opening P corresponding to the position of the full cutters 41, resulting in possibility of difficulty in cutting the tape T at an appropriate position (determined in the positioning control) in the first portion 92.

To solve this problem, in the present embodiment, the distance lM1 from the downstream end portion 92*d* of the first portion 92 to the downstream end portion M1*d* of the mark M1 is less than the distance L1 from the output opening P to the opening 104. This configuration avoids the above-described problem and makes it possible to reliably cut the tape T at an appropriate position (determined in the positioning control) in the first portion 92 when the mark M1 is detected by the optical sensor 65.

In the present embodiment, in particular, the distance lM2 from the downstream end portion 91*d* of the second portion 91 to the upstream end portion M2*u* of the mark M2 is less than the distance L2 from the recessed portion Q to the opening 104 (specifically, the downstream end of the opening 104). This configuration has the following significance.

That is, in the present embodiment, as in the above-described case, the label L is created by printing an image on the second portion 91 during conveyance of the tape To discharged from the tape cartridge 100 mounted on the printer 1 and by thereafter cutting the tape T. In this operation, the mark M2 is used for control for determining the position at which printing on the second portion 91 is started. In this case, the position of the recessed portion Q substantially corresponds to the printing position of the thermal head 22 provided in the printer 1, for example If the distance lM2 from the downstream end portion 91*d* of the second portion 91 to the mark M2 is greater than the distance L2 from the recessed portion Q to the opening 104, when the mark M2 is detected by the optical sensor 65 through the opening 104, the downstream end portion 91*d* of the second portion 91 may have already passed through the position of the recessed portion Q corresponding to the printing position of the thermal head 22, resulting in possibility that printing cannot be started from an appropriate position (determined in the positioning control) in the second portion 91.

To solve this problem, in the present embodiment, the distance lM2 from the downstream end portion 91*d* of the second portion 91 to the mark M2 is less than the distance L2 from the recessed portion Q to the opening 104. This configuration avoids the above-described problem and makes it possible to reliably start printing from an appropriate position (determined in the positioning control) in the second portion 91 when the mark M2 is detected by the optical sensor 65.

In the present embodiment, the cutting positions can be desirably changed using the marks M1, M2 to satisfy user's demand for the various uses of the label as described above. In this case, depending upon the cutting position FC in the preceding creation of the label, there is a possibility that a desired label shape intended by the user cannot always be obtained in the current creation of the label without any processing. Thus, processings to be executed are changed by the CPU 82, depending upon whether the mark M1 is detected after the start of conveyance for the current creation of the label and whether the second mark or the opening is detected.

That is, in the case where an upstream end portion of the label L is created in the preceding creation of the label by cutting the first portion 92 at some midway position therein in the longitudinal direction of the tape and in the case where the remaining first portion 92 is short (that is, in the case where the label L4 is created), for example, the optical sensor 65 detects the mark M2 without detecting the mark M1 after the start of conveyance in the current creation of the label. In consideration of a possibility that the length of the remaining first portion 92 is short, at the start of conveyance as described above, the CPU 82 at S135 in FIG. 14 determines whether the label having a shape corresponding to the print data obtained at S130 is creatable in a pattern cycle containing the detected mark M2.

Since the length of the remaining first portion is short as described above, the label L including the long first portion 92 (i.e., the label L1 or L2) cannot be created in the current pattern cycle as described above. Thus, in the case where the obtained print data indicates creation of the label L including the long first portion 92 (i.e., the label L1 or L2), it is determined that the creation of the label in the current pattern cycle is impossible. As a result, the CPU 82 determines that the creation of the label L including the long first portion 92 is to be executed in the next pattern cycle subsequent to the current pattern cycle, for example (see S180-S210).

In the case where the remaining first portion 92 is long (that is, in the case where one of the labels L1, L2, L3, L5 is created), the mark M1 is detected by the optical sensor 65 after the start of conveyance in the current creation of the label. In this case, in response to the first detection signal (noted that the CPU 82 ignores the second detection signal corresponding to detection of the mark M2 and input after the first detection signal), the CPU 82 at S140-S170 causes cutting at the cutting position FC based on the print data in the above-described pattern cycle containing the detected mark M1, regardless of the contents of the print data, thereby creating the label L having the shape desired by the user.

In the present embodiment as described above, when the cutting positions FC of the tape T are changed using the two marks M1, M2, the desired label shape intended by the user can be obtained regardless of the cutting positions FC in the preceding creation of the label, resulting in enhanced applications with fulfillment of user's demand for the various uses of the label.

In the present embodiment, in particular, when the CPU 82 determines at S135 that creation of the label is impossible in the above-described pattern cycle, cutting is performed at the cutting position FC based on the print data in the next pattern cycle subsequent to the pattern cycle containing the detected mark M2. This processing achieves the desired label shape intended by the user even in the case where the first portion 92 left in the preceding creation of the label is short, and the print data indicates creation of the label L including the long first portion 92 in the current creation of the label.

In the present embodiment, in particular, the CPU 82 obtains and refers to the label-creatable information contained in the matching table (see FIG. 16) and determines whether the label L is creatable. Thus, by using the label-creatable information of the matching table stored in advance, the CPU 82 can reliably determine whether the label L having the shape desired by the user is creatable in the above-described pattern cycle.

In the present embodiment, in particular, the CPU 82 identifies which of the first detection signal and the second detection signal is input, based on a period of detection of the optical sensor 65 which corresponds to the length w1 or w2 of the mark M1 or the mark M2. This processing easily and accurately identifies which of the mark M1 and the mark M2 is detected, based on whether the period of detection of the optical sensor 65 is long or short.

In the present embodiment, in particular, the CPU 82 obtains and refers to the detection-period information contained in the mark identification table (see FIG. 15) and identifies whether the detection signal input from the optical sensor 65 is the first detection signal or the second detection signal. By using the detection-period information of the mark identification table stored in advance, the CPU 82 can reliably identify whether the mark detected by the optical sensor 65 is the mark M1 or the mark M2.

In the present embodiment, in particular, in the case where not the first detection signal but the second detection signal is received from the optical sensor 65 after the start of conveyance of the tape To and in the case where the CPU 82 at S135 determines that creation of the label is possible in the current pattern cycle, cutting is performed at the cutting position FC based on the print data in the pattern cycle containing the detected mark M2. Accordingly, even in the case where the first portion 92 left in the preceding creation of the label is short, for example, when the print data indicates creation of the label having the short first portion 92 (i.e., any of the labels L3-L5), it is possible to reliably obtain the desired label shape intended by the user.

Modifications

While the embodiment has been described above, it is to be understood that the disclosure is not limited to the details of the illustrated embodiment, but may be embodied with various changes and modifications, which may occur to those skilled in the art, without departing from the spirit and scope of the disclosure.

(i) Variations in Arrangement of First Portions

Figure 18A:
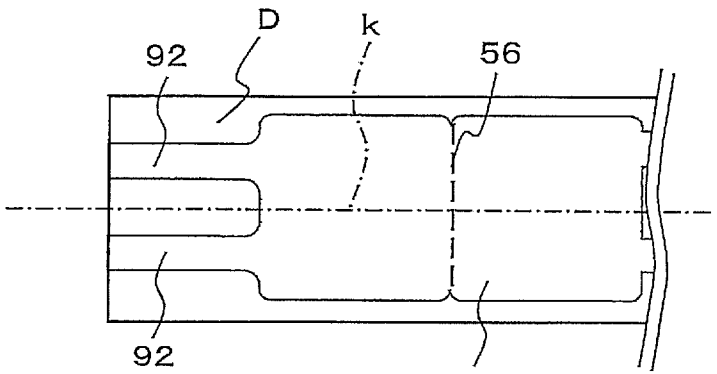
FIGS. 18A and 18B are plan views illustrating other examples of arrangement of the first portions.

It is noted that the configuration of the tape T is not limited to that illustrated in FIGS. 5A and 5B. For example, as illustrated in FIG. 18A, two first portions 92 may be provided on one side of one second portion 91 in the longitudinal direction of the tape. In this example, the two first portions 92 are provided downstream of the second portion 91 in the longitudinal direction of the tape. These two first portions 92 are different from each other in position in the widthwise direction of the tape and have line symmetry with respect to the center line k in the widthwise direction of the tape.

Figure 18B:
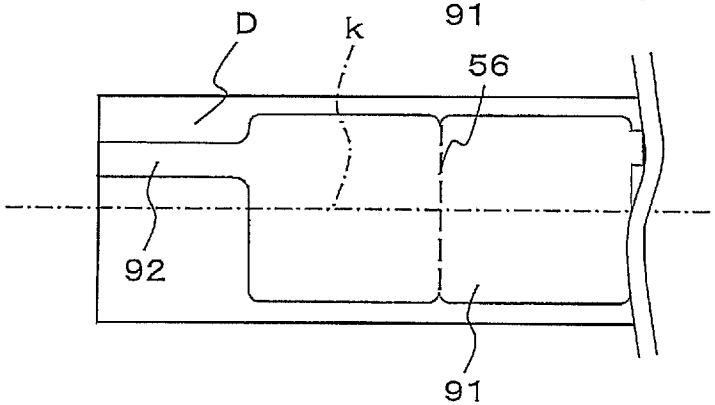

Also, as illustrated in FIG. 18B, one first portion 92 may be provided on one side (a downstream side in this example) of one second portion 91 in the longitudinal direction of the tape at a position located on any of opposite sides of the center line k in the widthwise direction of the tape, for example.

(ii) Variations in Reducing Shape Portion

Each of the reducing shape portions 400 configured to reduce stress concentration at the first connecting portion C1 has the continuously-curved shape in FIG. 5B but may have different shapes.

Figure 19A:
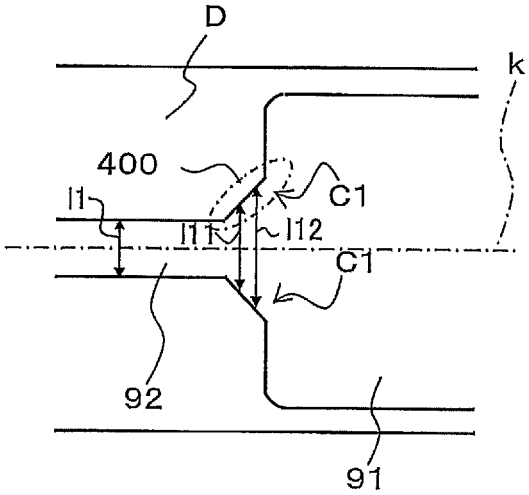
FIGS. 19A through 19C are plan views illustrating other examples of a reducing shape portion.
Figure 19B:
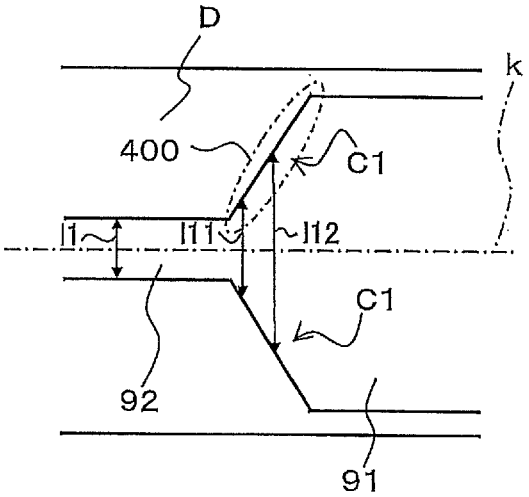
Figure 19C:
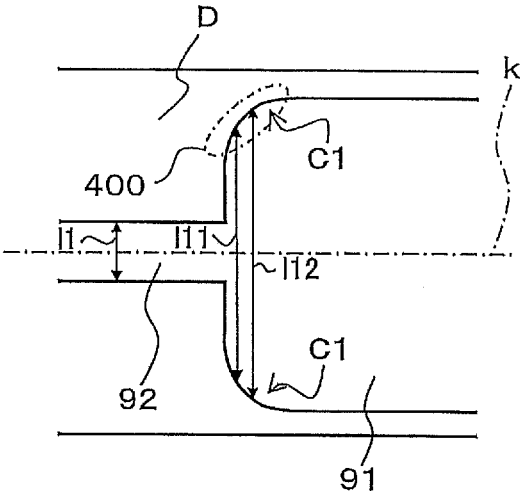

For example, as illustrated in FIG. 19A, the outline of each of the reducing shape portions 400 provided at the first connecting portion C1 is shaped like a wedge. The distance between these reducing shape portions 400 in the widthwise direction of the tape linearly increases toward the center of the second portion 91 in the longitudinal direction of the tape. In a modification of the reducing shape portions 400 in FIG. 19A, as illustrated in FIG. 19B, the distance between outer edges of the reducing shape portions 400 in the widthwise direction of the tape linearly increases to the dimension 12 of the second portion in the widthwise direction of the tape. In a modification of the reducing shape portions 400 in FIG. 19B, as illustrated in FIG. 19C, the distance between outer edges of the reducing shape portions 400 in the widthwise direction of the tape linearly does not increase, but the outline of each of the reducing shape portions 400 is curved in an arc shape. In any of the modifications, in the first connecting portion C1, the second connecting length l12 at the second position located nearer to the center of the second portion 91 than the first position is longer than the first connecting length l11 at the first position as in the configuration in FIG. 5B. These modifications achieve the same effects as obtained by the reducing shape portions 400 in FIG. 5B.

(iii) Case where Mark for Cutting along Perforation is Provided

Figure 20:
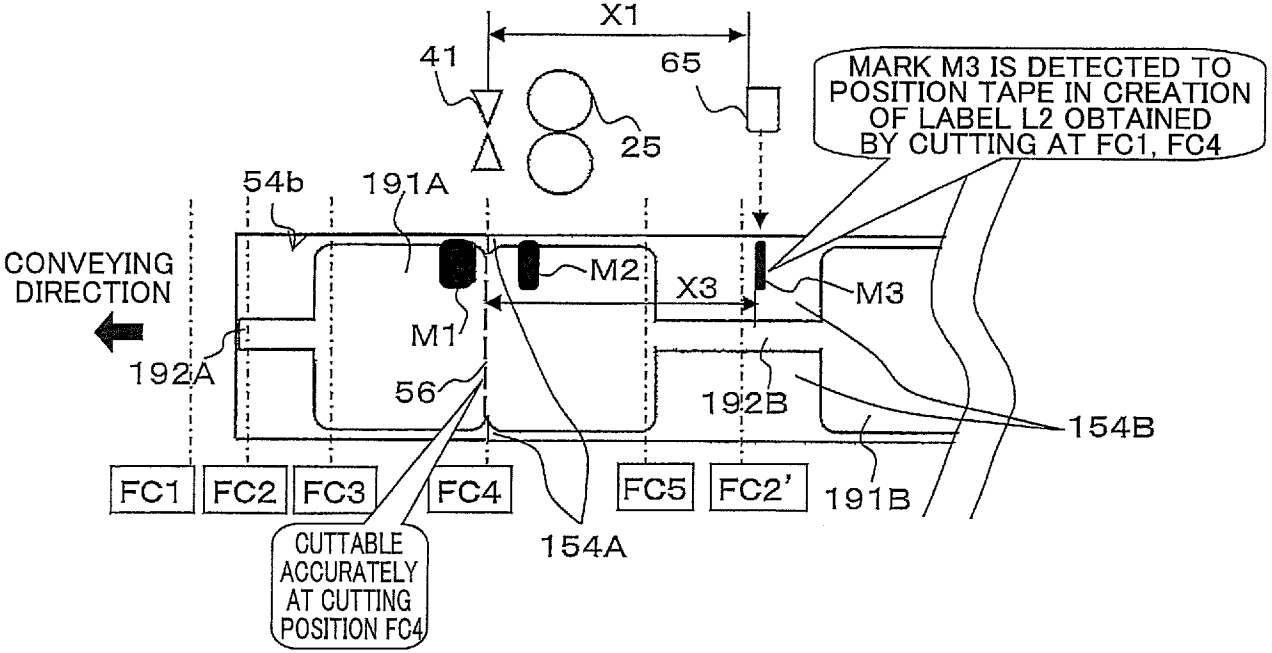
FIG. 20 is a view for explaining a situation in detection of a mark in the case where the mark for positioning in cutting of the tape along perforation is additionally provided on the tape.

As described above with reference to FIGS. 5C and 7A-7C, when creating the label L2, the printed tape T needs to be accurately cut at the cutting position FC4 that is the same position as the perforation 56 in the longitudinal direction of the tape. In a modification, as illustrated in FIG. 20, a mark M3 (as one example of a third mark and a third positioning mark) is formed on the tape To. This mark M3 is different from the marks M1, M2 and used for positioning in cutting at the cutting position FC4. In one example, when converted into the number of dots in the thermal head 22, the length of the mark M3 in the longitudinal direction of the tape is 50 dots (about 4 mm when the number of dots in the thermal head 22 is assumed to be 360 dpi).

That is, in the example illustrated in FIG. 20, the mark M3 corresponds to the marks M1, M2 formed on the second back portion 191A located on the right back from the second portion 91A and is formed on the first outer back portion 154B located on one side (an upper side in FIG. 20), in the widthwise direction of the tape, of the first back portion 192B corresponding to the first portion 92B located adjacent to and upstream of the second portion 91. The mark M3 is different from the mark M1 and the mark M2 in configuration.

In this modification, a distance X3 between the mark M3 and the perforation 56 in the longitudinal direction of the tape is equal to the sensor-to-cutter distance X1.

FIG. 21 illustrates one example of a mark recognition table in the case where the mark M3 is provided in addition to the marks M1, M2. As in FIG. 15, the table illustrated in FIG. 21 stores a relationship between each of the marks M1, M2, M3 and the corresponding detection-period information.

In this table, as in the above-described table, in the case where the detection period of the detection signal output from the optical sensor 65 is greater than or equal to the length equivalent to 125 dots and less than or equal to the length equivalent to 175 dots, it is considered that the mark M1 is detected. Also, in the case where the detection period of the detection signal output from the optical sensor 65 is greater than or equal to the length equivalent to 75 dots and less than the length equivalent to 125 dots (124 in FIG. 15), it is considered that the mark M2 is detected. In the case where the detection period of the detection signal output from the optical sensor 65 is greater than or equal to a length equivalent to 25 dots and less than the length equivalent to 75 dots (74 in FIG. 15), it is considered that the mark M3 is detected. That is, in this example, the length of the mark M3 in the longitudinal direction of the tape (i.e., the distance from an upstream end to a downstream end of the mark M3) is less than each of the length w1 of the mark M1 in the longitudinal direction of the tape and the length w2 of the mark M2 in the longitudinal direction of the tape (see FIG. 20).

Also in the present modification, the CPU 82 executes the determination at S135 in FIG. 14 by obtaining information (e.g., label-creatable information) stored in a table illustrated in FIG. 22 (e.g., a matching table) prepared and stored in the ROM 83 or another similar device in advance and by using the obtained information. It is noted that obtaining the information is another example of the label-creatable-information obtaining processing. In the table illustrated in FIG. 22, as in the table in FIG. 16, in the case where the mark M1 is detected first, any of the five labels L1-L5 is creatable in this pattern cycle (see marks "○"). In the case where the mark M2 is detected first, any of the labels L3-L5 is creatable in this pattern cycle (see marks "○"). In the case where the mark M3 is detected first, none of labels L1-L5 is not creatable in this pattern cycle (see marks "×").

While these two tables are stored in the printer 1 (in the ROM 83, for example) in this modification, the CPU 82 may access and read the tables stored in a device outside the printer 1 (as other examples of the first and second storages).

In the present modification, in creation of the label L2, the mark M3 different from the marks M1, M2 is used when the tape T is cut at the cutting position F4 located at the same position as the perforation 56 formed in the central portion of the second portion 91 in the longitudinal direction of the tape. This configuration enables control for determining the tape cutting position accurately.

Figure 23A:
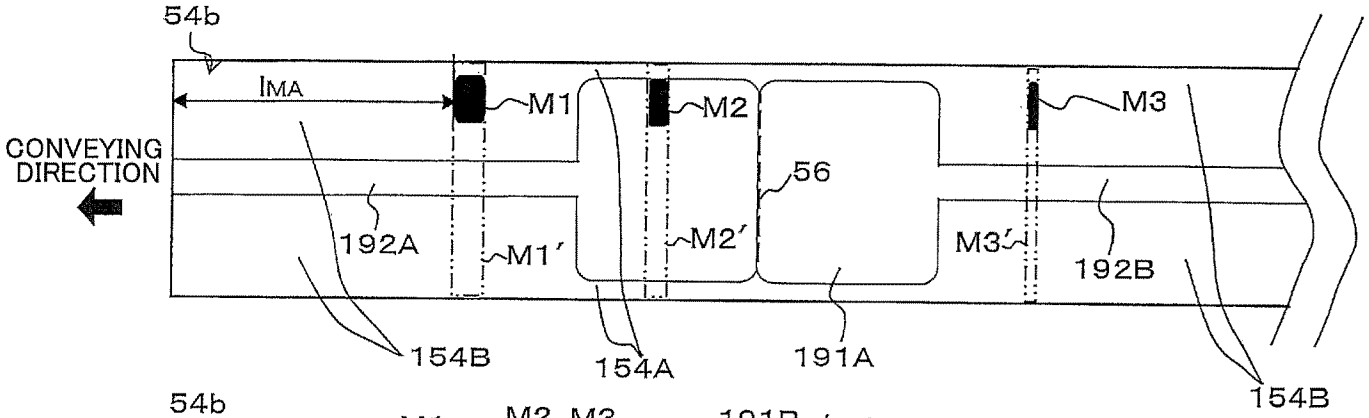
FIG. 23A is a plan view representing arrangement of the marks on the tape in a modification in which the first portions are long.

(iv) Other Variations in Position of Mark (iv-i) Case where First Portion is Long That is, as illustrated in FIG. 23A, in the case where the length of each of the first marks 92A, 92B, 92C, and so on in the longitudinal direction of the tape is relatively long, at least one of the marks M1, M2, e.g., the mark M1, may be formed on the first back portion 192 located on the right back from the first portion 92 or the first outer back portions 154B located on one side of the first back portion 192 in the widthwise direction of the tape. In this configuration, however, the distance lMA from the downstream end portion 92*d* of the first portion 92 to the mark M1 in the longitudinal direction of the tape needs to be less than or equal to the sensor-to-cutter distance X1. In the illustrated example, the mark M1 is formed on the first outer back portion 154B corresponding to the first back portion 192A located on the right back of the first portion 92A, the mark M2 is formed on the second back portion 191A located upstream of the first back portion 192A (specifically, the mark M2 is formed downstream of the perforation 56 on the second back portion 191A), and the mark M3 is formed on the first back portion 192B located upstream of the second back portion 191A.

In this modification, each of the marks M1, M2 may be formed on the other surface 54*b* of the separation sheet 54 across the length of the first portion 92 or the second portion 91 in the widthwise direction of the tape (see the marks M1', M2', M3' in FIG. 23A). This configuration enables the optical sensor 65 to reliably detect the marks M1', M2', M3' at any position of the tape To in its widthwise direction. In the configurations in FIGS. 12B, 12C, 13A, 13B, and 20, though not illustrated, each of the marks M1, M2, M3 may be formed on the other surface 54*b* of the separation sheet 54 across the length of the tape in its widthwise direction.

(iv-ii) Case where First Portion is Short

Figure 23B:
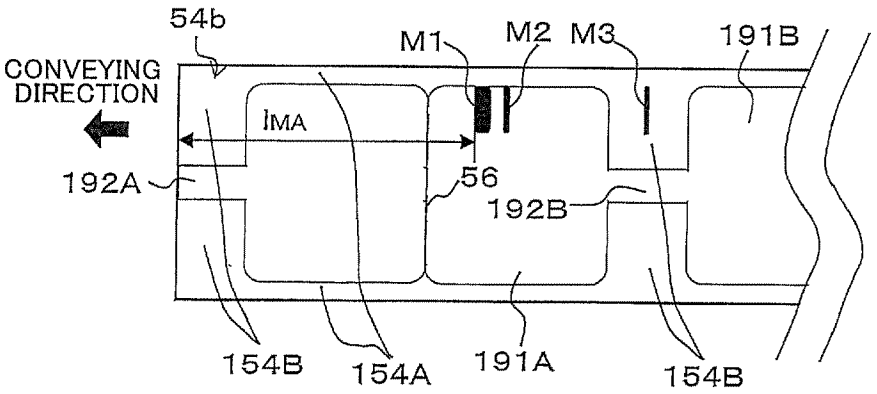
FIG. 23B is a plan view representing arrangement of the marks on the tape in a modification in which the first portions are short.

That is, as illustrated in FIG. 23B, in the case where the length of each of the first marks 92A, 92B, 92C, and so on in the longitudinal direction of the tape is relatively short, both of the marks M1, M2 may be formed on the second back portion 191 located on the right back of the second portion 91 or the second outer back portions 154A located on one side of the second back portion 191 in the widthwise direction of the tape. Also in this case, the distance lMA from the downstream end portion 92*d* of the first portion 92 to the mark M1 in the longitudinal direction of the tape needs to be less than or equal to the sensor-to-cutter distance X1.

In the illustrated example, both of the marks M1, M2 are formed on the second back portion 191A, located upstream of the first back portion 192A, at a position located upstream of the perforation 56. Also, the mark M3 is formed on the first outer back portion 154B corresponding to the first back portion 192B located upstream of the second back portion 191A.

(v) Case Where Openings are Provided Instead of Marks

Figure 24:
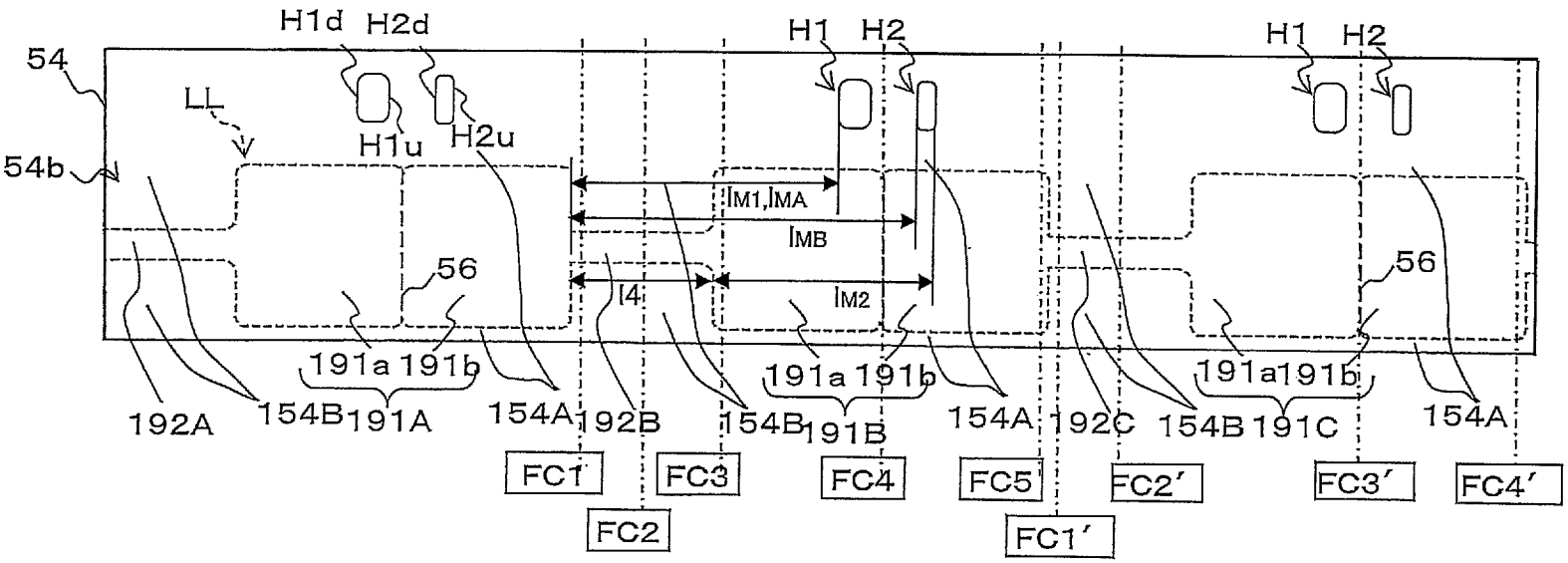
FIG. 24 is a plan view illustrating a modification with openings instead of the marks.

That is, instead of the marks M1, M2 illustrated in, e.g., FIGS. 12B and 12 C, as illustrated in FIG. 24, an opening H1 (as one example of a first opening) and an opening H2 (as one example of a second opening) may be formed in the tape To. Each of the openings H1, H2 may be any of a through hole and a blind hole detectable by the optical sensor 65. In this example, the dimension of the separation sheet 54 in the widthwise direction of the tape is greater than the largest dimension of the elongated label LL in the widthwise direction (i.e., the distance 12). Also, each of the openings H1, H2 is formed in the separation sheet 54 at an exposed region (specifically, the second outer back portion 154A) on which the elongated label LL is not provided and which is located on one side (an upper side in FIG. 24) of the elongated label LL in the widthwise direction of the tape. Also, each of the openings H1, H2 is formed so as to correspond to the second portion 91A in the widthwise direction of the tape.

In this configuration, dimensional and positional relationships between the openings H1, H2 are the same as those between the marks M1, M2. That is, an upstream end portion H1*u* of the opening H1 and an upstream end portion H2*u* of the opening H2 are different from each other in position in the longitudinal direction of the tape, and a downstream end portion H1*d* of the opening H1 and a downstream end portion H2*d* of the opening H2 are different from each other in position in the longitudinal direction of the tape. That is, the distance lMB from the downstream end portion 92*d* of the first portion 92 to the opening H2 in the longitudinal direction of the tape is greater than the distance lMA (=the distance lM1) from the downstream end portion 92*d* of the first portion 92 to the opening H1 in the longitudinal direction of the tape. The upstream end portion H1*u* of the opening H1 is located downstream of the downstream end portion H2*d* of the opening H2.

The length of the opening H1 in the longitudinal direction of the tape (i.e., a distance from the upstream end portion H1*u* of the opening H1 to the downstream end portion H1*d* thereof, which distance is in this example equal to the length w1 that is the same as that in the above-described embodiment) is different from the length w2 of the opening H2 in the longitudinal direction of the tape (i.e., a distance from the upstream end portion H2*u* of the opening H2 to the downstream end portion H2*d* thereof, which distance is in this example equal to the length w2 that is the same as that in the above-described embodiment). Specifically, the length w2 of the opening H2 is less than the length w1 of the opening H1, for example. An opening-to-opening distance, not illustrated, between the upstream end portion H1*u* of the opening H1 and the upstream end portion H2*u* of the opening H2 in the longitudinal direction of the tape (which distance is equal to the mark-to-mark distance LM) is less than the length l4 of the first portion 92.

As a relationship with the tape cartridge 100, a distance from the downstream end portion 92*d* of the first portion 92 to the downstream end portion H1*d* of the opening H1 (which distance is equal to the distance lM1 that is the same as that in the above-described embodiment) is less than the distance L1 (see FIG. 3) from the output opening P (specifically, the upstream end of the output opening) to the opening 104. A distance from the downstream end portion 91*d* of the second portion 91 to the upstream end portion H2*u* of the opening H2 (which distance is equal to the distance lM2 that is the same as that in the above-described embodiment) is less than the distance L2 (see FIG. 3) from the recessed portion to the opening 104 (specifically, the downstream end of the opening 104).

This modification with the openings H1, H2 instead of the marks M1, M2 also achieves the same effects as obtained in the above-described embodiment. Also, the openings H1, H2 are formed in the separation sheet 54 at the second outer back portion 154A located outside the elongated label LL. This configuration enables the above-described positioning of the tape To or T without reduction in strength of the label L due to the openings formed in the elongated label LL.

Though not illustrated, the mark M3 may be replaced with an opening. This modification also achieves the same effects as described above.

(vi) Applications to Standalone Type

In the above-described embodiment, the procedure in FIG. 10 is performed by executing the processings in the flow in FIG. 11 in the operation terminal 300 connected to the printer 1 so as to transmit and receive information, but the present disclosure is not limited to this configuration. That is, the procedure in FIG. 10 may be performed by executing the processings in the flow in FIG. 11 in a printer having a configuration similar to that of the printer 1 (i.e., a printer of the standalone type which is capable of operating alone). In this modification, for example, the following configuration and processings are established and executed: the EEPROM 84 stores the templates TP and a program similar to the application program 320; the CPU 82 reads the program to execute the processing at S5 in FIG. 11 (the obtaining procedure) to obtain the templates TP; the CPU 82 at S10 (the image display procedure) controls the display 64 to display the screen 303A (noted that the CPU 82 executing this processing is one example of a display controller); the CPU 82 at S15 (the selection accepting procedure) to accept a result of selection of the template TP (noted that the CPU 82 executing this processing is one example of a selection accepter); the CPU 82 at S20-S55 controls the display 64 to display the screens 303B-303E and accepts inputs and selections (noted that the processings S20 and S45 are one example of the area display procedure); the CPU 82 at S65 controls the display 64 to display the preview screen 303F; and when the print instruction is received, the CPU 82 at S75 transmits the print data to the label creating mechanism including the thermal head 22, the thermal-head drive circuit 61, the ribbon take-up shaft 125, the conveying-roller drive shaft 23, the drive motor 66, the motor drive circuit 62, the full cutters 41, the drive motor 71, the motor drive circuit 70, the half cutter 42, the drive motor 73, and the motor drive circuit 72 (noted that the CPU 82 executing this processing is one example of an information transmitter). This modification also achieves the same effects as described above.

(vii) Others

In the above-described description, each of the wordings "orthogonal", "parallel", "planar", and so on is not used in a strict sense. That is, tolerance and error in designing and manufacturing are allowed for these wordings, and the wordings "orthogonal", "parallel", "planar", and so on respectively mean "substantially orthogonal", "substantially parallel", "substantially planar", and so on.

In the above-described description, likewise, each of the wordings "same", "equal", "different", and so on in dimension and size in external appearance is not used in a strict sense. That is, tolerance and error in designing and manufacturing are allowed for these wordings, and the wordings "same", "equal", "different", and so on respectively mean " substantially same", " substantially equal", "substantially different", and so on. It should be understood that each of the wordings "same", "equal", "different", and so on is used in a strict sense for values used for determination or separation such as threshold values and reference values.

Each arrow in FIG. 4 indicates one example of a flow of signals and does not limit the direction of flow of the signals.

The flow charts illustrated in FIGS. 11 and 14 are embodied by way of example. For the flow charts, processings may be added, removed, altered, combined, and reordered without departing from the spirit of the scope of the present disclosure, for example.

The techniques in the embodiments and modifications may be combined with each other as needed.

It is to be understood that the disclosure is not limited to the details of the illustrated embodiments and modifications, but may be embodied with various changes and modifications, which may occur to those skilled in the art, without departing from the spirit and scope of the disclosure.

What is claimed is:

1. A tape, comprising:

a sheet having a strip shape and extending in a longitudinal direction of the tape; and an elongated label extending in the longitudinal direction and stuck to the sheet, the elongated label comprising:

a plurality of first portions each extending in the longitudinal direction; and a plurality of second portions, one of the plurality of second portions being located next to one of the plurality of first portions and located on a first side of the one of the plurality of first portions in the longitudinal direction, another of the plurality of second portions being located next to the one of the plurality of first portions and located on a second side of the one of the plurality of first portions in the longitudinal direction, the first side and the second side being opposite to each other in the longitudinal direction, a second-side end portion of the one of the plurality of second portions being connected to a first-side end portion of the one of the plurality of first portions, and a first-side end portion of the another of the plurality of second portions being connected to a second-side end portion of the one of the plurality of first portions, wherein the one of the plurality of first portions has a first length in a widthwise direction of the tape orthogonal to the longitudinal direction, each of the one of the plurality of second portions and the another of the plurality of second portions has a second length in the widthwise direction, the second length is greater than the first length, wherein slits are formed on outer portions of the plurality of second portions in the widthwise direction.

2. The tape according to claim 1, wherein each of the one of the plurality of second portions and the another of the plurality of second portions has a third length in the longitudinal direction, the one of the plurality of first portions has a fourth length in the longitudinal direction, and the fourth length is greater than or equal to a specific length and less than a sum of the specific length and the third length.

3. The tape according to claim 2, wherein the fourth length is greater than or equal to 0.3 times the third length and less than or equal to 1.3 times the third length.

4. The tape according to claim 2, wherein the fourth length is less than or equal to the third length.

5. The tape according to claim 2, wherein the specific length is greater than or equal to 14 mm and less than or equal to 16 mm.

6. The tape according to claim 1, wherein each of the plurality of second portions comprises a foldable line extending in the widthwise direction and located at a central portion of said each of the plurality of second portions in the longitudinal direction.

7. The tape according to claim 1, wherein each of the plurality of first portions has line symmetry with respect to a center line of each of the plurality of second portions in the widthwise direction, and the center line extends in the longitudinal direction.

8. The tape according to claim 1, wherein each of the plurality of first portions has a substantially rectangular shape extending in the longitudinal direction, and wherein positions of the plurality of first portions in the widthwise direction are identical to each other.

9. The tape according to claim 1, wherein the elongated label is stuck to a first surface of the sheet, and wherein the first surface of the sheet is exposed at a region outside the elongated label in the widthwise direction.

10. The tape according to claim 1, wherein the tape is rolled to form a tape roll.

11. The tape according to claim 10, wherein the tape is rolled so as to form a plurality of layers stacked on each other in a radial direction of the tape roll, and wherein the elongated label is located on an inner side of the sheet with respect to the sheet in the radial direction in each of the plurality of layers of the tape.

12. The tape according to claim 1, wherein the first-side end portion of the one of the plurality of second portions and the second-side end portion of the one of the plurality of first portions are connected to each other by a first connecting portion in which a first edge, extending in the longitudinal direction, of the one of the plurality of second portions and a second edge, extending in the widthwise direction, of the second-side end portion are connected to each other via a reducing shape portion for reducing stress concentration.

13. The tape according to claim 12, wherein the second-side end portion of the one of the plurality of second portions and the first-side end portion of the one of the plurality of first portions are connected to each other by a second connecting portion in which the first edge, extending in the longitudinal direction, of the one of the plurality of second portions and a third edge, extending in the widthwise direction, of the first-side end portion are directly connected to and orthogonal to each other, not forming continuous curved shapes.

14. A tape, comprising:

a sheet having a strip shape and extending in a longitudinal direction of the tape; and an elongated label extending in the longitudinal direction and stuck to the sheet, the elongated label comprising:

a first sticking portion to be stuck to an adherend;

a first label portion located on a first side of the first sticking portion in the longitudinal direction and on which printing is to be performed by a printing device, wherein a second side is opposite to the first side in the longitudinal direction of the tape;

a second sticking portion which is located on the first side of the first label portion in the longitudinal direction and which is to be stuck to the adherend; and a second label portion which is located on the first side of the second sticking portion in the longitudinal direction and on which printing is to be performed by the printing device, wherein a first-side end portion of the first label portion is connected to a second-side end portion of the second sticking portion, a second-side end portion of the first label portion is connected to a first-side end portion of the first sticking portion, and a first-side end portion of the second sticking portion is connected to a second-side end portion of the second label portion, wherein each of the first sticking portion and the second sticking portion has a first length in a widthwise direction of the tape orthogonal to the longitudinal direction, each of the first label portion and the second label portion has a second length in the widthwise direction, and the second length is greater than the first length, each of the first label portion and the second label portion has a third length in the longitudinal direction, and each of the first sticking portion and the second sticking portion has a fourth length in the longitudinal direction, and the fourth length is greater than or equal to a specific length and less than a sum of the specific length and the third length, and wherein the first-side end portion of the second sticking portion and the second-side end portion of the second label portion are connected to each other by a first connecting portion in which a first edge, extending in the longitudinal direction, of the second sticking portion and a second edge, extending in the widthwise direction, of the second-side end portion are connected to each other via a reducing shape portion for reducing stress concentration.

15. The tape according to claim 14, wherein the reducing shape portion is an arc having a radius of a predetermined length.

16. The tape according to claim 14, wherein the second-side end portion of the second sticking portion and the first-side end portion of the first label portion are connected to each other by a second connecting portion in which the first edge, extending in the longitudinal direction, of the second sticking portion and a third edge, extending in the widthwise direction, of the first-side end portion are directly connected to and orthogonal to each other, not forming continuous curved shapes.

17. A tape cartridge, comprising:

a housing;

an ink ribbon roll that is a roll of an ink ribbon; and a tape roll that is a roll of a tape, the tape comprising:

a sheet having a strip shape and extending in a longitudinal direction of the tape; and an elongated label extending in the longitudinal direction and stuck to the sheet, the elongated label comprising:

a plurality of first portions each extending in the longitudinal direction; and a plurality of second portions, one of the plurality of second portions being located next to one of the plurality of first portions and located on a first side of the one of the plurality of first portions in the longitudinal direction, another of the plurality of second portions being located next to the one of the plurality of first portions and located on a second side of the one of the plurality of first portions in the longitudinal direction, the first side and the second side being opposite to each other in the longitudinal direction, a second-side end portion of the one of the plurality of second portions being connected to a first-side end portion of the one of the plurality of first portions, a first-side end portion of the another of the plurality of second portions being connected to a second-side end portion of the one of the plurality of first portions, the one of the plurality of first portions having a first length in a widthwise direction of the tape, each of the one of the plurality of second portions and the another of the plurality of second portions having a second length in the widthwise direction, the second length being greater than the first length, each of the one of the plurality of second portions and the another of the plurality of second portions having a third length in the longitudinal direction, the one of the plurality of first portions having a fourth length in the longitudinal direction, the fourth length being greater than or equal to a specific length and less than a sum of the specific length and the third length, wherein slits are formed on outer portions of the plurality of second portions in the widthwise direction.

18. A tape comprising:

a sheet having a strip shape and extending in a longitudinal direction of the tape; and an elongated label extending in the longitudinal direction and stuck to the sheet, the elongated label comprising:

a plurality of second portions, one of the plurality of second portions being located next to one of a plurality of first portions and located on a first side of the one of the plurality of first portions in the longitudinal direction, another of the plurality of second portions being located next to the one of the plurality of first portions and located on a second side of the one of the plurality of first portions in the longitudinal direction, the first side and the second side being opposite to each other in the longitudinal direction, a second-side end portion of the one of the plurality of second portions being connected to a first-side end portion of the one of the plurality of first portions, and a first-side end portion of the another of the plurality of second portions being connected to a second-side end portion of the one of the plurality of first portions, wherein the one of the plurality of first portions has a first length in a widthwise direction of the tape orthogonal to the longitudinal direction, each of the one of the plurality of second portions and the another of the plurality of second portions has a second length in the widthwise direction, wherein the second length is greater than the first length, wherein the first-side end portion of the one of the plurality of first portions and the second-side end portion of the one of the plurality of second portions are connected to each other by a first connecting portion in which a first edge, extending in the longitudinal direction, of the one of the plurality of first portions and a second edge, extending in the widthwise direction, of the second-side end portion are connected to each other via a reducing shape portion for reducing stress concentration.

19. The tape according to claim 18, wherein the reducing shape portion is an arc having a radius of a predetermined length.

20. The tape according to claim 18, wherein the second-side end portion of the one of the plurality of second portions and the first-side end portion of said another of the plurality of first portions are connected to each other by a second portion in which the first edge, extending in the longitudinal direction, of the one of the plurality of second portions and a third edge, extending in the widthwise direction, of the first-side end portion are directly connected to and orthogonal to each other, not forming continuous curved shapes.

* * * * *